US007080700B2

(12) United States Patent
Bloom et al.

(10) Patent No.: US 7,080,700 B2
(45) **Date of Patent: *Jul. 25, 2006**

(54) TRACTOR WITH IMPROVED VALVE SYSTEM

(75) Inventors: Duane Bloom, Anaheim, CA (US); Norman Bruce Moore, Aliso Viejo, CA (US); Robert Levay, Yorba Linda, CA (US)

(73) Assignee: Western Well Tool, Inc., Anaheim, CA (US)

( * ) Notice: Subject to any disclaimer, the term of this patent is extended or adjusted under 35 U.S.C. 154(b) by 43 days.

This patent is subject to a terminal disclaimer.

(21) Appl. No.: 10/759,664

(22) Filed: Jan. 19, 2004

(65) Prior Publication Data

US 2004/0144548 A1 Jul. 29, 2004

Related U.S. Application Data

(63) Continuation of application No. 10/004,965, filed on Dec. 3, 2001, now Pat. No. 6,679,341.

(60) Provisional application No. 60/250,847, filed on Dec. 1, 2000.

(51) Int. Cl.
*E21B 4/04* (2006.01)

(52) U.S. Cl. ..... 175/51; 175/98; 175/104

(58) Field of Classification Search ..... 175/51, 175/97, 98, 99, 104, 105; 299/31
See application file for complete search history.

(56) References Cited

U.S. PATENT DOCUMENTS 2,167,194 A 7/1939 Anderson
2,271,005 A 1/1942 Grebe

FOREIGN PATENT DOCUMENTS

EP 0 257 744 B1 1/1995
WO WO 94/27022 11/1994

OTHER PUBLICATIONS

"Kolibomac to Challenge Tradition." Norwegian Oil Review, 1988. pp. 50 & 52.

*Primary Examiner*—William Neuder
(74) *Attorney, Agent, or Firm*—Knobbe Martens Olson & Bear LLP

(57) ABSTRACT

A hydraulically powered tractor includes an elongated body, two gripper assemblies, at least one pair of aft and forward propulsion cylinders and pistons, and a valve system. The valve system comprises an inlet control valve, a two-position propulsion control valve, a two-position gripper control valve, two cycle valves, and two pressure reduction valves. The inlet control valve spool includes a hydraulically controlled deactivation cam that locks the valve in a closed position, rendering the tractor non-operational. The propulsion control valve is piloted on both ends by fluid pressure in the gripper assemblies. The propulsion control valve controls the distribution of operating fluid to and from the propulsion cylinders, such that one cylinder performs a power stroke while the other cylinder performs a reset stroke. Each end of the gripper control valve is piloted by a source of high-pressure fluid selectively admitted by one of the cycle valves. The gripper control valve controls the distribution of operating fluid to and from the gripper assemblies. The cycle valves are spring-biased and piloted by fluid pressure in the propulsion cylinders, so that the gripper control valve shifts only after the cylinders complete their strokes. The pressure reduction valves limit the pressure within the gripper assemblies. These valves are spring-biased and piloted by the pressure of fluid flowing into the gripper assemblies. Some or all of the valves include centering grooves on the landings of the spools, which reduce leakage and produce more efficient operation. The propulsion control and gripper control valves include spring-assisted detents to prevent inadvertent shifting.

34 Claims, 22 Drawing Sheets

U.S. PATENT DOCUMENTS 2,946,565 A 7/1960 Williams
2,946,578 A 7/1960 De Smaele
3,138,214 A 6/1964 Bridwell
3,180,436 A 4/1965 Kellner et al.
3,180,437 A 4/1965 Kellner et al.
3,185,225 A 5/1965 Ginles
3,224,513 A 12/1965 Weeden, Jr.
3,224,734 A 12/1965 Hill
3,225,843 A 12/1965 Ortloff et al.
3,376,942 A 4/1968 Van Winkle
3,497,019 A 2/1970 Ortloff
3,599,712 A 8/1971 Magill
3,606,924 A 9/1971 Malone
3,797,589 A 3/1974 Kellner et al.
3,827,512 A 8/1974 Edmond
RE28,449 E 6/1975 Edmond
3,941,190 A 3/1976 Conover
3,978,930 A 9/1976 Schroeder
3,992,565 A 11/1976 Gatfield
4,085,808 A 4/1978 Kling
4,095,655 A 6/1978 Still
4,141,414 A 2/1979 Johansson
4,314,615 A 2/1982 Sodder, Jr. et al.
4,365,676 A 12/1982 Boyadjieff et al.
4,372,161 A 2/1983 De Buda et al.
4,385,021 A 5/1983 Neeley
4,440,239 A 4/1984 Evans
4,463,814 A 8/1984 Horstmeyer et al.
4,558,751 A 12/1985 Huffaker
4,615,401 A 10/1986 Garrett
4,674,914 A 6/1987 Wayman et al.
4,686,653 A 8/1987 Staron et al.
4,811,785 A 3/1989 Weber
4,821,817 A 4/1989 Cendre et al.
4,854,397 A 8/1989 Warren et al.
4,951,760 A 8/1990 Cendre et al.
5,010,965 A 4/1991 Schmelzer
5,169,264 A 12/1992 Kimura
5,184,676 A 2/1993 Graham et al.
5,186,264 A 2/1993 du Chaffaut
5,310,012 A 5/1994 Cendre et al.
5,363,929 A 11/1994 Williams et al.
5,425,429 A 6/1995 Thompson
5,449,047 A 9/1995 Schivley, Jr.
5,467,832 A 11/1995 Orban et al.
5,519,668 A 5/1996 Montaron
5,613,568 A 3/1997 Sterner et al.
5,752,572 A 5/1998 Baiden et al.
5,758,731 A 6/1998 Zollinger
5,758,732 A 6/1998 Liw
5,794,703 A 8/1998 Newman et al.
5,803,193 A 9/1998 Krueger et al.
5,857,731 A 1/1999 Heim et al.
6,003,606 A 12/1999 Moore et al.
6,026,911 A 2/2000 Angle et al.
6,031,371 A 2/2000 Smart
6,082,461 A 7/2000 Newman et al.
6,089,323 A 7/2000 Newman et al.
6,241,031 B1 6/2001 Beaufort et al.
6,347,674 B1 2/2002 Bloom et al.
6,431,270 B1 8/2002 Angle
6,679,341 B1 * 1/2004 Bloom et al. ..... 175/51

* cited by examiner

TRACTOR WITH IMPROVED VALVE SYSTEM

CLAIM FOR PRIORITY

The present application is a continuation of U.S. application Ser. No. 10/004,965, filed Dec. 3, 2001, now U.S. Pat. No. 6,679,341, which claims the benefit under 35 U.S.C. § 119(e) of U.S. Provisional Patent Application Ser. No. 60/250,847, filed Dec. 1, 2000.

INCORPORATION BY REFERENCE

This application incorporates by reference the entire disclosures of (1) U.S. Pat. No. 6,347,674 to Bloom et al.; (2) U.S. Pat. No. 6,241,031 to Beaufort et al.; (3) U.S. Pat. No. 6,003,606 to Moore et al.; (4) U.S. Pat. No. 6,464,003 to Bloom et al.; (5) U.S. Provisional Patent Application Ser. No. 60/250,847, filed Dec. 1, 2000; and (6) U.S. Pat. No. 6,679,341.

BACKGROUND OF THE INVENTION

1. Field of the Invention

This invention relates generally to tractors for moving equipment within passages.

2. Description of the Related Art

The art of moving equipment through vertical, inclined, and horizontal passages plays an important role in many industries, such as the petroleum, mining, and communications industries. In the petroleum industry, for example, it is often required to move drilling, intervention, well completion, and other forms of equipment within boreholes drilled into the earth.

One method for moving equipment within a borehole is to use rotary drilling equipment. In traditional rotary drilling, vertical and inclined boreholes are commonly drilled by the attachment of a rotary drill bit and/or other equipment (collectively, the "Bottom Hole Assembly" or BHA) to the end of a rigid drill string. The drill string is typically constructed of a series of connected links of drill pipe that extends between ground surface equipment and the BHA. A passage is drilled as the drill string and drill bit are together lowered into the earth. A drilling fluid, such as drilling mud, is pumped from the ground surface equipment through an interior flow channel of the drill string to the drill bit. The drilling fluid is used to cool and lubricate the bit, and only recently for drilling to remove debris and rock chips from the borehole, which are created by the drilling process. The drilling fluid returns to the surface, carrying the cuttings and debris, through the annular space between the outer surface of the drill pipe and the inner surface of the borehole. As the drill string is lowered or raised within the borehole, it is necessary to continually add or remove links of drill pipe at the surface, at significant time and cost.

Another method of moving equipment within a borehole involves the use of a downhole tool, such as a tractor, capable of gripping onto the borehole and thrusting both itself and other equipment through it. Such tools can be attached to rigid drill strings, but can also be used in conjunction with coiled tubing equipment. Coiled tubing equipment includes a non-rigid, compliant tube, referred to herein as "coiled tubing," through which operating fluid is delivered to the tool. The operating fluid provides hydraulic power to propel the tool and the equipment and, in drilling applications, to lubricate the drill bit. The operating fluid also can provide the power for gripping the borehole. In comparison to rotary equipment, the use of coiled tubing equipment in conjunction with a tractor should be generally less expensive, easier to use, less time consuming to employ, and should provide more control of speed and downhole loads. Also, a tractor, which thrusts itself within the passage and pushes and pulls adjoining equipment and coiled tubing, should move more easily through inclined or horizontal boreholes. In addition, due to its greater compliance and flexibility, the coiled tubing permits the tractor to perform much sharper turns in the passage than rotary equipment.

A tractor can be utilized for drilling boreholes as well as many other applications, such as well completion and production work for producing oil from an oil well, pipeline installation and maintenance, laying and movement of communication lines, well logging activities, washing and acidizing of sands and solids, retrieval of tools and debris, and the like.

One type of tractor comprises an elongated body securable to the lower end of a drill string. The body can comprise one or more connected shafts in addition to a control assembly housing or valve system. This tractor includes at least one anchor or gripper assembly adapted to grip the inner surface of the passage. When the gripper assembly is actuated, hydraulic power from operating fluid supplied to the tractor via the drill string can be used to force the body axially through the passage. The gripper assembly is longitudinally movably engaged with the tractor body, so that the body and drill string can move axially through the passage while the gripper assembly grips the passage surface. A gripper assembly can transmit axial and even torsional loads from the tractor body to the borehole wall. Several highly effective designs for a fluid-actuated gripper assembly are disclosed in U.S. Pat. No. 6,464,003, which is incorporated by reference herein. In one design, the gripper assembly includes a plurality of flexible toes that bend radially outward to grip onto the passage surface by the interaction of ramps and rollers.

Some tractors have two or more sets of gripper assemblies, which permits the tractor to move continuously within the passage. Forward longitudinal motion (unless otherwise indicated, the terms "longitudinal" and "axial" are herein used interchangeably and refer to the longitudinal axis of the tractor body) is achieved by powering the tractor body forward with respect to an actuated first gripper assembly (a "power stroke" with respect to the first gripper assembly), and simultaneously moving a retracted second gripper assembly forward with respect to the tractor body (a "reset stroke" of the second gripper assembly). At the completion of the power stroke with respect to the first gripper assembly, the second gripper assembly is actuated and the first gripper assembly is retracted. Then, the tractor body is powered forward while the second gripper assembly is actuated (a power stroke with respect to the second gripper assembly), and the retracted first gripper assembly executes a reset stroke. At the completion of these respective strokes, the first gripper assembly is actuated and the second gripper assembly is retracted. The cycle is then repeated. Thus, each gripper assembly operates in a cycle of actuation, power stroke, retraction, and reset stroke, resulting in longitudinal motion of the tractor. A number of highly effective tractor designs utilizing this configuration are disclosed in U.S. Pat. No. 6,003,606 to Moore et al., which discloses several embodiments of a tractor known as the "Puller-Thruster Downhole Tool;" U.S. Pat. No. 6,241,031 to Beaufort et al., which discloses an "Electro-Hydraulically Controlled Tractor;" and U.S. Pat. No. 6,347,674 to Bloom et al., which discloses an "Electrically Sequenced Tractor" ("EST").

The power required for actuating the gripper assemblies, longitudinally thrusting the tractor body during power strokes, and longitudinally resetting the gripper assemblies during reset strokes may be provided by pressurized operating fluid delivered to the tractor via the drill string—either a rotary drill string or coiled tubing. For example, the aforementioned Puller-Thruster Downhole Assembly includes inflatable engagement bladders and uses hydraulic power from the operating fluid to inflate and radially expand the bladders so that they grip the passage surface. Hydraulic power is also used to move forward cylindrical pistons residing within sets of propulsion cylinders slidably engaged with the tractor body. Each set of cylinders is secured with respect to a bladder, so that the cylinders and bladder move together longitudinally. Each piston is longitudinally fixed with respect to the tractor body. When a bladder is inflated to grip onto the passage wall, operating fluid is directed to the proximal side of the pistons in the set of cylinders secured to the inflated bladder, to power the pistons forward with respect to the borehole. The forward hydraulic thrust on the pistons results in forward thrust on the entire tractor body. Further, hydraulic power is also used to reset each set of cylinders when their associated bladder is deflated, by directing drilling fluid to the distal side of the pistons within the cylinders.

A tractor can include a valve system for, among other functions, controlling and sequencing the distribution of operating fluid to the tractor's gripper assemblies, thrust chambers, and reset chambers. Some tractors, including several embodiments of the Puller-Thruster Downhole Tool, are all-hydraulic. In other words, they utilize pressure-responsive valves and no electrically controlled valves. One type of pressure-responsive valve shuttles between its various positions based upon the pressure of the operating fluid in various locations of the tractor. In one configuration, a spool valve is exposed on both ends to different fluid chambers or passages. The valve position depends on the relative pressures of the fluid chambers. Fluid having a higher pressure in a first chamber exerts a greater pressure force on the valve than fluid having a lower pressure in a second chamber, forcing the valve to one extreme position. The valve moves to another extreme position when the pressure in the second chamber is greater than the pressure in the first chamber. Another type of pressure-responsive valve is a spring-biased spool valve having at least one end exposed to fluid. The fluid pressure force is directed opposite to the spring force, so that the valve is opened or closed only when the fluid pressure exceeds a threshold value.

Other tractors utilize valves controlled by electrical signals sent from a control system at the ground surface or even on the tractor itself. For example, the aforementioned EST includes both electrically controlled valves and pressure-responsive valves. The electrically controlled valves are controlled by electrical control signals sent from a controller housed within the tractor body. The EST is preferred over all-hydraulic tractors for drilling operations, because electrical control of the valves permits very precise control over important drilling parameters, such as speed, position, and thrust. In contrast, all-hydraulic tractors, including several embodiments of the Puller-Thruster Downhole Tool, are preferred for so-called "intervention" operations. As used herein, "intervention" refers to re-entry into a previously drilled well for the purpose of improving well production, to thereby improve fuel production rates. As wells age, the rate at which fuel can be extracted therefrom diminishes for several reasons. This necessitates the "intervention" of many different types of tools. Hydraulic tractors, as opposed to electrically controlled tractors, are preferred for intervention operations because intervention, as opposed to drilling, does not require precise control of speed or position. The absence of electrically controlled valves makes hydraulic tractors generally less expensive to deploy and operate.

Tractors in combination with coiled tubing equipment are particularly useful for intervention operations because, in many cases, the wells were originally drilled with rotary drilling equipment capable of drilling very deep holes. It is more expensive to bring back the rotary equipment than it is to bring in a coiled tubing unit. However, the coiled tubing unit may not be capable of reaching extended distances within the borehole without the aid of a tractor.

In one known design, exemplified by FIG. 3 of U.S. Pat. No. 6,003,606 (which discloses the Puller-Thruster Downhole Tool), a tractor includes a spool valve whose spool has two main positions. In one main position, the valve directs pressurized fluid to a first gripper and to propulsion chambers of a first set of propulsion cylinders. In this position of the spool, the pressure is permitted to decrease in a second gripper and in reset chambers of a second set of propulsion cylinders. In the other main position, the valve does the opposite—it directs pressurized fluid to the second gripper and propulsion chambers of the second set of cylinders, and permits pressure to decrease in the first gripper and in propulsion chambers of the first set of cylinders. The spool of the valve is piloted by fluid pressure on both ends of the spool. A pair of cycle valves selectively administers high pressure to the ends of the spool. Each cycle valve is in turn piloted by the pressure in the fluid passages to the cylinders and grippers.

The Puller-Thruster all-hydraulic tractor design has proven to be a major advance in the art of tractors for moving equipment within boreholes. However, it operates most effectively within a limited zone of parameters, including the pressure, weight, and density of the operating fluid, the geometry of the tractor components, and the total weight of the equipment that the tractor must pull and/or push. Thus, it is desirable to provide an improved design for a tractor, which will work within a much larger zone of such parameters.

Another prior design consists of a wellbore tractor having wheels that roll along the surface of the well casing. This design is problematic because the wheels do not have the ability to provide significant gripping force to move heavier downhole equipment. Also, the wheels can lose traction in certain conditions, such as in regions including sand.

A typical process of extracting hydrocarbons from the earth involves drilling an underground borehole and then inserting a generally tubular casing in the borehole. In order to access oil reserves from a given underground region through which the well passes, the casing must be opened within that region. In one method, perforation guns are brought to the desired location within the well and then utilized to cut openings through the casing wall and/or the earth formation. Oil is then extracted through the openings in the casing up through the well to the surface for collection. Perforation guns can also be used to penetrate the formation in an "open hole" to access desired oil reserves. An open hole is a borehole without a casing. Perforation guns can be ignited by different means, such as by pressurized operating fluid or electricity provided through electrical lines ("e-lines"). However, the practice of igniting the perforation guns with e-lines poses the risk of a spark leading to explosion and potential loss of life. Thus, it is desirable to fully hydraulic tractors, without e-lines, for operations that involve the use of perforation guns.

Perforation guns are commonly used in conjunction with rotary drilling equipment, due to the large weight of the guns. Long strips of perforation guns can weigh up to 20000 pounds or more. The rotary drilling equipment, consisting of the rigid drill string formed from connected links of drill pipe, has been used because of its ability to absorb the weight in tension. However, the use of rotary equipment is very expensive and time-consuming, due in part to the necessity of assembling and disassembling the portions of drill pipe.

In the prior art, shafts designed for downhole tools used in drilling and intervention applications have been formed from more flexible materials, such as copper beryllium (CuBe). This is because in drilling it is not uncommon to experience sharp turns, and the tool is preferably capable of turning at sharp angles. Also, shafts have been formed with relatively large internal passages for the flow of operating fluid to the valves and other equipment of the BHA. This is because in drilling the operating fluid is typically drilling mud, which often contains larger solids and necessitates a larger flow passage. The drilling mud is preferred because it provides better lubrication to the drill bit and more effectively carries the drill cuttings up through the annulus back to the ground surface.

The shaft of a downhole tool typically must include multiple internal passages (e.g., for fluid to the gripper assemblies, propulsion chambers, and the other downhole equipment) that extend along the shaft length. In the past, such passages have been formed by gun-drilling, which is well known. Unfortunately, it is typically not possible to gun-drill the entire length of the shaft (in most applications, the length of a shaft for a downhole tool can be anywhere in the range of 50 to 168 inches). The distance that a passage can be gun-drilled is limited by (1) the inherent length limitations of known gun-drilling tools, and (2) the limitations imposed by the geometry and material characteristics of the shaft. In the past, it has been necessary to limit the length of gun-drilled passages in shafts of downhole tools to a relatively great degree. This is because the larger internal passage required for drilling mud leaves less room for other fluid passages. This shortage of available "real estate" in the shaft requires higher precision gun-drilling and increases the risk of inadvertent damage to other passages caused by the gun-drilling process. These problems are exacerbated by the fact that the more flexible materials used for the shaft (e.g., CuBe) are softer, more difficult to drill through, and more prone to damage.

The limitations on the length that passages can be gun-drilled have necessitated forming the shafts from a plurality of shaft portions of reduced length. The fluid passages are gun-drilled in each shaft portion, and then the shaft portions are attached to each other. Due in large part to the use of CuBe, shaft portions have been attached together by electron beam welding. Electron beam welding is favored because it maintains the structural integrity of the material and of the fluid passages contained therein. Unfortunately, electron beam welding is a very expensive process. Most conventional welding processes have not been used because they do not facilitate the welding together of thick objects (i.e., the weld does not fuse completely through the objects). In shaft manufacturing for downhole tools, it is necessary to soundly fuse together all of the mating surfaces in order to maintain zero leakage between the various internal fluid passages and to provide structural integrity.

SUMMARY OF THE INVENTION

The present invention seeks to overcome the aforementioned limitations of the prior art by providing a hydraulically powered and substantially or completely hydraulically controlled tractor to be used preferably with coiled tubing equipment. This invention represents a major advancement in the art of tractors, and particular in the art of well intervention tools. Compared to the prior art, the preferred embodiments of the tractor of the invention operate very effectively within a much larger zone of parameters, such as the pressure, weight, and density of the operating fluid, the geometry of the tractor components, and the total weight of the equipment that the tractor must pull and/or push.

As explained below, the tractor preferably includes a two-position propulsion control valve that directs fluid to and from the tractor's propulsion cylinders. In order for the propulsion control valve spool to shift, two cycle valves are provided for sensing the completion of the strokes of the propulsion cylinders. The cycle valves shift in order to begin a sequence of events that results in a fluid pressure force causing the propulsion control valve spool to shift, so that the propulsion cylinders can switch between their power and reset strokes. However, rather than administering high pressure fluid directly to the propulsion control valve spool, the cycle valves shift to send a pressure force to an additional two-position valve. The additional valve controls the flow of pressurized fluid to control the position of the propulsion control valve spool. Thus, the additional valve isolates the propulsion control valve from direct interaction with the cycle valves. Advantageously, the shift action of the additional valve creates a longer time lag between the shift action of either cycle valve and the shift action of the propulsion control valve spool. Due to the time lag, the propulsion cylinders are more likely to complete their strokes before the propulsion control valve shifts. In addition, better shifting can be effected by spring-assisted detents on the propulsion control valve spool. In the illustrated embodiments of the invention, the additional valve comprises a gripper control valve that controls the distribution of fluid to and from the gripper assemblies.

The preferred embodiments include an inlet control valve having a feature that allows the valve to be hydraulically restrained in a closed position, so that the tractor is assured of being non-operational and in a non-gripping state. This permits the operation of downhole equipment adjoined to the tractor or other portions of the bottom hole assembly, such as perforation guns, substantially without the risk of inadvertent movement of the tractor. It also assures that the gripper assemblies are retracted from the borehole surface during the operation of other downhole equipment, thus reducing the risk of damage to the gripper assemblies.

In addition, the invention provides a new method of manufacturing the shafts that form the body of the tractor, which is much less expensive than prior art shaft manufacturing methods. According to this method, shaft portions are silver brazed together to form the shafts. Silver brazing is less expensive than prior art welding methods, such as electron beam welding. Also, the preferred material characteristics and internal fluid passage configuration permits longer gun-drilled holes. Advantageously, fewer shaft portions are necessary.

In one aspect, the present invention provides a tractor assembly comprising a tractor for moving within a borehole. The tractor comprises an elongated body, first and second gripper assemblies, first and second elongated propulsion cylinders, and a valve system. The body has first and second pistons longitudinally fixed with respect to the body. Each piston has aft and forward surfaces configured to receive longitudinal thrust forces from fluid from a pressurized source. The body has a flow passage.

Each gripper assembly is longitudinally movably engaged with the body. Each gripper assembly has an actuated position in which the gripper assembly limits relative movement between the gripper assembly and an inner surface of the borehole, and a retracted position in which the gripper assembly permits substantially free relative movement between the gripper assembly and said inner surface. Each gripper assembly is configured to be actuated by fluid.

The first propulsion cylinder is longitudinally slidably engaged with respect to the body and has an elongated internal propulsion chamber enclosing the first piston. The first piston is slidable within and fluidly divides the internal propulsion chamber of the first cylinder into an aft chamber and a forward chamber. Similarly, the second propulsion cylinder is longitudinally slidably engaged with respect to the body and has an elongated internal propulsion chamber enclosing the second piston. The second piston is slidable within and fluidly divides the internal propulsion chamber of the second cylinder into an aft chamber and a forward chamber.

The valve system comprises a propulsion control valve and a gripper control valve. The propulsion control valve has a first position in which it provides a flow path for the flow of fluid to the aft chamber of the first cylinder. The propulsion control valve also has a second position in which it provides a flow path for the flow of fluid to the aft chamber of the second cylinder. The gripper control valve has a first position in which it provides a flow path for the flow of fluid to the first gripper assembly. The gripper control valve also has a second position in which it provides a flow path for fluid to the second gripper assembly. When the gripper control valve is in its first position and the propulsion control valve is in its first position, the gripper control valve must move from its first position to its second position before the propulsion control valve can move from its first position to its second position.

In another aspect, the present invention provides a method of moving the tractor assembly (described immediately above) within a borehole. The method comprises providing pressurized fluid from a source, directing the pressurized fluid toward the gripper control valve, directing the pressurized fluid toward the propulsion valve, and, when the gripper control valve and propulsion control valves are in their first positions, preventing the propulsion control valve from moving from its first position to its second position until the gripper control valve moves from its first position to its second position.

In another aspect, the invention provides a tractor assembly, comprising a tractor for moving within a borehole. The tractor comprises an elongated body, first and second gripper assemblies, first and second elongated propulsion cylinders, and a valve system. The elongated body has first and second pistons longitudinally fixed with respect to the body. Each of the pistons has aft and forward surfaces configured to receive longitudinal thrust forces from fluid from a pressurized source. The body also has a flow passage. Each of the first and second gripper assemblies is longitudinally movably engaged with the body, and has actuated and retracted positions as described above. The first and second propulsion cylinders are configured as described above.

The valve system comprises a propulsion valve and a control valve. The propulsion valve has a first position in which it provides a flow path for the flow of fluid to the aft chamber of the first cylinder, and a second position in which it provides a flow path for the flow of fluid to the aft chamber of the second cylinder. The control valve has a first position in which it provides a flow path for the flow of fluid to urge the propulsion valve toward the first position of the propulsion valve. The control valve has a second position in which it provides a flow path for the flow of fluid to urge the propulsion valve toward the second position of the propulsion valve. When the control valve and the propulsion valve are in their first positions, the control valve must move from its first position to its second position before the propulsion valve can move from its first position to its second position.

In another aspect, the invention provides a method of moving the tractor assembly (described immediately above) within a borehole. The method comprises providing pressurized fluid from a source, directing the pressurized fluid toward the gripper control valve, directing the pressurized fluid toward the propulsion valve, and, when the control valve and the propulsion valve are in their first positions, preventing the propulsion valve from moving from its first position to its second position before the control valve moves from its first position to its second position.

In another aspect, the invention provides a tractor assembly, comprising a tractor for moving within a borehole. The tractor is configured to be powered by operating fluid received from a conduit extending from the tractor through the borehole to a source of the operating fluid. The tractor comprises an elongated body, a gripper assembly, a valve system housed within the body, a pressure reduction valve, and first and second gripper fluid passages. The elongated body has a thrust-receiving portion longitudinally fixed with respect to the body. The body also has an internal passage configured to receive the operating fluid from the conduit. The gripper assembly is longitudinally movably engaged with the body and has actuated and retracted positions as described above. The valve system is configured to receive operating fluid from the internal passage of the body and to selectively control the flow of operating fluid to at least one of the gripper assembly and the thrust-receiving portion. The first gripper fluid passage extends from the valve system to the pressure reduction valve, while the second gripper fluid passage extends from the pressure reduction valve to the gripper assembly. The pressure reduction valve is configured to provide a flow path for operating fluid to flow from the first gripper fluid passage to the second gripper fluid passage when the pressure within the first gripper fluid passage is below a threshold. The pressure reduction valve is also configured to prevent fluid from flowing from the first gripper fluid passage to the second gripper fluid passage when the pressure within the first gripper fluid passage is above the threshold.

In another aspect, the invention provides a method of moving a tractor assembly within a borehole. The tractor assembly includes a tractor having an elongated body, a gripper assembly longitudinally movably engaged with the body, a valve system housed within the body, and first and second gripper fluid passages. The body has a thrust-receiving portion longitudinally fixed with respect to the body. The body also has an internal passage configured to receive the operating fluid from the conduit. The gripper assembly has actuated and retracted positions as described above, and is configured to be actuated by receiving operating fluid from the internal passage of the body. The valve system is configured to receive operating fluid from the internal passage of the body and to selectively control the flow of operating fluid to at least one of the gripper assembly and the thrust-receiving portion. The first gripper fluid passage extends from the valve system, and the second gripper fluid passage extends to the gripper assembly. According to the method of this aspect of the invention, pressurized fluid is provided from a source. The pressurized fluid is permitted to flow from the first gripper fluid passage to the second gripper fluid passage when the pressure within the first gripper fluid passage is below a threshold. Fluid is prevented from flowing from the first gripper fluid passage to the second gripper fluid passage when the pressure within the first gripper fluid passage is above the threshold.

In another aspect, the invention provides a tractor assembly, comprising a tractor for moving within a borehole. The tractor is configured to be powered by pressurized operating fluid received from a conduit extending from the tractor through the borehole to a source of the operating fluid. The tractor comprises an elongated body, a gripper assembly longitudinally movably engaged with the body, and a valve system housed within the body. The body has a thrust-receiving portion longitudinally fixed with respect to the body, and an internal passage configured to receive the operating fluid from the conduit. The gripper assembly has actuated and retracted positions as described above.

The valve system is configured to receive fluid from the internal passage of the body and to selectively control the flow of operating fluid to at least one of the gripper assembly and the thrust-receiving portion. The valve system includes an entry control valve controlling the flow of operating fluid from the internal passage of the body into the valve system. The entry control valve comprises a valve passage and a body movably received therein. The valve passage has at least two secondary passages and is configured to conduct the operating fluid between the secondary passages. The entry control valve has first and third position ranges in which it provides a flow path for operating fluid within the valve system to flow through the entry control valve to the exterior of the tractor, and in which the valve body prevents the flow of operating fluid from the internal passage of the tractor body into the valve system. The entry control valve also has a second position range in which it provides a flow path for operating fluid from the internal passage of the tractor body to flow into the valve system, and in which the valve body prevents the flow of operating fluid within the valve system to the exterior of the tractor. The entry control valve is in its first position range when the fluid pressure in the internal passage of the tractor body is below a lower shut-off threshold. The entry control valve is in the second position range when the fluid pressure in the internal passage is above the lower shut-off threshold and below an upper shut-off threshold. The entry control valve is in the third position range when the fluid pressure in the internal passage is above the upper shut-off threshold.

In another aspect, the invention provides a method of moving a tractor assembly within a borehole, the tractor assembly including a tractor having an elongated body and gripper assembly configured as in the previously described aspect of the invention. The tractor also comprises a valve system housed within the body, the valve system including an entry control valve. According to the method, fluid is received from the internal passage of the body, and the flow of operating fluid from the internal passage of the body into the valve system is controlled with the entry control valve. The flow of operating fluid from the internal passage of the body into the valve system is prevented with the entry control valve when the fluid pressure in the internal passage of the body is below a lower shut-off threshold and when the fluid pressure in the internal passage is above an upper shut-off threshold. The flow of operating fluid from the internal passage of the body into the valve system is permitted when the fluid pressure in the internal passage is above the lower shut-off threshold and below the upper shut-off threshold.

In another aspect, the present invention provides a tractor assembly, comprising a tractor for moving within a borehole. The tractor is configured to be powered by pressurized operating fluid received from a conduit extending from the tractor through the borehole to a source of the operating fluid. The tractor comprises an elongated body, a gripper assembly longitudinally movably engaged with the body, and a valve system. The elongated body has a thrust-receiving portion longitudinally fixed with respect to the body. The body also has an internal passage configured to receive the operating fluid from the conduit. The gripper assembly has actuated and retracted positions as described above.

The valve system of the tractor is configured to receive fluid from the internal passage of the body and to selectively control the flow of operating fluid to at least one of the gripper assembly and the thrust-receiving portion. The valve system includes an entry control valve controlling the flow of operating fluid from the internal passage of the body into the valve system. The entry control valve comprises a housing defining a valve passage, a body movably received within the passage, and at least one spring. The housing has at least two side passages, the valve passage being configured to conduct the operating fluid between the side passages. The valve body has a first surface configured to be exposed to operating fluid from the internal passage of the tractor body, the first surface being configured to receive a longitudinal pressure force in a first direction. The valve body has first and third position ranges in which the body provides a flow path for operating fluid within the valve system to flow through the entry control valve to the exterior of the tractor, and in which the valve body prevents the flow of operating fluid from the internal passage of the body into the valve system. The valve body has a second position range between the first and third position ranges in which the valve body provides a flow path for operating fluid from the internal passage of the tractor body to flow into the valve system, and in which the valve body prevents the flow of operating fluid within the valve system to the exterior of the tractor.

The at least one spring biases the valve body in a direction opposite to that of the pressure force received by the first surface of the valve body, such that the magnitude of the fluid pressure in the internal passage determines the deflection of the at least one spring and thus the position of the valve body. The at least one spring is configured so that the valve body occupies a position within the first position range when the fluid pressure in the internal passage of the tractor body is below a lower shut-off threshold, so that the valve body occupies a position within the second position range when the fluid pressure in the internal passage is above the lower shut-off threshold and below an upper shut-off threshold, and so that the valve body occupies a position within the third position range when the fluid pressure in the internal passage is above the upper shut-off threshold.

In another aspect, the invention provides a tractor assembly, comprising a tractor for moving within a borehole while connected to an injector by a drill string. The tractor comprises an elongated body, first and second gripper assemblies, elongated first and second propulsion cylinders, and a valve system. The body has first and second pistons longitudinally fixed with respect to the body. Each of the pistons has aft and forward surfaces configured to receive longitudinal thrust forces from fluid from a pressurized source. The body also has a flow passage. The first gripper assembly is longitudinally movably engaged with the body and has actuated and retracted positions as described above. Similarly, the second gripper assembly is longitudinally movably engaged with the body and has actuated and retracted positions as described above. The first propulsion cylinder is longitudinally slidably engaged with respect to the body. The first cylinder has an elongated internal propulsion chamber enclosing the first piston. The first piston is slidable within and fluidly divides the internal propulsion chamber of the first cylinder into an aft chamber and a forward chamber. Similarly, the second propulsion cylinder is longitudinally slidably engaged with respect to the body. The second cylinder has an elongated internal propulsion chamber enclosing the second piston. The second piston is slidable within and fluidly divides the internal propulsion chamber of the second cylinder into an aft chamber and a forward chamber.

The valve system of the tractor comprises a propulsion control valve and a gripper control valve. The propulsion control valve has a first position in which it provides a flow path for the flow of fluid to the aft chamber of the first cylinder, and a second position in which it provides a flow path for the flow of fluid to the aft chamber of the second cylinder. The gripper control valve has a first position in which it provides a flow path for the flow of fluid to the first gripper assembly, and a second position in which it provides a flow path for fluid to the second gripper assembly. The speed of movement of the tractor is controlled by the pressure and flow rate of the operating fluid and the tension exerted on the tractor by the drill string.

In another aspect, the invention provides a tractor assembly, comprising a tractor for moving within a borehole. The tractor comprises an elongated body, a first gripper assembly longitudinally movably engaged with the body, an elongated first propulsion cylinder longitudinally slidably engaged with respect to the body, and a valve system. The body has first and second pistons longitudinally fixed with respect to the body. Each of the pistons has aft and forward surfaces configured to receive longitudinal thrust forces from fluid from a pressurized source. The body also has a flow passage. The first gripper assembly has actuated and retracted positions as described above. The first propulsion cylinder has an elongated internal propulsion chamber enclosing the first piston. The first piston is slidable within and fluidly divides the internal propulsion chamber of the first cylinder into an aft chamber and a forward chamber.

The valve system comprises a propulsion valve and a control valve. The propulsion valve has a first position in which it provides a flow path for the flow of fluid to the aft chamber of the first cylinder, and a second position in which it does not provide a flow path for the flow of fluid to the aft chamber of the first cylinder. The control valve has a first position in which it provides a flow path for the flow of fluid to urge the propulsion valve toward the first position, and a second position in which it provides a flow path for the flow of fluid to urge the propulsion valve toward the second position. When the control valve and the propulsion valve are in their first positions, the control valve must move from its first position to its second position before the propulsion valve can move from its first position to its second position.

For purposes of summarizing the invention and the advantages achieved over the prior art, certain objects and advantages of the invention have been described above and as further described below. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

All of these embodiments are intended to be within the scope of the invention herein disclosed. These and other embodiments of the present invention will become readily apparent to those skilled in the art from the following detailed description of the preferred embodiments having reference to the attached figures, the invention not being limited to any particular preferred embodiment(s) disclosed.

DETAILED DESCRIPTION OF THE PREFERRED EMBODIMENT

Figure 1:
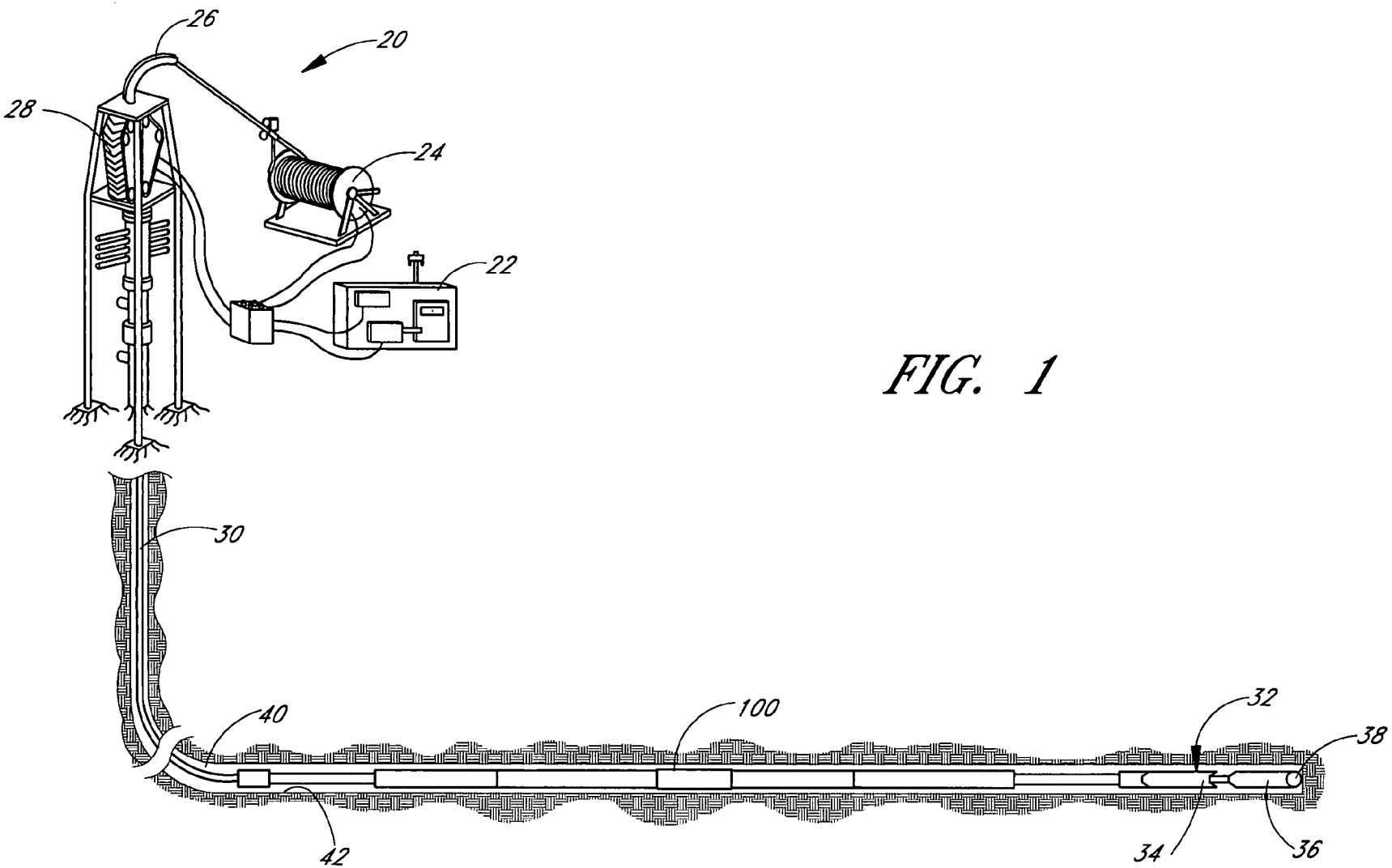
FIG. 1 is a schematic diagram of the major components of one embodiment of a tractor of the present invention, utilized in conjunction with a coiled tubing system.

FIG. 1 shows a hydraulic tractor 100 for moving equipment within a passage, configured in accordance with a preferred embodiment of the present invention. In the embodiments shown in the accompanying figures, the tractor of the present invention may be used in conjunction with a coiled tubing drilling system 20 and adjoining downhole equipment 32. The system 20 may include a power supply 22, tubing reel 24, tubing guide 26, tubing injector 28, and coiled tubing 30, all of which are well known in the art. The tractor 100 is configured to move within a borehole having an inner surface 42. An annulus 40 is defined by the space between the tractor 100 and the inner surface 42 of the borehole.

The downhole equipment 32 may include various types of equipment that the tractor 100 is designed to move within the passage. For example, the equipment 32 may comprise a perforation gun assembly, an acidizing assembly, a sand-washing assembly, a bore plug setting assembly, an E-line, a logging assembly, a bore casing assembly, a measurement while drilling (MWD) assembly, or a fishing tool. Also, the equipment 32 may comprise a combination of these items. If the tractor 100 is used for drilling, the equipment 32 will preferably include an MWD system 34, downhole motor 36, and drill bit 38, all of which are also known in the art. Of course, the downhole equipment 32 may include many other types of equipment for non-drilling applications, such as intervention and completion applications. While the equipment 32 is illustrated on the forward end of the tractor, it will be understood that such downhole equipment can be connected both aftward and forward of the tractor.

It will be appreciated that a hydraulic tractor of a preferred embodiment of the present invention may be used to move a wide variety of tools and equipment within a borehole or other passage. For example, the tractor can be utilized for applications such as well completion and production work for producing oil from an oil well, pipeline installation and maintenance, laying and movement of communication lines, well logging activities, washing and acidizing of sands and solids, retrieval of tools and debris, and the like. Also, while preferred for intervention operations, the tractor can be used for drilling applications, including petroleum drilling and mineral deposit drilling. The tractor can be used in conjunction with different types of drilling equipment, including rotary drilling equipment and coiled tubing equipment.

For example, one of ordinary skill in the art will understand that oil and gas well completion typically requires that the reservoir be logged using a variety of sensors. These sensors may operate using resistivity, radioactivity, acoustics, and the like. Other logging activities include measurement of formation dip and borehole geometry, formation sampling, and production logging. These completion activities can be accomplished in inclined and horizontal boreholes using a preferred embodiment of the hydraulic tractor of the invention. For instance, the tractor can deliver these various types of logging sensors to regions of interest. The tractor can either place the sensors in the desired location, or it can idle in a stationary position to allow the measurements to be taken at the desired locations. The tractor can also be used to retrieve the sensors from the well.

Examples of production work that can be performed with a preferred embodiment of the hydraulic tractor of the invention include sands and solids washing and acidizing. It is known that wells sometimes become clogged with sand, hydrocarbon debris, and other solids that prevent the free flow of oil through the borehole 42. To remove this debris, specially designed washing tools known in the industry are delivered to the region, and fluid is injected to wash the region. The fluid and debris then return to the surface. Such tools include acid washing tools. These washing tools can be delivered to the region of interest for performance of washing activity and then returned to the ground surface by a preferred embodiment of the tractor of the invention.

In another example, a preferred embodiment of the tractor of the invention can be used to retrieve objects, such as damaged equipment and debris, from the borehole. For example, equipment may become separated from the drill string, or objects may fall into the borehole. These objects must be retrieved, or the borehole must be abandoned and plugged. Because abandonment and plugging of a borehole is very expensive, retrieval of the object is usually attempted. A variety of retrieval tools known to the industry are available to capture these lost objects. The tractor can be used to transport retrieving tools to the appropriate location, retrieve the object, and return the retrieved object to the surface.

In yet another example, a preferred embodiment of the tractor of the invention can also be used for coiled tubing completions. As known in the art, continuous-completion drill string deployment is becoming increasingly important in areas where it is undesirable to damage sensitive formations in order to run production tubing. These operations require the installation and retrieval of fully assembled completion drill string in boreholes with surface pressure. The tractor of the invention can be used in conjunction with the deployment of conventional velocity string and simple primary production tubing installations. The tractor can also be used with the deployment of artificial lift devices such as gas lift and downhole flow control devices.

In a further example, a preferred embodiment of the tractor of the invention can be used to service plugged pipelines or other similar passages. Frequently, pipelines are difficult to service due to physical constraints such as location in deep water or proximity to metropolitan areas. Various types of cleaning devices are currently available for cleaning pipelines. These various types of cleaning tools can be attached to the tractor so that the cleaning tools can be moved within the pipeline.

In still another example, a preferred embodiment of the tractor of the invention can be used to move communication lines or equipment within a passage. Frequently, it is desirable to run or move various types of cables or communication lines through various types of conduits. The tractor can move these cables to the desired location within a passage.

Overview of Tractor Components

Figure 2:
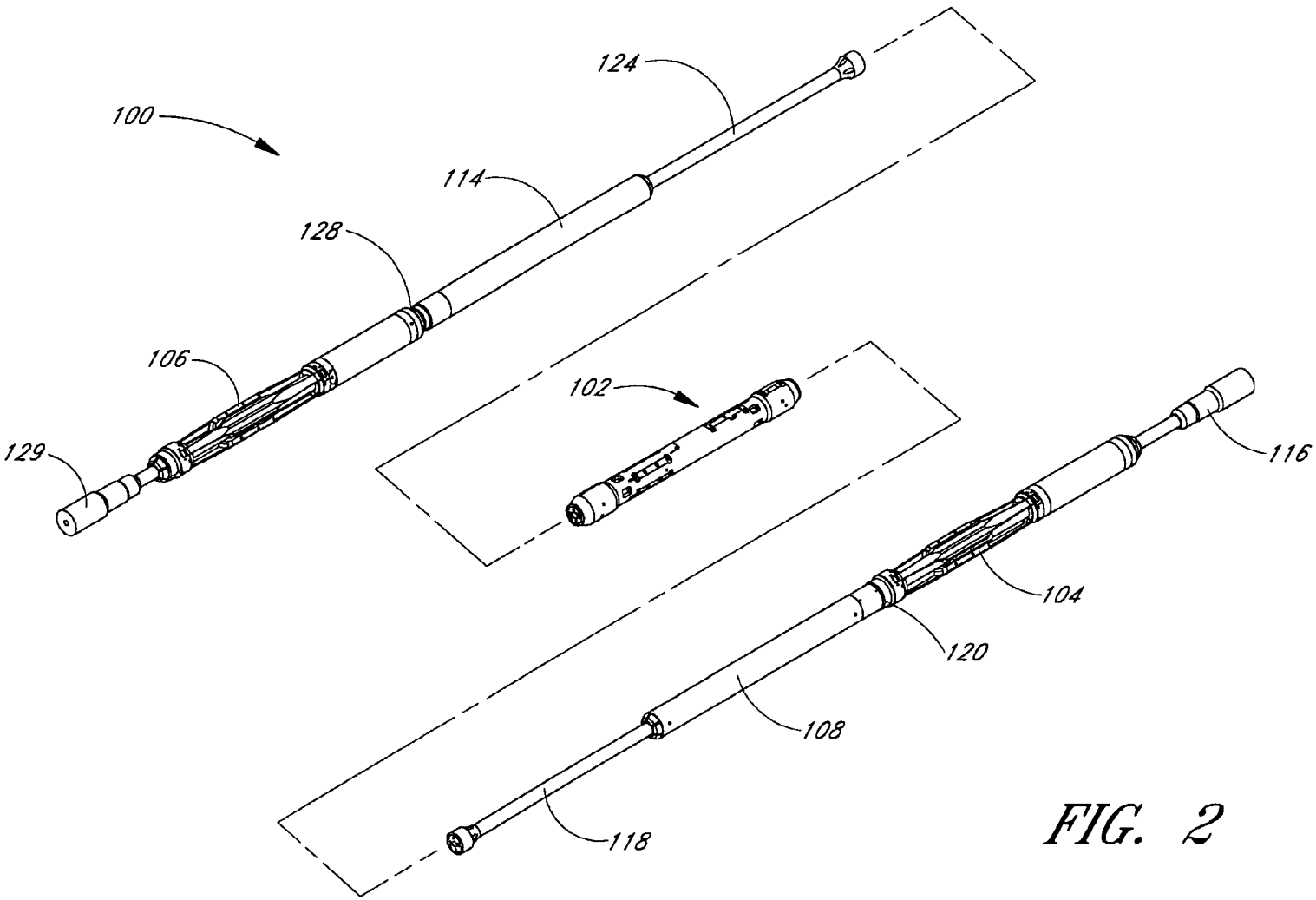
FIG. 2 is a front perspective view of a preferred embodiment of the tractor of the present invention.

FIG. 2 shows a preferred embodiment 100 of a tractor of the present invention, shown with the aft end on the right and the forward end on the left. The tractor 100 comprises a central control assembly 102, an uphole or aft gripper assembly 104, a downhole or forward gripper assembly 106, an aft propulsion cylinder 108, a forward propulsion cylinder 114, tool joint assemblies 116 and 129, shafts 118 and 124, and flex joints or adapters 120 and 128. The tool joint assembly 116 connects a drill string, such as coiled tubing, to the shaft 118. The aft gripper assembly 104, aft propulsion cylinder 108, and flex joint 120 are assembled together end-to-end and are all axially slidably engaged with the shaft 118. Similarly, the forward gripper assembly 106, forward propulsion cylinders 114, and flex joint 128 are assembled together end-to-end and are axially slidably engaged with the shaft 124. The tool joint assembly 129 couples the tractor 100 to downhole equipment 32 (FIG. 1). The shafts 118 and 124 and control assembly 102 are axially fixed with respect to one another and are sometimes referred to herein as the body of the tractor. The body of the tractor is thus axially fixed with respect to the drill string and the downhole tools.

The tractor 100 can be made to have the capability of pulling and/or pushing downhole equipment 32 of various weights. In one embodiment, the tractor 100 is capable of pulling and/or pushing a total weight of 100 lbs, in addition to the weight of the tractor itself. In three other embodiments, the tractor is capable of pulling and/or pushing a total weight of 500, 3000, and 15,000 lbs.

In order to prevent damage to a surrounding formation or casing wall, the tractor can be designed to limit the radial gripping load that it exerts on a surface surrounding the tractor. In one embodiment, the tractor exerts no more than 25 psi on a surface surrounding the tractor. This embodiment is particularly useful in softer formations, such as gumbo. In three other embodiments, the tractor exerts no more than 100, 3000, and 50,000 psi on a surface surrounding the tractor. At radial gripping loads of 50,000 psi or less, the tractor can be used safely in steel tube casing.

The tractor components shown in FIG. 2 are assembled in a manner similar to the components of the aforementioned EST, disclosed and illustrated in U.S. Pat. No. 6,347,674. Two notable differences between the tractor 100 shown in FIG. 2 and the EST are (1) the tractor 100 of the present invention utilizes gripper assemblies of a different type, and (2) the control assembly 102 of the tractor 100 is different than the control assembly of the EST. In the preferred embodiment, the gripper assemblies 104 and 106 of the tractor 100 are preferably of a design similar to a gripper assembly disclosed and illustrated in U.S. Pat. No. 6,464,003, with a number of improvements described below. The control assembly 102 houses a valve system that controls the distribution of operating fluid to and from the gripper assemblies and propulsion cylinders. The control assembly 102 is described below.

The control assembly 102 includes internal fluid passages for flow between the valves and flow to the gripper assemblies, propulsion cylinders, and downhole equipment. In a preferred embodiment, some of the fluid passage sizes are similar to or larger than the fluid passages of the control assembly of the EST. As in the EST design, the fluid passages are sized and located to fit within the available space constraints of the tractor. The sizes of the various components (e.g., the shafts, propulsion cylinders, pistons, control housing, valves, etc.) are generally similar to the sizes of analogous components of the EST. Using principles of design and space management made apparent by U.S. Pat. No. 6,347,674 (which discloses the EST) in combination with the specification and figures of the present application, one of ordinary skill in the art will understand how to build a tractor according to the present invention.

The tractor 100 can be any desirable length, but for typical oilfield applications the length is approximately 25 to 30 feet. The maximum diameter of the tractor will typically vary with the size of the hole, thrust requirements, and the restrictions that the tractor must pass through. The gripper assemblies can be designed to operate within boreholes of various sizes, but typically can expand to a diameter of 3.75 to 7.0 inches.

The flex adapters 120 and 128 are hollow structural members that provide a region of reduced flexural rigidity in the tractor. This region of increased flexibility facilitates the negotiation of sharp turns. The adapters are preferably formed of a relatively low modulus material such as Copper Beryllium (CuBe) and Titanium. Occasionally, there are applications that require the use of non-magnetic materials for the tractor. Otherwise, depending on the required turning capability of the tractor and resultant stresses, it is possible that various stainless steels may be used in many areas of the tractor.

In the preferred embodiment, the tool joint assembly 116 couples the shaft 118 to a coiled tubing drill string, preferably via a threaded connection. However, downhole tools can also be placed aftward of the tractor, connected to the tool joint assembly 116. The tool joint assembly 129 will normally be coupled to downhole tools. The interface threads of the tool joint assemblies are preferably API threads or proprietary threads (such as Hydril casing threads). The tool joint assemblies can be prepared with conventional equipment (tongs) to a specified torque (e.g., 1000–3000 ft-lbs). The tool joint assemblies can be formed from a variety of materials, including CuBe, steel, and other metals.

The shafts 118 and 124 can be formed from any suitable material. In one embodiment, the shafts are formed from a flexible material, such as CuBe, in order to permit the tractor 100 to negotiate sharper turns. In other embodiments CuBe is not used, as it is relatively expensive. Other acceptable materials include Titanium and steel (when low flexibility is sufficient). In a preferred configuration, each shaft includes a central internal bore (forming a portion of the passage 44 discussed below and shown in FIG. 3) for the flow of pressurized operating fluid to the downhole equipment and to the valve system of the tractor. This bore extends the entire length of each shaft. Each shaft also includes numerous other passages for the flow of fluid to the gripper assemblies and propulsion cylinders. These fluid passages range in length and are equal to or less than the overall length of the tractor. Multiple fluid passages can be drilled in the shaft for the same function, such as to feed a single propulsion chamber. Preferably, the bore and the other internal fluid passages are arranged so as to minimize stress and provide sufficient space and strength for other design features, such as the pistons within the cylinders. Each shaft is preferably provided with threads on one end for connection to the tool joint assemblies 116 and 129, and with a flange on the other end to allow bolting to the control assembly 102.

In one embodiment, the tractor 100 is specifically designed for intervention applications. While intervention tractors can be made any size, they are typically operated within 5-inch or 7-inch casing. The inside diameter of a 5-inch casing can range from 4.5 to 4.8 inches. The inside diameter of a 7-inch casing can range from 5.8 to 6.4 inches. The primary structural components of the tractor 100 are the shafts 118 and 124. In a preferred embodiment, the shafts have an outside diameter of 1.75 inches and an inside bore diameter of 0.8 inches. The remaining fluid passages of the shafts are preferably smaller. The pistons can have varying outside diameters.

For intervention applications, the tractor 100 saves time and money. Prior art intervention tools that utilize rotary drill strings are as much as 150% more expensive than the illustrated tractor 100 using coiled tubing equipment. In addition, the tractor 100 is more time-conservative, as the longer rig-up time associated with rotary equipment is avoided. The use of coiled tubing is particularly advantageous when operating perforation guns.

Figure 3:
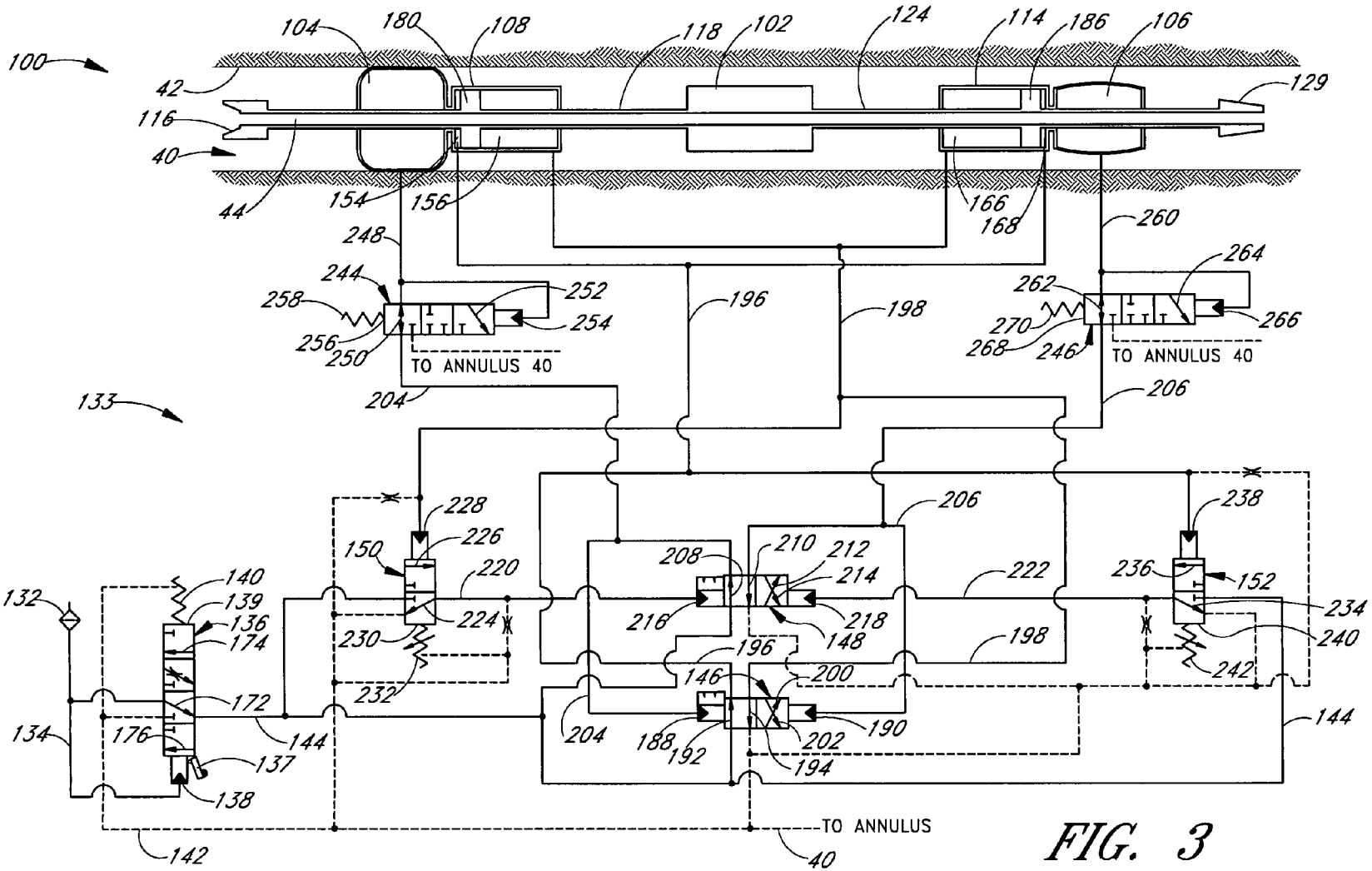
FIG. 3 is a schematic diagram illustrating a preferred configuration of the tractor and the valve system of the present invention.

FIG. 3 schematically illustrates a preferred configuration of the major components of the tractor 100. The tractor 100 includes an internal passage 44 extending from the aft end of the aft shaft 118 through the control assembly 102 to the forward end of the forward shaft 124. In use, pressurized operating fluid is pumped through the drill string into the internal passage 44. The operating fluid can be used for various applications to be undertaken by the downhole equipment, such as for powering perforation guns utilized for cutting holes in a casing wall of an oil well. The valve system 133 is configured to receive a portion of the operating fluid flowing through the internal passage 44.

FIG. 3 also schematically illustrates a preferred configuration of the valve system 133 of the tractor 100. The valve system 133 is housed within the control assembly 102 shown in FIG. 2. The valve system 133 selectively controls the flow of operating fluid to and from the gripper assemblies 104 and 106 and to and from the propulsion cylinders 108 and 114. The operation of the valve system 133 is described in detail below.

In the aft shaft assembly, the aft propulsion cylinder 108 is longitudinally slidably engaged with the aft shaft 118 and forms an internal annular chamber surrounding the shaft. An annular piston 180 resides within the annular chamber formed by the cylinder 108, and is at least longitudinally fixed to the shaft 118. The piston 180 fluidly divides the internal annular chamber formed by the cylinder 108 into an aft chamber 154 and a forward chamber 156. Preferably, the chambers 154 and 156 are fluidly sealed to substantially prevent fluid flow between the chambers or leakage to the annulus 40. The piston 180 is longitudinally slidable within the cylinder 108.

In the forward shaft assembly, the forward propulsion cylinder 114 is configured similarly to the aft propulsion cylinder 108. The cylinder 114 is longitudinally slidably engaged with the forward shaft 124. An annular piston 186 is at least longitudinally fixed to the shaft 124, and is enclosed within the cylinder 114. The piston 186 fluidly divides the internal annular chamber formed by the cylinder 114 into a rear chamber 166 and a front chamber 168. The piston 186 is longitudinally slidable within the cylinder 114.

Thus, the chambers 154, 156, 166, and 168 have varying volumes, depending upon the positions of the pistons 180 and 186 within the cylinders. It will be understood that the cylinders and pistons can have any of a variety of different shapes and sizes (including non-circular cross-sections), preferably keeping in mind the goals of providing an elongated thrust chamber for a suitable power stroke, as well as concerns of simplicity, prevention of leakage, ease of manufacturing, and compatibility with existing downhole tools.

Although one aft propulsion cylinder 108 and one forward propulsion cylinder 114 (along with a corresponding aft piston and forward piston) are shown in the illustrated embodiment, any number of aft cylinders and forward cylinders may be provided. The hydraulic thrust provided by the tractor increases as the number of propulsion cylinders increases. In other words, the hydraulic force provided by the cylinders is additive. Thus, the number of cylinders is selected according to the desired thrust. It will be understood that the number of cylinders may be limited by the capability of the gripper assemblies to transfer radial loads to the borehole wall. In other words, the thrust produced by the cylinders should not be so high as to cause the gripper assemblies to slip in their actuated positions. In a preferred embodiment, the cylinder outside diameter is 3.75 inches. In this embodiment, the gripper assemblies are designed to transmit a radial gripping force of approximately 6,500 pounds, and each piston is designed to produce a stall force of 8,835 pounds at 1500 psi. Thus, in this embodiment, only one aft and one forward cylinder are preferred. The load transmission capability of the gripper assemblies varies by design of the gripper assembly.

The tractor 100 is hydraulically powered by an operating fluid pumped down the drill string, such as brine, sea water, drilling mud, or hydraulic fluid. In a preferred embodiment, the same fluid that may operate downhole equipment 32 (FIG. 1) powers the tractor. This avoids the need to provide additional fluid channels in the tool for the fluid powering the tractor. Preferably, liquid brine or sea water is used in an open system. Alternatively, fluid may be used in a closed system, if desired. Referring to FIG. 1, in operation, operating fluid flows from the drill string 30 through the tractor 100 and down to the downhole equipment 32. Referring again to FIG. 3, a diffuser or filter 132 in the control assembly 102 diverts a portion of the operating fluid into the valve system 133 to power the tractor. Preferably, the diffuser 132 filters out larger fluid particles that can damage internal components of the valve system, such as the valve spools.

Preferred Configuration of Valve System

With reference to FIG. 3, a preferred embodiment of the valve system 133 includes an inlet or entry control valve 136, a propulsion control valve 146, a gripper control valve 148, an aft cycle valve 150, and a forward cycle valve 152. In addition, pressure reduction valves 244 and 246 are preferably provided to limit the fluid pressure in the gripper assemblies, as described in further detail below. The operation of each of these valves is discussed below.

Fluid diverted to the valve system 133 through the diffuser 132 enters an inlet galley 134 upstream of the inlet control valve 136. As used herein, the terms "galley," "chamber," and "passage" refer to regions of the tractor that are configured to contain operating fluid, and are not limited to any particular shape. Some of these regions are illustrated as flow paths or lines in FIG. 3.

The inlet control valve 136 is preferably a spool valve, a preferred embodiment of which is illustrated in FIGS. 4–8. The valve 136 serves as a gateway for fluid to flow into a main galley 144 of the valve system 133. The spool of the valve 136 has first, second, and third position ranges, the second range being interposed between the first and third ranges. In the first and third position ranges, the spool provides a flow path (represented by arrow 174 for the first position range and arrow 176 for the third position range) for fluid within the main galley 144 to flow through the valve 136 to the annulus 40 on the exterior of the tractor. Also, in the first and third position ranges, the spool prevents the flow of fluid from the inlet galley 134 through the valve 136 into the main galley 144. Thus, in the first and third position ranges of the inlet control valve spool, fluid exits the valve system 133 to render the tractor non-operational. In the second position range, the spool provides a flow path (represented by arrow 172) for fluid in the inlet galley 134 to flow into the main galley 144. In the second position range, the spool also prevents the flow of fluid from the main galley 144 through the valve 136 to the annulus 40. Thus, in the second position range of the inlet control valve spool, fluid enters the valve system 133 such that the tractor is operational. In FIG. 3, the spool of valve 136 is shown in its second position range. When shifted vertically downward in FIG. 3, the spool occupies its first position range. When shifted vertically upward in FIG. 3, the spool occupies its third position range.

The spool of the inlet control valve 136 has a first end or surface 139 biased by one or more springs 140 and a second end or surface 138 exposed to fluid in the inlet galley 134. In the illustrated embodiment, the spring 140 is also in fluid communication with the annulus 40, as indicated by the broken lines 142. The spring 140 imparts a spring force on the first end surface 139 that tends to push the spool toward its first position range. In the illustrated embodiment, fluid from the annulus 40 also imparts a pressure force onto the first end surface 139. The fluid in the galley 134 imparts a pressure force on the second surface 138 that tends to push the spool toward its third position range. Thus, the spring force and fluid pressure force on the first end surface 139 act against the fluid pressure force on the second surface 138. The differential fluid pressure in the inlet galley 134 required to move the spool from the first position range to the lower endpoint of the second position range (i.e., the position at which the valve opens a flow path between the galleys 134 and 144) depends upon the effective spring constant of the spring 140 and is defined as the lower shut-off threshold. Likewise, the differential fluid pressure required to move the spool from the second position range to the lower endpoint of the third position range (i.e., the position at which the valve closes the flow path between the galleys 134 and 144) also depends upon the effective spring constant of the spring 140 and is defined as the upper shut-off threshold. Unless otherwise indicated, as used herein, "differential pressure" or "pressure" at a particular location within the tractor refers to the difference between the pressure at that location and the pressure in the annulus 40. Advantageously, the inlet control valve 136 thus permits the fluid pressure within the valve system 133 to be limited to within a specific range. In a preferred embodiment, the lower shut-off threshold is 800 psid and the upper shut-off threshold is 2100 psid.

It will be understood that the spring 140 can bear against any suitable surface of the spool or any component having a fixed relationship with the spool. It will also be understood that the spring 140 can be configured to operate primarily in tension or primarily in compression, keeping in mind the goal of biasing the spool toward its first position.

In the preferred embodiment, discussed in greater detail below, the inlet control valve 136 includes a locking feature to lock the valve spool in its third position range and to thus prevent fluid from entering the valve system 133. The locking feature is schematically represented in FIG. 3 by a latch 137. The purpose and preferred configuration of the locking feature is discussed below.

The main galley 144 fluidly communicates with and provides incoming pressurized operating fluid to the propulsion control valve 146, the gripper control valve 148, the aft cycle valve 150, and the forward cycle valve 152. The propulsion control valve 146 is preferably a two-position spool valve. The spool of the valve 146 has a first position, shown in FIG. 3, in which the valve 146 provides a flow path (represented by arrow 192) for the flow of fluid from the main galley 144 into a chamber or passage 196. The chamber 196 leads from the valve 146 to the aft chamber 154 of the aft cylinder 108, and also to the forward chamber 168 of the forward cylinder 114. When the spool of the valve 146 is in its first position, the valve 146 also provides a flow path (represented by arrow 194) for the flow of fluid within a chamber or passage 198 to the annulus 40. The chamber 198 leads from the valve 146 to the forward chamber 156 of the aft cylinder 108, and also to the aft chamber 166 of the forward cylinder 114.

The spool of the propulsion control valve 146 also has a second position, shifted to the left in FIG. 3. When the spool of the valve 146 is in its second position, the valve 146 provides a flow path (represented by arrow 200) for the flow of fluid from the main galley 144 to the chamber 198. When the spool of the valve 146 is in its second position, the valve 146 also provides a flow path (represented by arrow 202) for the flow of fluid from the chamber 196 to the annulus 40.

With continued reference to FIG. 3, the spool of the propulsion control valve 146 has a first end surface 188 and a second end surface 190. The first end surface 188 is exposed to fluid within a chamber 204 that leads to the aft gripper assembly 104 (or, if present, to an aft pressure reduction valve 244). The second end surface 190 is exposed to fluid within a chamber 206 that leads to the forward gripper assembly 106 (or, if present, to a forward pressure reduction valve 246). The first and second end surfaces 188 and 190 are configured to receive respective fluid pressure forces that act against each other. The first end surface 188 receives a pressure force from the fluid in the chamber 204 that tends to move the spool of the valve 146 toward its first position, as shown in FIG. 3. The second end surface 190 receives a pressure force from the fluid in the chamber 206 that tends to move the spool toward its second position, which would be shifted to the left in FIG. 3. Preferably, the valve 146 includes detents (mechanical catches or restraints) for retaining the spool in its first and second positions until the pressure difference between the chambers 204 and 206 reaches a shifting threshold. In a preferred embodiment, the detents include resilient elements, such as springs, that interact with tapered surfaces of the spool landings, as described in further detail below and illustrated in FIG. 10. Alternatively, the detents may be conventional mechanical detents.

Like the propulsion control valve 146, the gripper control valve 148 is preferably a two-position spool valve. The spool of the valve 148 has a first position, shown in FIG. 3, in which the valve 148 provides a flow path (represented by arrow 208) for the flow of fluid from the main galley 144 into the chamber 204. When the spool of the valve 148 is in its first position, the valve 148 also provides a flow path (represented by arrow 210) for the flow of fluid within the chamber 206 to the annulus 40. The spool of the gripper control valve 148 also has a second position, not shown in FIG. 3. The second position is that which the spool would be in if it is shifted to the left in FIG. 3. When the spool of the valve 148 is in its second position, the valve 148 provides a flow path (represented by arrow 212) for the flow of fluid from the main galley 144 to the chamber 206. When the spool of the valve 148 is in its second position, the valve 148 also provides a flow path (represented by arrow 214) for the flow of fluid from the chamber 204 to the annulus 40.

The spool of the gripper control valve 148 has a first end surface 216 and a second end surface 218. The first end surface 216 is exposed to fluid within a chamber or passage 220 that leads to the aft cycle valve 150. The second end surface 218 is exposed to fluid within a chamber or passage 222 that leads to the forward cycle valve 152. The first and second end surfaces 216 and 218 are configured to receive respective fluid pressure forces that act against each other. The first end surface 216 receives a pressure force from the fluid in the chamber 220 that tends to move the spool of the valve 148 toward its first position, as shown in FIG. 3. The second end surface 218 receives a pressure force from the fluid in the chamber 222 that tends to move the spool toward its second position, which would be shifted to the left in FIG. 3. Preferably, the valve 148 includes detents for retaining the spool in its first and second positions until the pressure difference between the chambers 220 and 222 reaches a shifting threshold. In a preferred embodiment, the detents include resilient elements, such as springs, that interact with tapered surfaces of the spool landings. Alternatively, the detents may be conventional mechanical detents.

The aft cycle valve 150 is preferably a two-position spring-biased spool valve. The spool of the cycle valve 150 has a first position, shown in FIG. 3, in which the valve 150 provides a flow path (represented by arrow 224) for the flow of fluid from the chamber 220 to the annulus 40. The spool also has a second position, not shown in FIG. 3. The second position is that which the spool would be in if it is shifted vertically downward in FIG. 3. When the spool of the cycle valve 150 is in its second position, the valve 150 provides a flow path (represented by arrow 226) for the flow of fluid from the main galley 144 to the chamber 220.

The spool of the cycle valve 150 has an end surface 228 exposed to fluid in the chamber 198. The fluid in the chamber 198 imparts a pressure force onto the end surface 228, which tends to move the spool toward its second position. An opposite end surface 230 of the spool is biased by one or more springs 232. In the illustrated embodiment, the end surface 230 is also in fluid communication with fluid in the annulus 40. The spring 232 imparts a spring force onto the spool, which tends to move the spool to its first position. Thus, the fluid pressure force on the end surface 228 and the spring force on the end surface 230 act against each other. When the differential fluid pressure in the chamber 198 is below a threshold, the fluid pressure force is less than the spring force and the spool occupies its first position. When the differential fluid pressure in the chamber 198 exceeds the threshold, the fluid pressure force exceeds the spring force and the spool moves to its second position. Any desired threshold can be achieved by careful selection of the spring 232. It will be understood that the spring 232 can bear against any suitable surface of the spool or any component having a fixed relationship with the spool. It will also be understood that the spring 232 can be configured to operate primarily in tension or primarily in compression, keeping in mind the goal of biasing the spool toward its first position.

The forward cycle valve 152 is preferably configured similarly to the aft cycle valve 150. The valve 152 is preferably a two-position spring-biased spool valve. The spool of the cycle valve 152 has a first position, shown in FIG. 3, in which the valve 152 provides a flow path (represented by arrow 234) for the flow of fluid from the chamber 222 to the annulus 40. The spool also has a second position, not shown in FIG. 3. The second position is that which the spool would be in if it is shifted vertically downward in FIG. 3. When the spool of the cycle valve 152 is in its second position, the valve 152 provides a flow path (represented by arrow 236) for the flow of fluid from the main galley 144 to the chamber 222.

The spool of the cycle valve 152 has an end surface 238 exposed to fluid in the chamber 196. The fluid in the chamber 196 imparts a pressure force onto the end surface 238, which tends to move the spool toward its second position. An opposite end surface 240 of the spool is biased by one or more springs 242. In the illustrated embodiment, the end surface 240 is also in fluid communication with fluid in the annulus 40. The spring 242 imparts a spring force onto the end surface 240, which tends to move the spool to its first position. Thus, the fluid pressure force on the end surface 238 and the spring force on the end surface 240 act against each other. When the differential fluid pressure in the chamber 196 is below a threshold, the fluid pressure force is less than the spring force and the spool occupies its first position. When the differential fluid pressure in the chamber 196 exceeds the threshold, the fluid pressure force exceeds the spring force and the spool moves to its second position. Any desired threshold can be achieved by careful selection of the spring 242. It will be understood that the spring 242 can bear against any suitable surface of the spool or any component having a fixed relationship with the spool. It will also be understood that the spring 242 can be configured to operate primarily in tension or primarily in compression, keeping in mind the goal of biasing the spool toward its first position.

The gripper control valve 148 acts as a pilot for the propulsion control valve 146, which would stall without this pilot. The pilot action of valve 148 improves the operation of valve 146 since the operation of valve 146 controls the pressure signal to the cycle valves 150 and 152. Without the gripper control valve 148 to isolate the valve 146 from the cycle valves 150 and 152, the valve 146 would stall or oscillate. For example, consider a configuration in which the valve 146 controls fluid flow to the passages 196, 198, 204, and 206 (which is not the case in the illustrated embodiment), and in which the valve 148 is eliminated. In a worst-case scenario, the system would operate as follows.

When the piston 180 reaches the end of its stroke, rising pressure in the passage 196 would "open" the valve 152 (i.e., would cause the valve 152 to shift to its second position, downward in FIG. 3). This would cause a pressure rise in the passage 222, causing the spool of valve 146 to shift toward the left position (in FIG. 3). As the flow path 192 begins to close, the pressure in passage 196 would decrease, causing the cycle valve 152 to close. The high pressure force on the end surface 190 of the spool of the valve 146 would be lost. Without a pressure force on the surface 190, the spool of the valve 146 would not be able to finish the shift and would either stall in a partially shifted position or return to the first position (i.e., to the right in FIG. 3). If the spool of the valve 146 returns to its first position, the pressure signal would be restored to the cycle valve 152, which would again shift to provide a pressure signal to the spool of the valve 146. The spool would again start to shift. This cycle would continue without the spool of the valve 146 ever completing a full shift. In the illustrated embodiment of the valve system 133, the gripper control valve 148 ensures that the spool of the propulsion control valve 146 completes each of its shifts. A complete sequence of operation is described below.

As shown in FIG. 3, the valve system 133 preferably includes two pressure reduction valves 244 and 246. The pressure reduction valves limit the pressure of the fluid in the gripper assemblies, and thus provide a means for preventing possible failure of the gripper assembly components.

The aft pressure reduction valve 244 preferably comprises a spool valve. In a first position of the spool, shown in FIG. 3, the valve 244 provides a flow path (represented by arrow 250) for the flow of fluid within the chamber 204 to a chamber or passage 248 that leads to the aft gripper assembly 104. The valve spool is designed to be in its first position when the gripper assembly 104 is being purposefully actuated or retracted according to the operational cycle of the valve system 133. A second position of the spool is that in which the spool is shifted partially to the left in FIG. 3. In the second position of the spool, the valve 244 blocks communication between the chambers 204 and 248. The valve spool is designed to be in its second position when the gripper assembly 104 is actuated during the normal operational cycle of the valve system 133. The second position of the spool prevents fluid from exiting the gripper assembly 104.

A third position of the spool of the pressure reduction valve 244 is that in which the spool is shifted further to the left. In the third position, the valve 244 provides a flow path (represented by arrow 252) for the flow of fluid within the chamber 248 to the annulus 40. In the preferred embodiment, the valve spool is designed to shift to the third position when the toes 612 (see FIG. 21) of the preferred gripper assembly experience external forces, such as sliding friction between the toes and the borehole surface. These external forces can cause over-pressurization of the fluid in the gripper assembly 104. The third position of the spool of the valve 244 allows the excess pressure to bleed to the annulus 40. The spool has a surface 254 exposed to fluid within the chamber 248, and an opposing surface 256 biased by one or more springs 258. Fluid within the chamber 248 imparts a fluid pressure force onto the surface 254, which tends to move the spool toward its third position. The spring 258 exerts a spring force that counteracts the fluid pressure force and tends to move the spool toward its first position. When the pressure in the chamber 248 exceeds a threshold determined by the spring 258, the spool shifts to its third position. Thus, the valve 244 imposes an upper limit on the pressure in the passage 248 and thereby prevents over-pressurization of the aft gripper assembly 104 by bleeding excess pressure to the annulus 40.

It will be understood that the spring 258 can bear against any suitable surface of the spool or any component having a fixed relationship with the spool. It will also be understood that the spring 258 can be configured to operate primarily in tension or primarily in compression, keeping in mind the goal of biasing the spool toward its first position.

The forward pressure reduction valve 246 is preferably configured similarly to the aft pressure reduction valve 244. The forward pressure reduction valve 246 preferably comprises a spool valve. In a first position of the spool, shown in FIG. 3, the valve 246 provides a flow path (represented by arrow 262) for the flow of fluid within the chamber 206 to a chamber or passage 260 that leads to the forward gripper assembly 106. The valve spool is designed to be in its first position when the gripper assembly 106 is being purposefully actuated or retracted according to the operational cycle of the valve system 133. A second position of the spool is that in which the spool is shifted partially to the left in FIG. 3. In the second position of the spool, the valve 246 blocks communication between the chambers 206 and 260. The valve spool is designed to be in its second position when the gripper assembly 106 is actuated during the normal operational cycle of the valve system 133. The second position of the spool prevents fluid from exiting the gripper assembly 106.

A third position of the spool of the pressure reduction valve 246 is that in which the spool is shifted further to the left. In the third position, the valve 246 provides a flow path (represented by arrow 264) for the flow of fluid within the chamber 260 to the annulus 40. In the preferred embodiment, the valve spool is designed to shift to the third position when the toes 612 (see FIG. 21) of the preferred gripper assembly experience external forces, such as sliding friction between the toes and the borehole surface. These external forces can cause over-pressurization of the fluid in the gripper assembly 106. The third position of the spool of the valve 246 allows the excess pressure to bleed to the annulus 40. The spool has a surface 266 exposed to fluid within the chamber 206, and an opposing surface 268 biased by one or more springs 270. Fluid within the chamber 260 imparts a fluid pressure force onto the surface 266, which tends to move the spool toward its third position. The spring 270 exerts a spring force that counteracts the fluid pressure force and tends to move the spool toward its first position. When the pressure in the chamber 260 exceeds a threshold determined by the spring 270, the spool shifts to its third position. Thus, the valve 246 imposes an upper limit on the pressure in the passage 260 and thereby prevents over-pressurization of the forward gripper assembly 106 by bleeding excess pressure to the annulus 40.

It will be understood that the spring 270 can bear against any suitable surface of the spool or any component having a fixed relationship with the spool. It will also be understood that the spring 270 can be configured to operate primarily in tension or primarily in compression, keeping in mind the goal of biasing the spool toward its first position.

It will also be understood that some of the illustrated valves of the valve system 133 can be combined to provide a more condensed configuration of the valve system. The valves can be formed from various different materials, but are preferably made of a hard erosion-resistant material such as Tungsten Carbide, Ferrotic (a proprietary metal formulation), or possibly a ceramic blend.

Valve System Operation

With reference to FIG. 3, when the inlet control valve 136 is open, i.e., in its second position range, pressurized operating fluid flows from the inlet galley 134 to the main galley 144 of the valve system 133. With the valves in the positions shown in FIG. 3, the pressurized operating fluid in the main galley 144 flows through the gripper control valve 148, the chamber 204, the aft pressure reduction valve 244, the chamber 248 (which extends through the aft shaft 118), and into the aft gripper assembly 104. Thus, the aft gripper assembly 104 becomes actuated and grips onto the borehole surface 42. At the same time, fluid within the forward gripper assembly 106 flows through the chamber 260 (which extends through the forward shaft 124), the forward pressure reduction valve, the chamber 206, the gripper control valve, and into the annulus 40. Thus, the forward gripper assembly 106 becomes retracted from the borehole surface 42.

With the aft gripper assembly 104 actuated and the forward gripper assembly 106 retracted, pressurized fluid within the main galley 144 flows through the propulsion control valve 146, the chamber 196 (which extends through both shafts), and into the aft chamber 154 of the aft cylinders 108, as well as into the forward chamber 168 of the forward cylinder 114. Simultaneously, fluid within the forward chamber 156 of the aft cylinder 108, as well as fluid within the aft chambers 166 of the forward cylinder 114, flows through the chamber 198 (which extends through both shafts) and the propulsion control valve 146 into the annulus 40. This causes the aft piston 180, and thus the entire tractor body, to be thrust forward (to the right in FIG. 3) with respect to the actuated aft gripper assembly 104. In other words, the aft cylinder 108 performs a power stroke. Simultaneously, the forward cylinder 114 is thrust forward with respect to the piston 186 and the tractor body. In other words, the forward cylinder 114 performs a reset stroke.

During the above strokes of the cylinders, note that the fluid within the chamber 204 is pressurized and the fluid within the chamber 206 is depressurized. Thus, the fluid pressure force acting on the first end surface 188 of the spool of the propulsion control valve 146 is significantly larger than the fluid pressure force acting on the second end surface 190 of the spool. As a result, the spool of the valve 146 is maintained in its first position (the position shown in FIG. 3).

Also, during the above strokes of the cylinders, the cycle valves 150 and 152 remain in their first positions (the positions shown in FIG. 3). Since there is flow into the valve system 133 filling the cylinders, there is a pressure drop from the full system pressure available in the central passage 44. This decrease in pressure maintains the cycle valves in their first positions. Thus, the chambers 220 and 222 remain in fluid communication with the annulus 40. In this state, the fluid pressure forces on the end surfaces 216 and 218 of the spool of the gripper control valve 148 are approximately equal (the pressure within the annulus 40 may vary depending upon position). Hence, the gripper control valve 148 will remain in the position shown in FIG. 3, particularly since the detents (described below) require a threshold force to shift the valve spool.

When the cylinders complete their respective strokes, the fluid pressure in the chamber 196 will begin to rise. In contrast to when the cylinders are still stroking, the incoming flow of fluid into the system is halted. As a result, the pressure in the tractor valve system 133 will rise to the full pressure available in the center passage 44. When the pressure in the chamber 196 exceeds a threshold associated with the spring(s) 242 of the forward cycle valve 152, the spool of the valve 152 will shift to its second position (downward in FIG. 3), permitting pressurized fluid from the main galley 144 to enter the chamber 222. At this point, the spool of the aft cycle valve 150 is still in its first position, due to the low pressure in chamber 198. Due to the pressure imbalance on the end surfaces 216 and 218, the spool of the gripper control valve 148 overcomes the retaining forces of the detents and shifts to its second position (to the left in FIG. 3). As a result, pressurized fluid within the galley 144 flows through the gripper control valve 148, the chamber 206, the forward pressure reduction valve 246, the chamber 260, into the forward gripper assembly 106. This causes the forward gripper assembly to actuate and grip onto the borehole surface 42. Simultaneously, fluid within the aft gripper assembly 104 flows through the chamber 248, the aft pressure reduction valve 244, the chamber 204, the gripper control valve 148, into the annulus 40. This causes the aft gripper assembly to retract from the borehole surface 42. Thus, when the gripper control valve 148 switches positions, both gripper assemblies switch between their actuated and retracted positions.

After the gripper control valve 148 switches its position, the fluid within the chamber 204 becomes depressurized and the fluid within the chamber 206 becomes pressurized. The resulting pressure imbalance on the end surfaces 188 and 190 causes the spool of the propulsion control valve 146 to overcome the retaining forces of its detents and shift to its second position (to the left in FIG. 3). This happens when the flow of fluid into the valve system 133 stops, which occurs when the gripper assembly has come into contact with the borehole wall. When the flow stops, there is no longer a pressure drop (due to flow), and the pressure will rise to full system pressure. As a result of the shifting of the spool of the valve 146, pressurized fluid within the main galley 144 flows through the propulsion control valve 146, the chamber 198, and into the forward chamber 156 of the aft cylinder 108 and the aft chamber 166 of the forward cylinder 114. Simultaneously, fluid within the aft chamber 154 of the aft cylinder 108, as well as fluid within the forward chamber 168 of the forward cylinder 114, flows through the chamber 196 and the propulsion control valve 146 into the annulus 40. This causes the forward piston 186, and thus the entire tractor body, to be thrust forward (to the right in FIG. 3) with respect to the actuated forward gripper assembly 106. In other words, the forward cylinder 114 performs a power stroke. Simultaneously, the aft cylinder 108 is thrust forward with respect to the piston 180 and the tractor body. In other words, the aft cylinder 108 performs a reset stroke. The depressurization of the chamber 196 causes the spool of the forward cycle valve 152 to shift back to its first position (the position shown in FIG. 3).

During the above strokes of the cylinders, the fluid within the chamber 206 is pressurized and the fluid within the chamber 204 is depressurized. Thus, the fluid pressure force acting on the second end surface 190 of the spool of the propulsion control valve 146 is significantly larger than the fluid pressure force acting on the first end surface 188 of the spool. As a result, the spool of the valve 146 is maintained in its second position (shifted to the left in FIG. 3).

Also, during the above strokes of the cylinders, with the cycle valves 150 and 152 in their first positions (the positions shown in FIG. 3), the chambers 220 and 222 are in fluid communication with the annulus 40. In this state, the fluid pressure forces on the end surfaces 216 and 218 of the spool of the gripper control valve 148 are again equal. Hence, the gripper control valve 148 will remain in its position, particularly since the detents (described below) require a threshold force to shift the valve spool.

When the cylinders complete their respective strokes, the fluid pressure in the chamber 198 will begin to rise. When the pressure in the chamber 198 exceeds a threshold associated with the spring(s) 232 of the aft cycle valve 150, the spool of the valve 150 will shift to its second position (downward in FIG. 3), permitting pressurized fluid from the main galley 144 to enter the chamber 220. At this point, the spool of the forward cycle valve 152 is still in its first position, due to the low pressure in chamber 196. Due to the pressure imbalance on the end surfaces 216 and 218, the spool of the gripper control valve 148 overcomes the retaining forces of the detents and shifts back to its first position (the position shown in FIG. 3). As a result, pressurized fluid flows from the galley 144 through the gripper control valve 148, the chamber 204, the aft pressure reduction valve 244, the chamber 248, into the aft gripper assembly 104. This causes the aft gripper assembly to actuate. Simultaneously, fluid within the forward gripper assembly 106 flows through the chamber 260, the forward pressure reduction valve 246, the chamber 206, the gripper control valve 148, into the annulus 40. This causes the forward gripper assembly 106 to retract.

After the gripper control valve 148 switches its position, the fluid within the chamber 204 again becomes pressurized and the fluid within the chamber 206 again becomes depressurized. The resulting pressure imbalance on the end surfaces 188 and 190 causes the spool of the propulsion control valve 146 to overcome the retaining forces of its detents and shift back to its first position (the position shown in FIG. 3). With the valve 146 back in its first position, pressurized fluid again flows into the aft chamber 154 of the aft cylinder 108, and into the forward chamber 168 of the forward cylinder 114. Simultaneously, fluid within the forward chamber 156 of the aft cylinder 108, as well as fluid within the aft chamber 166 of the forward cylinder 114, flows into the annulus 40. This causes the aft cylinder 108 to perform a new power stroke. Simultaneously, the forward cylinder 110 performs a new reset stroke. The depressurization of the chamber 198 causes the spool of the aft cycle valve 150 to shift back to its first position (the position shown in FIG. 3).

At this point, all of the valves have returned back to their original positions (the positions shown in FIG. 3). Thus, the above describes a complete cycle of operation of the valve system during forward motion. Note that during forward (or backward) motion, the gripper assemblies shuttle between two extreme positions: First, the gripper assemblies move as far apart as possible toward opposite ends of the tractor. Second, the gripper assemblies move as close together as possible (with the propulsion cylinders and control assembly between them). During most of the operation of the tractor, one gripper assembly is in a power stroke while the other is in a reset stroke. When they switch directions they also switch gripper action. Hence, the tractor continually moves in one longitudinal direction.

A significant advantage of the preferred configuration of the valve system 133 is that the cylinders are assured of completing their respective strokes before the gripper assemblies are switched between their actuated and retracted positions. This result is achieved by (1) the provision of separate valves for controlling the flow of fluid to the gripper assemblies and to the propulsion cylinders (in the illustrated embodiment, these are the propulsion control valve 146 and the gripper control valve 148), and (2) piloting the gripper control valve by cycle valves that are themselves piloted by the pressure in the cylinders. This ensures that the cycle valves will open only when the pressure in the cylinders increases significantly, which in turn will occur only when the cylinders complete their strokes or when the tractor is stalled by an overload.

In a preferred embodiment, the valve system 133 requires an incoming flow of operating fluid of about 16 gallons per minute. Typically, large positive displacement pumps are utilized at the ground surface to pump fluid down the coiled tubing and through the internal passage 44 of the tractor. Such pumps usually supply a flow rate of about 80 to 120 gpm. Thus, since the valve system only requires a relatively small portion of the flow, the operation of the tractor has little effect on the pressure in the passage 44. This makes the system more stable. Preferably, an orifice is provided downstream of the tractor. The orifice is designed to provide the desired back pressure (which the tractor utilizes to push/pull a specified load) at a predetermined flow rate within the passage 44.

The speed of the tractor is determined by the pressure and flow rate of fluid pumped through the coiled tubing, as well as the loads experienced by the tractor. The pressure and flow rate of the fluid in the coiled tubing, which are substantially controlled by the actions of surface equipment operators, together determine the amount of hydraulic energy available in the tractor. The loads experienced by the tractor include the weight of equipment (such as the equipment 32 shown in FIG. 1) pushed and pulled by the tractor, tension in the coiled tubing from the surface, frictional drag forces between the coiled tubing and the borehole, etc. The surface operators also control the injector and coiled tubing reel and thus the feed rate of the coiled tubing into the borehole.

Because the valve system 133 is all-hydraulic, its maximum speed is greater than an electrically controlled tractor. The valve system does not include electrical conductors and other electrical elements, which allows for larger internal fluid passages, greater flow rates, and improved power density. The faster maximum speed of the tractor results in lower operational costs, especially for intervention applications. In a preferred embodiment of the invention, the tractor is capable of moving at speeds greater than or equal to 1350 feet per hour.

Control Assembly

According to the preferred embodiment, the tractor 100 includes a control assembly 102 which houses the valve system 133 described above. One embodiment of the control assembly 102 is shown partially disassembled in FIG. 4. The illustrated control assembly includes a control housing 280, an aft transition housing 282, and a forward transition housing 284.

Figure 4:
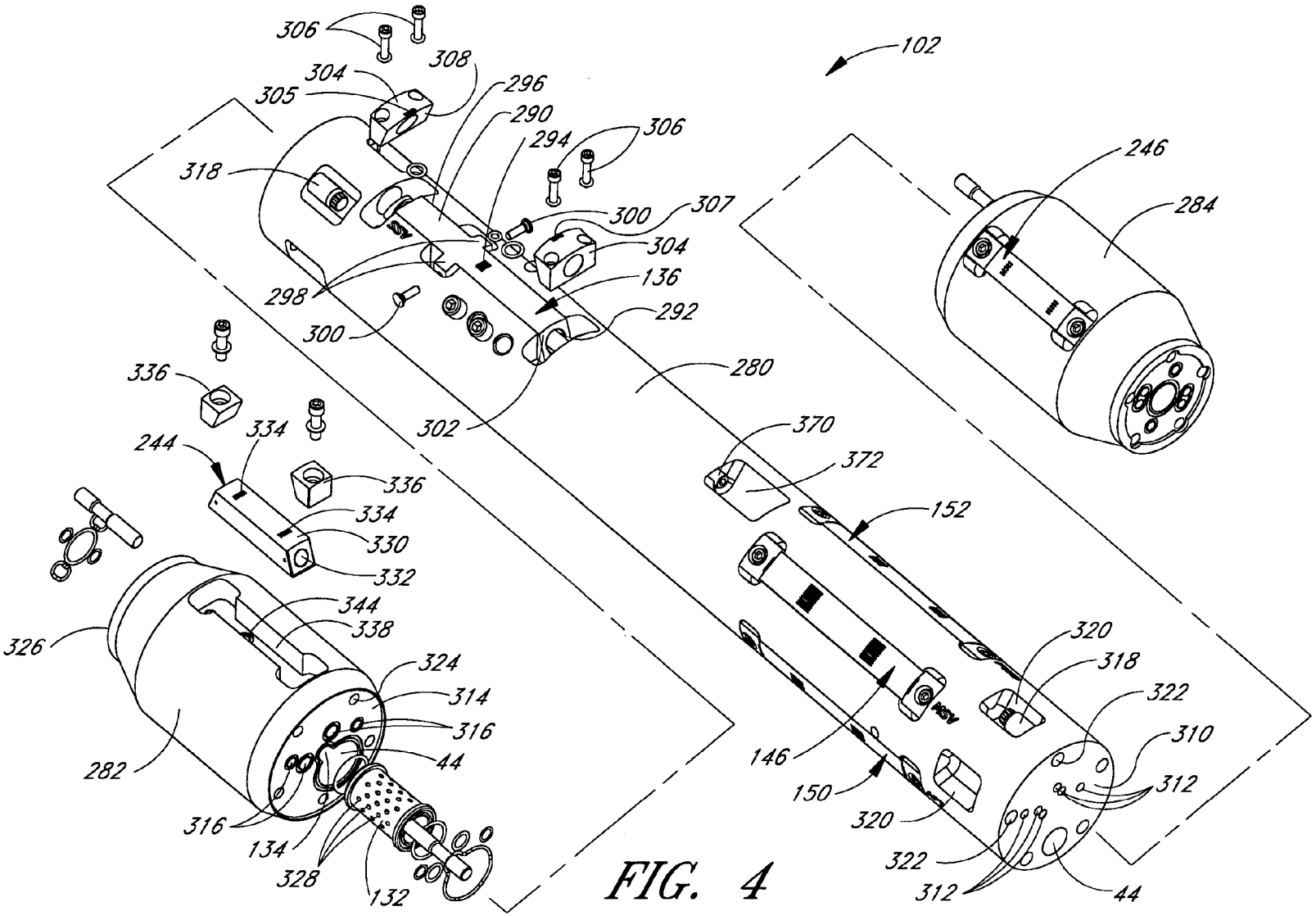
FIG. 4 is a front perspective view of the control assembly of the tractor of FIG. 2, shown partially disassembled.

The control housing 280 houses the inlet control valve 136, the propulsion control valve 146, the gripper control valve 148 (not visible, as it is located on the backside of the view of FIG. 4), and the cycle valves 150 and 152. Each valve includes an elongated valve housing defining a spool passage, and a spool. The valves are positioned within recesses in the outer surface of the control housing 280.

For example, the inlet control valve 136 includes a housing 290 having a spool passage 292 sized to receive a spool. The valve housing 290 also has an external vent 294 configured to vent operating fluid into the annulus 40 between the tractor and the borehole surface. The housing 290 is positioned within a recess 296 in the outer surface of the control housing 280. In contrast to the housings of the other valves, the inlet control valve housing 290 includes two pin receiving side portions 298 configured to receive pins or slot engagement portions 300, for purposes described below. The ends of the housing 290 are slightly inclined from the radial direction, such that the housing has a trapezoidal axial cross-section. Two valve housing clamp elements 304 are secured into the recess 296 at each end of the valve housing 290 by bolts 306. The clamp elements have surfaces 308 that mate closely with the inclined surfaces 302 of the valve housing 290, thus securing the valve housing rigidly onto the control housing 280. The aft clamp element has a vent 305, and the forward clamp element has a vent 307. The inner configuration of the valve housing 290 and the spool of the inlet control valve 136 are described below.

The propulsion control valve 146, gripper control valve 148, and cycle valves 150 and 152 are configured somewhat similarly to the inlet control valve 136. Specifically, the valve housings of the valves 146, 148, 150, and 152 are include similarly configured spool passages and vents and are secured to the control housing 280 in similar fashion. In the illustrated embodiment, the housings of the valves 146, 148, 150, and 152 include two vents as opposed to one. Also, each of the clamp elements for the valves 146, 148, 150, and 152 receives a single bolt as opposed to two bolts.

The control housing 280 includes numerous internal fluid passages for the controlled flow of operating fluid to the downhole equipment 32 (FIG. 1), between the valves, to the gripper assemblies, and to the propulsion cylinders. The fluid passages are configured to effect the hydraulic circuit shown in FIG. 3. Some of the fluid passages extend to openings 312 in the end surfaces 310 of the control housing 280, where they connect to openings of corresponding fluid passages in the end surfaces 316 of the transition housings 282 and 284. Some of these fluid passages extend through the shafts 118 and 124 (FIG. 2) to the gripper assemblies, the propulsion cylinders, or to downhole equipment connected to the tractor. As in the EST, within the housing 280 the internal passage 44 is shifted to one side (i.e., it is not in the center of the housing), to maximize available space for the various valves and internal fluid passages. Also, if liquid brine is used as the operating fluid, the passage 44 is not required to be as large as in the EST design, further maximizing the available space.

The control housing 280 is bolted to the transition housings 282 and 284 by a plurality of studs 318 and nuts 319. The studs extend though holes 322 in the end surfaces 310 of the housing 280 into holes 324 in the end surfaces 314 of the transition housings. Recesses 320 are provided in the outer surfaces of the housing 280, which facilitate access to the studs 318. In the illustrated embodiment, five studs 318 are provided in the end surfaces of the housing 280 and the transition housings.

The aft transition housing 282 houses the diffuser 132 and the aft pressure reduction valve 244. The aft end 326 of the housing 282 receives the internal passage 44 from the aft shaft 118 at the center axis of the tractor. Within the housing 282, the passage 44 transitions toward one side of the housing. Thus, the housing 282 moves the passage 44 to one side to maximize space for the valves and various fluid passages within the control housing 280. The diffuser 132 is positioned on the forward end 314 of the housing 282. As in the EST, the diffuser 132 is generally cylindrical and has a plurality of side holes 328 for directing the flow from the passage 44 into the inlet galley 134 of the inlet control valve 136. In one embodiment, the side holes 328 are angled so that the fluid passing forward through the diffuser must turn somewhat aftward to enter the inlet galley 134. This prevents larger particles within the operating fluid from entering the valve system 133, as it is more difficult for the larger particles to overcome forward momentum and flow through the side holes 328. Those of ordinary skill in the art will understand that any of a variety of different types of filters can be used instead of the illustrated diffuser 132.

The aft pressure reduction valve 244 includes a valve housing 330. The valve housing 330 is configured similarly to the housings of the valves within the control housing 280. Specifically, the valve housing 330 includes a similarly configured spool passage 332 and vents 334. In the illustrated embodiment, the valve housing 330 includes two vents 334. Also, the valve housing 330 is secured into a recess 338 of the aft transition housing 282 by the use of clamp elements 336, in similar fashion as the aforementioned valve housings are secured to the control housing 280. The recess 338 includes several openings 344. The openings 344 comprise ends of fluid passages that conduct fluid to and from corresponding side passages in the valve housing 330 of the valve 244 (such as the side passages 477 and 479 shown in FIG. 13), as described in further detail below. It will be understood that the corresponding recesses for all of the valve housings of the housings 280 and 284 (such as the recess 296 of the inlet control valve 136) have openings of fluid passages that communicate flow through the valves.

The forward transition housing 284 is configured generally similarly to the aft transition housing 282. One difference is that the aft housing 282 is configured to accommodate the diffuser 132 and has a fluid passage for the inlet galley 134, whereas the forward housing 284 does not require these features. Also, the forward housing 284 transitions the internal passage 44 back to the center axis of the tractor.

Figure 5:
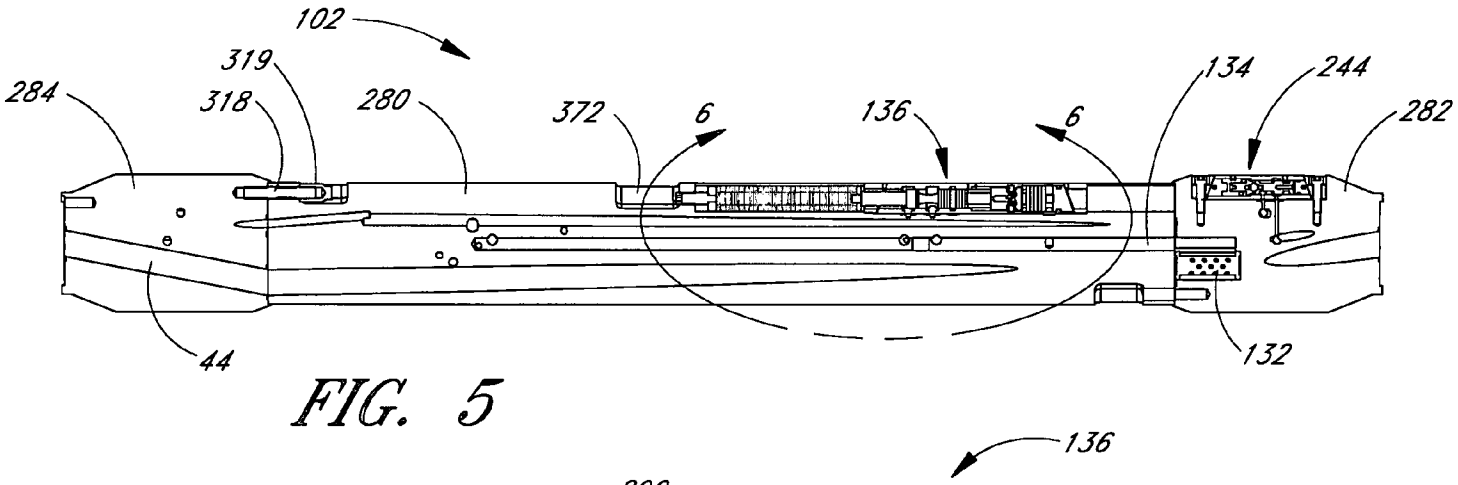
FIG. 5 is a longitudinal sectional view of the control assembly of FIG. 4, illustrating the inlet control valve of the tractor.

FIG. 5 shows a longitudinal cross-section of the assembled control assembly 102 of FIG. 4, with the aft end on the right and the forward end on the left. This particular section shows the configuration of the inlet control valve 136. Also shown in FIG. 5 are several internal fluid passages, which comprise some of the flow lines, chambers, passages, and galleys schematically illustrated in FIG. 3. One of skill in the art will understand that the internal fluid passages can have any of a large variety of configurations.

Inlet Control Valve

Figure 6:
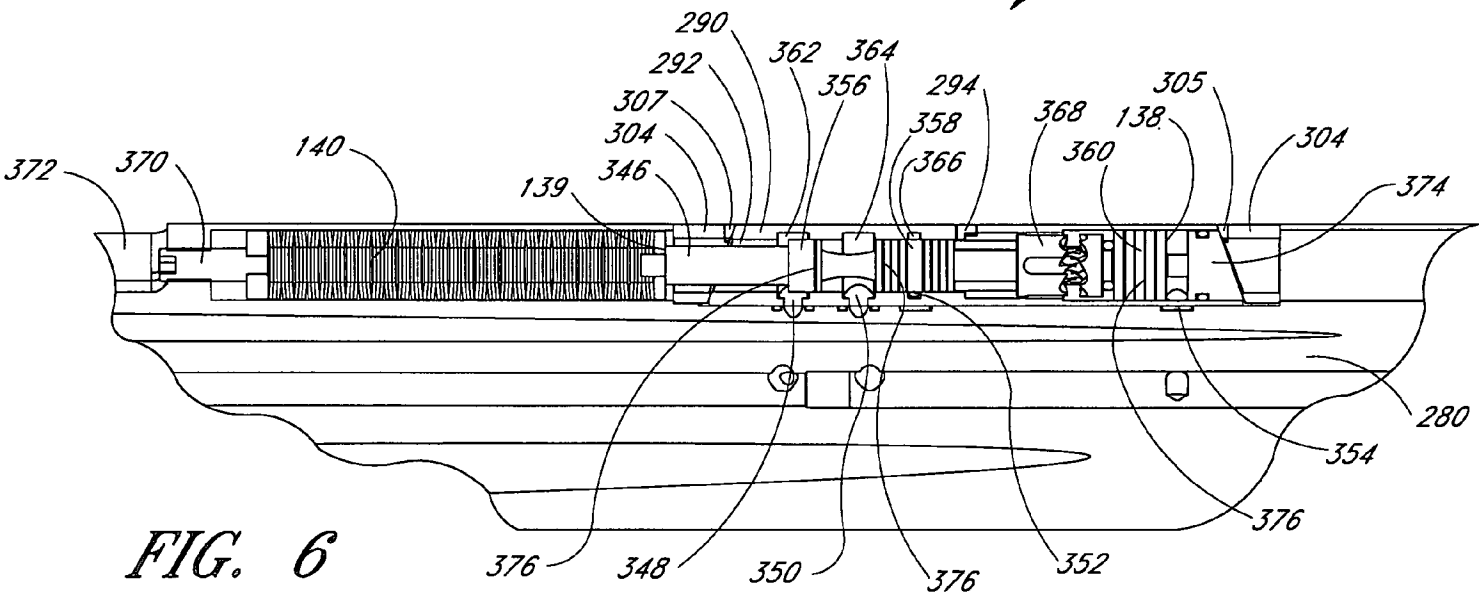
FIG. 6 is an exploded view of the inlet control valve shown in FIG. 5.

FIG. 6 is an exploded view of the inlet control valve 136 shown in FIG. 5, which includes the valve housing 290, an elongated spool 346, and a set of springs 140 biasing the spool to the right of the figure. The valve housing 290 defines an elongated generally cylindrical spool passage 292 that receives the spool 346. The inner surface of the passage 292 has annular recesses 362, 364, and 366 (commonly referred to as "galleys"), in which the passage has a slightly enlarged inner diameter. The valve housing 290 also includes side passages or fluid ports 348, 350, 352, and 354 that are open to the spool passage 292. When the valve housing 290 is secured onto the control housing 280, these ports align with openings of fluid passages in the housing 280. The ports 348 and 352 are in fluid communication with the main galley 144 of the valve system 133. The ports 350 and 354 are in fluid communication with the inlet control galley 134. The ports 348, 350, and 352 are located within the annular recesses 362, 364, and 366, respectively. The port 354 is located aftward of the second end surface 138 of the spool 346. The port 354 permits fluid within the inlet galley 134 to impart a pressure force against the end surface 138, which tends to move the spool 346 toward its second and third position ranges (to the left in FIG. 6). The housing 290 further includes the aforementioned vents 294, 305, and 307. The port 305 is non-functional in this configuration. It exists only because it is desirable to have identical designs for the clamp elements 304, and because a vent is desired within the forward clamp element. On the aft end of the valve housing 290, a plug 374 and an O-ring seal are provided to prevent fluid on the second end surface 138 of the spool 346 from flowing out to the annulus 40 through the vent 305.

As described above, the first end surface 139 of the spool 346 is in contact with a set of springs 140 that bias the spool 346 aftward, or to the right in FIG. 6. In a preferred embodiment, Belleville springs are stacked in 30 sets in series, each set containing three springs in parallel. This configuration provides a desired spring rate and resultant deflection. The spool 346 has three "landings" 356, 358, and 360. These landings comprise larger diameter portions that effect a fluid seal of the spool passage 292, as known in the art. In other words, each landing slides within the passage and prevents fluid on one side of the landing from flowing to the other side of the landing. The spool 346 also includes a locking feature to lock the spool in its third position range, in which the inlet control valve 136 is closed at high pressure. In the illustrated embodiment, the locking feature comprises a deactivation cam 368, described in further detail below.

As explained above, the spool 346 has first, second, and third position ranges. In the first and third ranges, the inlet control valve 136 provides a flow path for fluid from the main galley 144 of the valve system to vent into the annulus 40, and prevents fluid within the inlet galley 134 from flowing through the valve 136 into the main galley 144. In the second range, the valve 136 provides a flow path for fluid within the inlet galley 134 to flow into the main galley 144, and prevents fluid within the main galley 144 from flowing through the valve 136 into the annulus 40.

In FIG. 6, the spool 346 is shown in its first position range, shifted to the right. In this position, fluid from the main galley 144 flows through the fluid port 348, past the forward end of the landing 356, through the spool passage 292, and out to the annulus 40 through the vent 307. The spool 346 occupies this position when the pressure in the inlet galley 134 is below a lower shut-off threshold (e.g., 800 psid). As the pressure in the galley 134 rises, the fluid pressure force acting on the second end surface 138 of the spool 346 increases and pushes the spool to the left in FIG. 6, until the fluid pressure force is equalized by the spring force from the springs 140. When the pressure in the inlet galley 134 exceeds the lower shut-off threshold, the spool 346 moves to the left in FIG. 6 until it occupies a position within its second range. In this position, the landing 356 blocks flow between the port 348 and the vent 307, and permits flow between the ports 348 and 350. Fluid now flows from the inlet control galley 134 through the port 350, the spool passage 292, the port 348, and into the main galley 144. Fluid within the galley 144 is prevented from flowing through the valve 136 into the annulus 40. When the pressure in the inlet galley 134 exceeds an upper shut-off threshold (e.g., 2100 psid), the spool 346 moves further left in FIG. 6 until it occupies a position within its third range. In this position, the landing 358 blocks flow through the port 350 but permits flow between the port 352 and the vent 294. Fluid flows from the main galley 144 through the port 352, the spool passage 292, the vent 294, into the annulus 40.

A spring adjustment screw 370 is preferably provided to adjust the compression of the springs 140. In the illustrated embodiment, the screw 370 is accessible via a recess 372 in the control housing 280, which is also shown in FIG. 4. Adjustment of the screw 370 permits the shut-off threshold pressures of the inlet control valve 136 to be adjusted.

As shown in FIG. 6, the landings 356, 358, and 360 include "centering grooves" 376. The grooves 376 comprise circumferential grooves oriented generally perpendicular to the spool passage 292. The grooves 376 reduce leakage across the landings by providing a series of expansions and contractions in the leak path. Also, the grooves effectively equalize pressure around the circumference of the landing. During operation, fluid within the valve tends to push the spool against the side of the spool passage. By equalizing the pressure around the landings, the centering grooves cause the spool to remain more accurately centered within the spool passage. As a result, less energy is required to move the spool, and the valve operates more efficiently and reliably. Further, the centering function reduces leakage. The concentric relationship between the landings and the spool passage minimizes the largest width of the leak path. The grooves 376 also provide a region for small particles to deposit, which further prevents jamming of the spool within the spool passage. Any number of centering grooves can be provided on each of the landings of the spool 346. In the preferred embodiment, the grooves have a depth between 0.010 and 0.030 inches, and a width between 0.010 and 0.020 inches.

Figure 7:
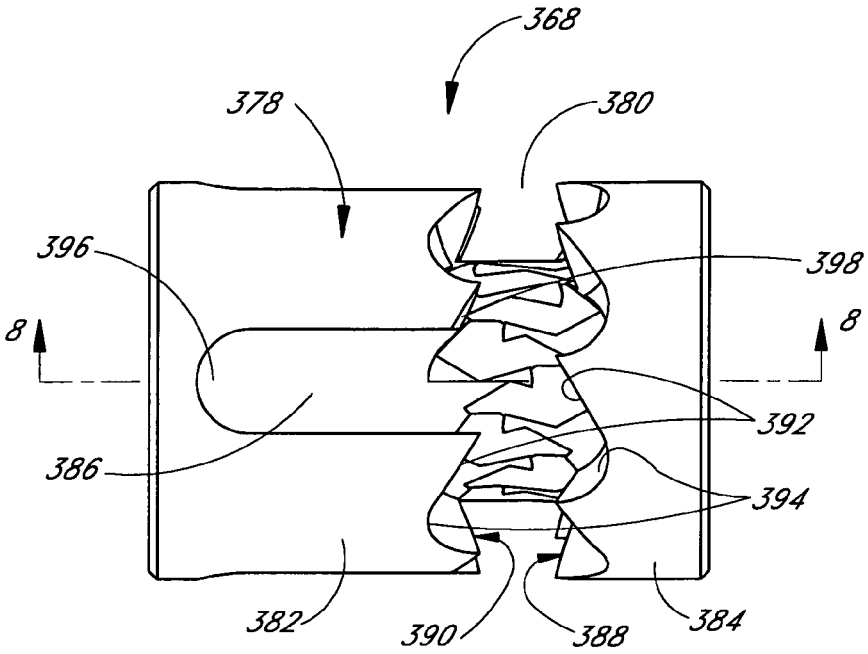
FIG. 7 is an exploded view of the deactivation cam shown in FIG. 6.
Figure 8:
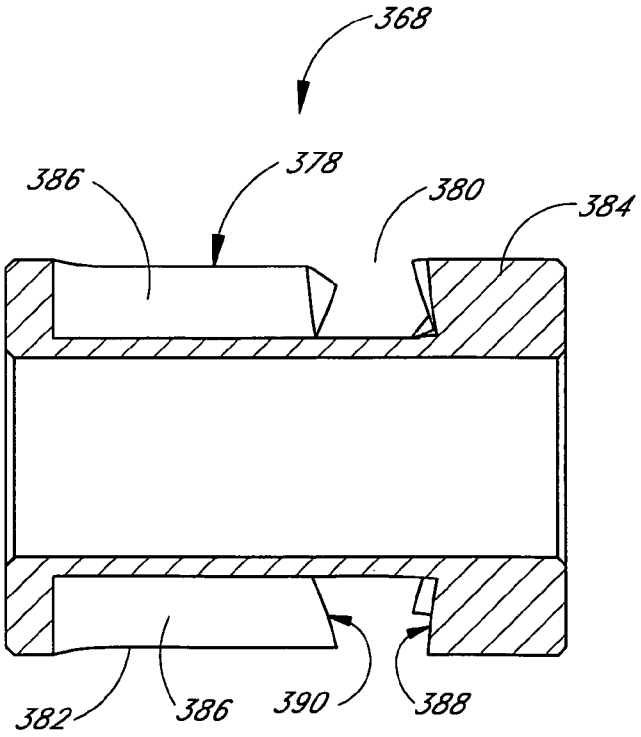
FIG. 8 is a longitudinal sectional view of the deactivation cam of FIG. 7.

FIGS. 7 and 8 further illustrate the deactivation cam 368 of the spool 346 of the inlet control valve 136. The cam 368 forms a portion of the spool 346 and is preferably axially fixed, but rotationally free, with respect to the remainder of the spool. The cam 368 comprises a large diameter portion 378 having a first portion 382 and a second portion 384 separated by an annular cam path recess 380. The peripheral surface of the first portion 382 includes at least one slot 386 oriented parallel to the spool passage 292 and extending into the recess 380. In the preferred embodiment, four slots 386 are provided in the peripheral surface of the first portion 382 and are spaced at 90° intervals (with respect to the longitudinal axis of the spool 346) around the circumference of the cam 368. Each slot 386 is sized and configured to receive a slot engagement portion of the valve housing 290. At least one slot engagement portion is provided within the spool passage 292. The slot engagement portion extends radially inward from an inner surface of the spool passage 292. Preferably, there are two slot engagement portions, on opposite sides of the spool passage separated by 180°. In the preferred embodiment, the slot engagement portions comprise pins 300 (FIG. 4) received within side walls of the valve housing 290.

The cam path recess 380 of the deactivation cam 368 is defined partially by a first annular sidewall 388 and a second annular sidewall 390. The sidewalls 388 and 390 include a plurality of cam surfaces 392 and valleys 394. As used herein, a "valley" refers to a region of the sidewall in which one of the slot engagement portions can become restrained within when the slot engagement portion bears against the sidewall 388 or 390. The cam surfaces 392 are angled with respect to the axis of the spool 346. In the preferred embodiment, the cam surfaces 392 are oriented at angles of about 60° with respect to the axis of the spool 346. The valleys 394 are configured to receive the slot engagement portions, such as the pins 300. When the pins 300 are not received within the slots 386, the cam 368 can freely rotate about the longitudinal axis of the spool passage 292. In a less preferred embodiment, the spool 346, including the deactivation cam 368, is rotatable about its longitudinal axis within the spool passage 292.

When the spool 346 is in its first position range, as defined above, the pins 300 are received within the slots 386 of the deactivation cam 368, preventing the cam from rotating. In the first position range, the pins 300 are positioned near the first ends 396 of the slots 386. As the spool 346 moves to its second position range, the cam 368 moves toward the springs 140 (FIG. 6) and the cam path recess 380 moves closer to the pins. However, the pins 300 remain within the slots 386. When the spool 346 moves to the lower endpoint of its third position range (i.e., when the pressure in the inlet galley 134 reaches the lower shut-off threshold pressure, as explained above), the pins 300 are still within the slots 386. As the pressure within the inlet galley 134 continues to rise, the pins 300 eventually enter the cam path recess 380, at which point the cam 386 becomes free to rotate. When the pressure in the inlet galley 134 reaches an upper cam activation pressure (e.g., 2500 psid), which is above the upper shut-off threshold pressure (e.g., 2100 psid), cam surfaces 392 of the first sidewall 388 bear against the pins 300. This causes the cam 368 to rotate in a first direction (so that the labeled slot 396 moves upward in FIG. 7) until each pin 300 is nestled in a valley 394 of the first sidewall 388. In a preferred embodiment, the cam surfaces 392 are configured similarly, such that the spool 346 rotates 22.5°. If the pressure in the inlet galley 134 increases beyond the upper cam activation pressure, the pins 300 nestled within the valleys 394 of the first sidewall 388 prevent the spool 346 from moving further toward the springs 140.

With the cam 368 in this rotated position, the pins 300 are no longer aligned with the slots 386. If the fluid within the inlet galley 134 (or in the passage 44—it will be understood that the pressure within the passage 44 is very closely equal to the pressure in the galley 134) is depressurized only once, the pins 300 will not re-enter the slots 386. Rather, the pins 300 are now restrained within the cam path recess 380. In this locked position of the valve 136, the spool 346 is in its third position range, such that the fluid within the valve system 133 is free to vent to the annulus 40. In this position, the tractor is in a failsafe mode, i.e., a mode in which the gripper assemblies are depressurized and retracted from the borehole surface 42. A significant advantage of this failsafe mode is that equipment connected to the tractor can undertake activities without risking damage to the gripper assemblies. For example, perforation guns can be operated with the gripper assemblies assured of being retracted, thus preventing or minimizing any possible damage to the gripper assemblies. Also, with the gripper assemblies assured of being retracted, they cannot cause the perforation guns to be erroneously moved. The failsafe mode also makes it possible to pull the tractor out of the borehole in case of an emergency.

After the cam surfaces 392 of the first sidewall 388 bear against the pins 300 for the first time and cause the cam 368 to initially rotate in the first direction, a subsequent first depressurization of the fluid within the inlet galley 134 below a lower cam-activation pressure (which is above the upper shut-off threshold) causes the deactivation cam 368 to move to the right in FIG. 7, so that cam surfaces 392 of the second sidewall 390 bear against the pins 300. This causes the cam 368 to rotate further in the first direction, until each pin 300 is nestled within a valley 394 of the second sidewall 390. In the preferred embodiment, the cam surfaces 392 of the second sidewall 390 are configured so that the cam rotates another 22.5°. At this point, the cam has rotated a total of 45° from the time the spool 346 was last in its first or second position ranges. The spool 346 is still restrained within its third position range. If the fluid in the inlet galley 134 is further depressurized, the pins 300 nestled within the valleys 394 of the second sidewall 390 will prevent the spool 346 from moving into its second (or "operating") position range.

Thus, as described above, a single pressure spike of the fluid in the inlet galley 134 to the upper cam activation pressure causes the entry control valve 136 to move to its locked position, in which the gripper assemblies are assured of being retracted.

The deactivation cam 368 is preferably configured so that, in order to move the spool 346 back into its second or first position ranges, it is necessary to again pressurize the fluid within the inlet galley 134. In the illustrated embodiment, this repressurization must occur after the pressure was first lowered from the upper cam activation threshold to the lower cam activation threshold. With the pins 300 restrained within the cam path recess 380 and nestled within valleys 394 of the second sidewall 390, a repressurization of the fluid within the inlet galley 134 to the upper cam activation pressure causes the spool 346 to move to the left in FIG. 7, so that the pins 300 again bear against cam surfaces 392 of the first sidewall 388. The cam 368 again rotates in the first direction (again, preferably 22.5°, such that the cam will have rotated a total of 67.5° since the spool 346 was last in its first or second position ranges) until each pin is again nestled within a valley 394 of the first sidewall 388. Then, a subsequent second depressurization of the fluid within the inlet galley 134 causes the spool 346 to move to the right in FIG. 7. When the pressure decreases to the lower cam activation level, each pin 300 bears against a partial cam surface 398 just "above" (see FIG. 7) one of the slots 386. As the pressure in the galley 134 continues to drop, the pins 300 slide along the cam surfaces 398 such that the cam rotates another 22.5° in the first direction. At this point, the cam 368 will have rotated a total of 90° since the spool 346 was last in its first or second position ranges. This causes the pins 300 to reenter the slots 386, although each pin is now in a different slot than before. The reengagement of the pins 300 within the slots 386 prevents the cam 368 from rotating further and permits the spool 346 to move into its second and first position ranges.

The spool 346 of the inlet control valve 136 can have variable diameter sections to allow some degree of throttling of the fluid into the tractor. This configuration provides some control over the pressure drop and speed of the tractor. In one embodiment, the landings of the spool 346 include notches, such as the notches 438 shown in FIG. 11 and described below. Thus, it will be understood that, in industry parlance, the valve 136 is commonly referred to as a "four-way valve," as it has a throttling position.

If desired, the cam 368 could be made to be completely rigid with respect to the remainder of the spool. However, such a configuration would require more force to rotate the cam and is thus less desirable than the preferred configuration described above.

Propulsion Control and Gripper Control Valves

The propulsion control valve 146 and the gripper control valve 148 function similarly. They are both piloted by fluid pressure on both sides. In a preferred embodiment, the valves 146 and 148 are configured substantially identically. Thus, only the propulsion control valve 146 is herein described.

Preferably, the propulsion control valve 146 almost has a "critically lapped spool design." A critically lapped valve has no "center" position (or third position), which would allow the valve to be closed. In this case, a closed propulsion control valve would render the tractor non-operational. Instead, the valve 146 is preferably "overlapped," which assures that fluid flows to only one of the chambers 196 and 198 (FIG. 3). An overlapped design also keeps leakage to a minimum. In contrast, an "under lapped" design would allow fluid to simultaneously flow to both of the chambers 196 and 198. Preferably, the valve 146 is not under lapped.

Figure 9:
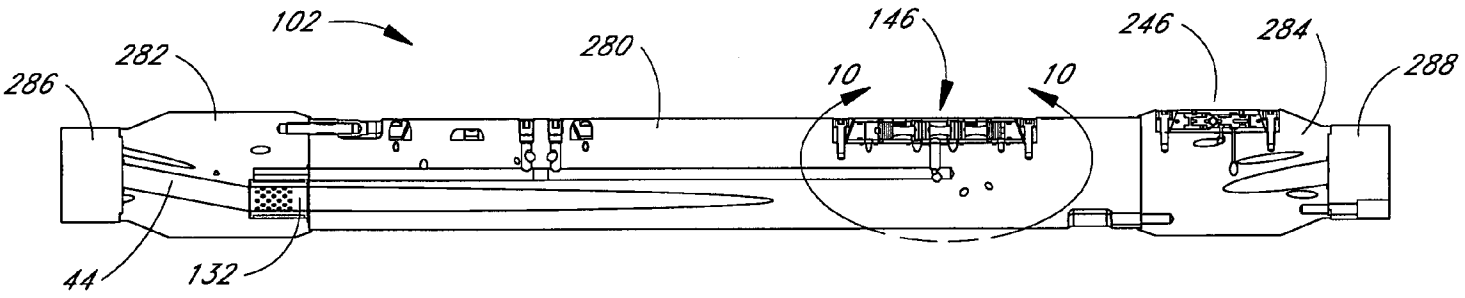
FIG. 9 is a longitudinal sectional view of the control assembly of FIG. 4, illustrating the propulsion control valve of the tractor.
Figure 10:
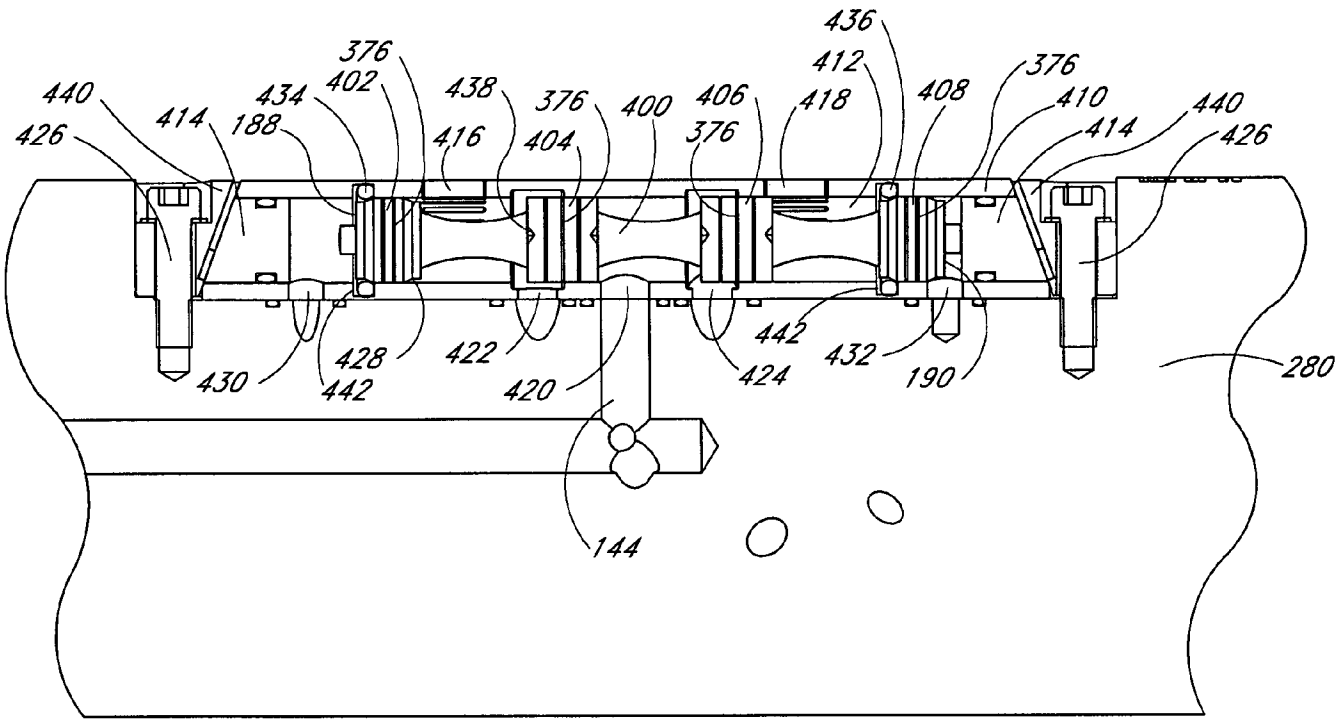
FIG. 10 is an exploded view of the propulsion control valve shown in FIG. 9.

FIG. 9 is a longitudinal sectional view of the preferred embodiment of the control assembly 102, with the aft end shown on the left and the forward end on the right. FIG. 9 shows the propulsion control valve 146 in cross-section. The valve 146 is located toward the forward end of the control housing 280. FIG. 10 is an exploded view of the valve 146 as depicted in FIG. 9. In the preferred embodiment, the valve 146 functions as a two-position spool valve with detents that tend to retain the spool within one of its two main positions. In reality, it is a three-position valve with a center (blocked) position. However, the spool resides within its center position for only about 0.005 inches of a total spool stroke of 0.35 inches, which makes the center position relatively insignificant. In the illustrated embodiment, the valve 146 includes a valve housing 410 having an internal cylindrical spool passage 412. Plugs 414 with O-rings seal the ends of the spool passage 412. The valve housing 410 includes two vents 416 and 418. Two clamp elements 440 secure the ends of the valve housing 410 to the control housing 280 via bolts 426.

In the illustrated embodiment, the valve housing 410 includes fluid ports 430, 422, 420, 424, and 432, which align with openings of fluid passages within the control housing 280. The ports 430 and 432 provide pilot pressures that control the position of the spool 400. The ports 430 and 432 fluidly communicate with chambers 204 and 206, respectively. Fluid from the chamber 204 flows through the port 430 into the spool passage 412 and imparts a pressure force against the end surface 188 of the spool 400. Fluid from the chamber 206 flows through the port 432 into the spool passage 412 and imparts a pressure force against the end surface 190 of the spool 400. The ports 422, 420, and 424 fluidly communicate with the chamber 198, the main galley 144, and the chamber 196, respectively.

Near the ends of the valve housing 410, the inner surface of the spool passage 412 includes two grooves 442. Each groove 442 is preferably circular and sized to receive a resilient stop 434, 436. The stops 434 and 436 perform a detent function; they tend to retain the spool 400 in one of its two main positions. Each stop 434, 436 preferably defines an inner diameter and is positioned at least partially within the groove 442. Each stop 434, 436 has a relaxed position in which it has a first inner diameter and in which at least an inner radial portion of the stop is positioned outside of the groove 442. Each stop 434, 436 also has a deflected position in which it has a second inner diameter larger than the first inner diameter. Preferably, in its deflected position, substantially all of the stop is in the groove 442. In a preferred embodiment, each stop 434, 436 comprises an expandable ring-shaped spring. However, various other configurations are possible. For example, each stop could alternatively comprise a plurality of (e.g., three) circumferentially separated stop portions that extend radially inward from the inner surface of the spool passage 412.

The valve 146 includes a spool 400 having four landings 402, 404, 406, and 408. In the preferred embodiment, each of the two ends of each of the outer landings 402 and 408 have a radially tapered section followed by a generally constant diameter section that intersects the bottom of the taper. The tapered section has a tapered peripheral or radial surface 428. The tapered or conical surfaces 428 operate in conjunction with the stops 434, 436 to provide the detent function. The tapered surfaces 428 also function to prevent the stops 434, 436 from falling out or being washed out of the grooves 442. In their relaxed positions, each stop 434, 436 is configured to bear against or be in very close proximity to one of the tapered peripheral surfaces 428 of the landings 402 and 408, while being immediately radially outside of the reduced constant diameter section that intersects the bottom of the taper. It is this reduced diameter section that retains the stop from inadvertently being removed from the groove 442. The resilient stops are configured so that the landings 402 and 408 cannot move across the stops until the net longitudinal movement force on the spool 400 (from the fluid pressure on the end surfaces 188 and 190) reaches a threshold at which the tapered surfaces 428 of the landings cause the stops to move to their deflected positions. In their deflected positions, the stops 434, 436 permit the landings 402 and 408 to move across the stops. As used in this context, the terms "longitudinal" and "axial" refer to the longitudinal axis of the spool 400. Preferably, the shifting threshold of the valve 146 is relatively low, preferably between 250 and 800 psid.

As described above, the spool 400 of the propulsion control valve 146 has two main positions. The position shown in FIG. 10 corresponds to the above-described first position (shown in FIG. 3). In this position, fluid flows from the main galley 144 through the port 420, the spool passage 412, the port 424, and into the chamber 196. Simultaneously, fluid in the chamber 198 flows through the port 422, the spool passage 412, the vent 416, and into the annulus 40. As the fluid pressure forces against the end surfaces 188 and 190 fluctuate, the stops 434 and 436 bear against tapered surfaces 428 of the landings 402 and 408, respectively, to maintain the spool 400 in the position shown in FIG. 10. When the pressure differential acting on the end surfaces 188 and 190 (the force acting on end surface 190 being larger) reaches a threshold, the pressure force on the spool 400 exceeds the retaining forces of the stops 434, 436. The tapered surfaces 428 force the stops to move to their deflected positions, such that the spool 400 is permitted to shift to its second main position (to the left in FIGS. 3 and 10). After the spool 400 shifts, the stops 434, 436 move back to their relaxed positions and bear against or come in close proximity to the tapered surfaces 428 on the opposite sides of the landings 402 and 408. The spool 400 is thus maintained in its second position by the stops' contact with or close proximity to the tapered surface. The spool is prevented from moving away from the stop by the spool ends bearing against or being in close proximity to the end plugs 414. In the second position of the spool, fluid flows from the main galley 144 through the port 420, the spool passage 412, the port 422, and into the chamber 198. Simultaneously, fluid in the chamber 196 flows through the port 424, the spool passage 412, the vent 418, and into the annulus 40. The spool 400 will not shift back to its first position until the pressure differential acting on the end surfaces 188 and 190 (the force acting on end surface 188 being larger) reaches the aforementioned threshold necessary to again overcome the retaining forces of the stops 434, 436.

The landings of the spool 400 preferably include centering grooves 326, similar to those of the inlet control valve spool 346 described above. In the illustrated embodiment, the center landings 404 and 406 each include three centering grooves, and the outer landings 402 and 408 each include two centering grooves. Any number of centering grooves can be provided on each landing.

Figure 11:
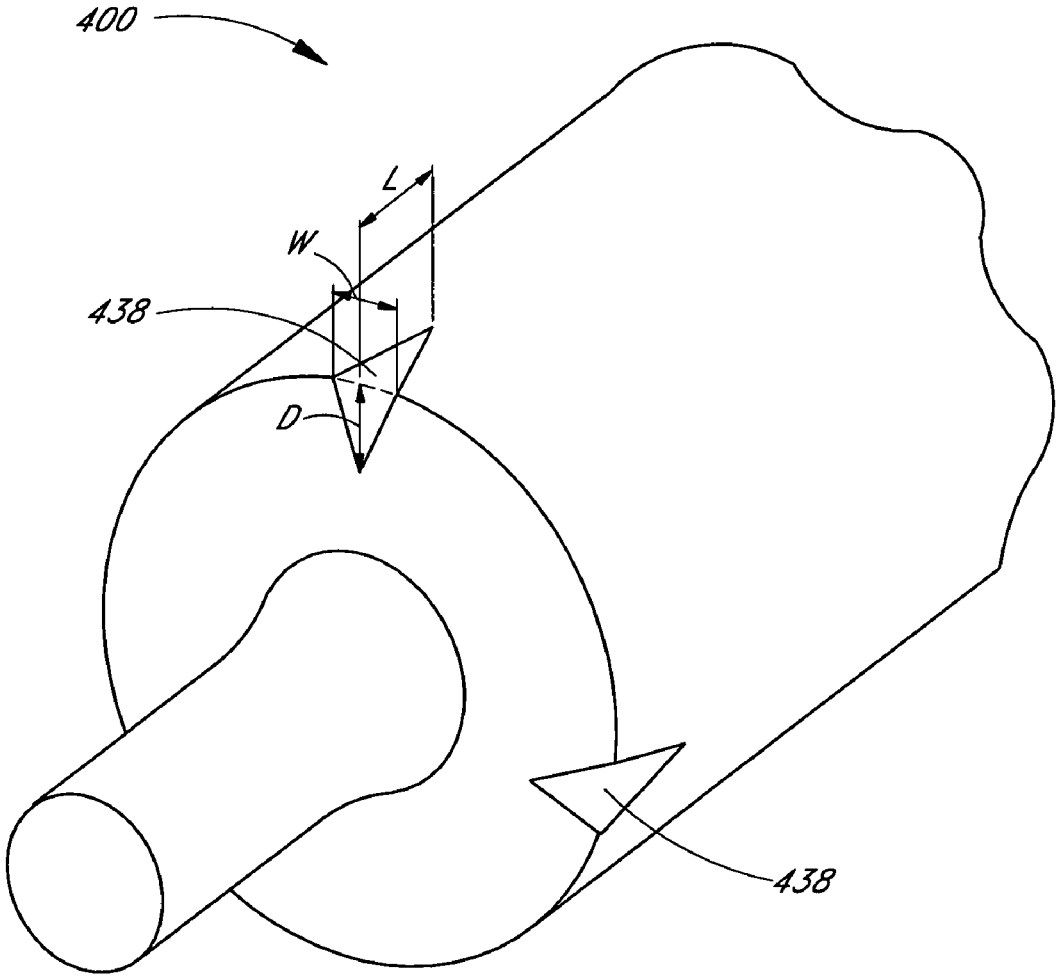
FIG. 11 is a perspective view of a portion of the propulsion control valve spool.

The center landings 404 and 406 preferably include a plurality of notches 438 (preferably between 3 and 8) at each end. The notches 438 permit a small amount of fluid flow past the landings when the landings are almost in a completely closed position with respect to a fluid port. The notches 438 help to reduce hydraulic shock caused by the sudden flow of fluid into a valve (commonly referred to as "hammer"). Thus, the notches help decrease wear on the valves. The skilled artisan will understand that notches can be included on some or all of the landings of the valves of the tractor 100. The notches 438 are preferably V-shaped. FIG. 11 shows an exemplary notch 438, having an axial length L extending inward from the edge of the landing, a width W at the edge of the landing, and a depth D. In one embodiment, L is about 0.055–0.070 inches, W is about 0.115–0.150 inches, and D is about 0.058–0.070 inches. Preferably, the positions of the notches 438 are carefully controlled, as the notches provide the lapping function of the valve 146.

As mentioned above, the gripper control valve 148 is preferably configured substantially identically to the propulsion control valve 146. One difference is that, in the valve 148, the fluid ports analogous to the fluid ports 430, 422, 424, and 432 of the valve 146 are in fluid communication with the chambers 220, 206, 204, and 222, respectively. Also, the gripper control valve 148 can be significantly smaller than the propulsion control valve 146, because the flow through the valve 148 can be significantly less.

In a preferred embodiment, the stops 434, 436 of the propulsion control valve 146 have about twice the detent force of analogous stops within the gripper control valve 148. In one embodiment, only one stop is provided within the valve 148, as opposed to two in the valve 146. Also, it is possible to use stops of differing stiffness or grooves 442 of differing diameter to adjust the detent force, keeping in mind the goal of ensuring that upon the completion of the strokes of the propulsion cylinders the gripper assemblies switch between their actuated and retracted positions before the valve 146 switches positions. It will also be understood that the detent force can be modified by adjusting the angles of the tapered sections 428 of the spools.

Cycle Valves

In the preferred embodiment, the cycle valves 150 and 152 are configured substantially identically. Thus, only the aft cycle valve 150 is herein described.

Figure 12:
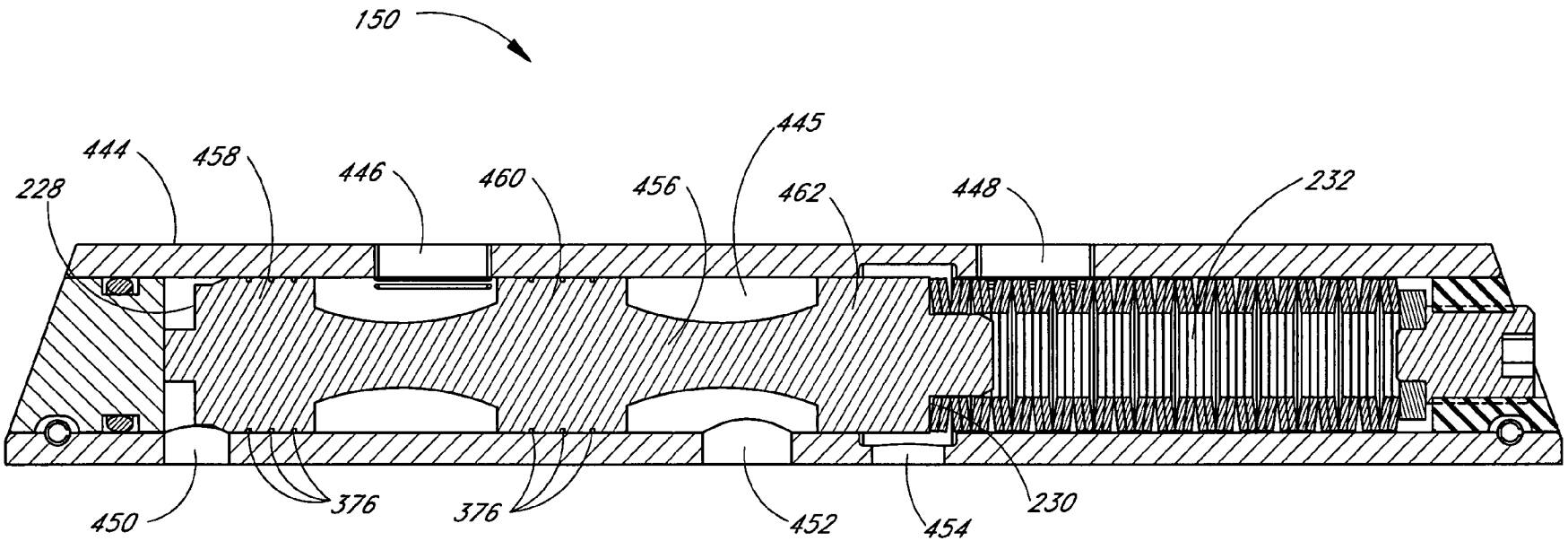
FIG. 12 is a longitudinal sectional view of the aft cycle valve shown in FIG. 4.

FIG. 12 shows a longitudinal sectional view of the aft cycle valve 150, according to a preferred embodiment, with the aft end shown on the left and the forward end shown on the right. With reference to the inlet control valve 136 and the propulsion control valve 146 described above, the cycle valve 150 includes a generally similarly configured valve housing 444. The housing 444 has an internal cylindrical spool passage 445 and includes vents 446 and 448. The housing 444 also includes fluid ports 450, 452, and 454 that fluidly communicate with the chamber 198, the main galley 144, and the chamber 220, respectively. The valve 150 includes a spool 456 with landings 458, 460, and 462 as shown. One or more of the landings preferably include centering grooves 376 as described above. The spool 456 has end surfaces 228 and 230. The end surface 228 is in fluid communication with the fluid in the chamber 198, via the port 450. A spring, and more preferably a set of springs 232 (preferably Belleville springs), bears against the end surface 230, such that the springs bias the spool 456 to the left in FIG. 12.

As explained above, the spool 456 of the valve 150 has a first position and a second position. The spool 456 is shown in its first position in FIG. 12. In this position, fluid within the chamber 220 flows through the port 454 and the spool passage 445, within the springs 232, through the vent 448, and out into the annulus 40. The fluid from the chamber 198 imparts a pressure force against the end surface 228, which tends to push the spool 456 to its second position (to the right in FIG. 12). When the fluid pressure force on the end surface 228 exceeds an actuation threshold, the spool 456 moves such that the landing 462 blocks the flow of fluid between the port 454 and the vent 448, and permits flow between the ports 452 and 454. When the spool 456 is in its second position, fluid within the main galley 144 flows through the port 452, the spool passage 445, the port 454, and into the chamber 220. Preferably, the actuation threshold of the valve 150 is between 800 and 1500 psid, or possibly even as high as 2000 psid. The vent 446 is non-operational. It exists only because of a preference that all of the valve housings have the same configuration, to keep manufacturing costs down.

As mentioned above, the forward cycle valve 152 is preferably configured substantially identically to the aft cycle valve 150. One difference is that, in the valve 152, the fluid ports analogous to the fluid ports 450 and 454 of the valve 150 are in fluid communication with the chambers 196 and 222, respectively. If desired, the valves 150 and 152 can be provided with screws to permit adjustment of the spring forces of the springs. Such screws can compensate for variance in manufacturing tolerances.

Pressure Reduction Valves

In a preferred embodiment, the pressure reduction valves 244 and 246 are configured substantially identically. Thus, only the aft pressure reduction valve 244 is herein described.

Figure 13:
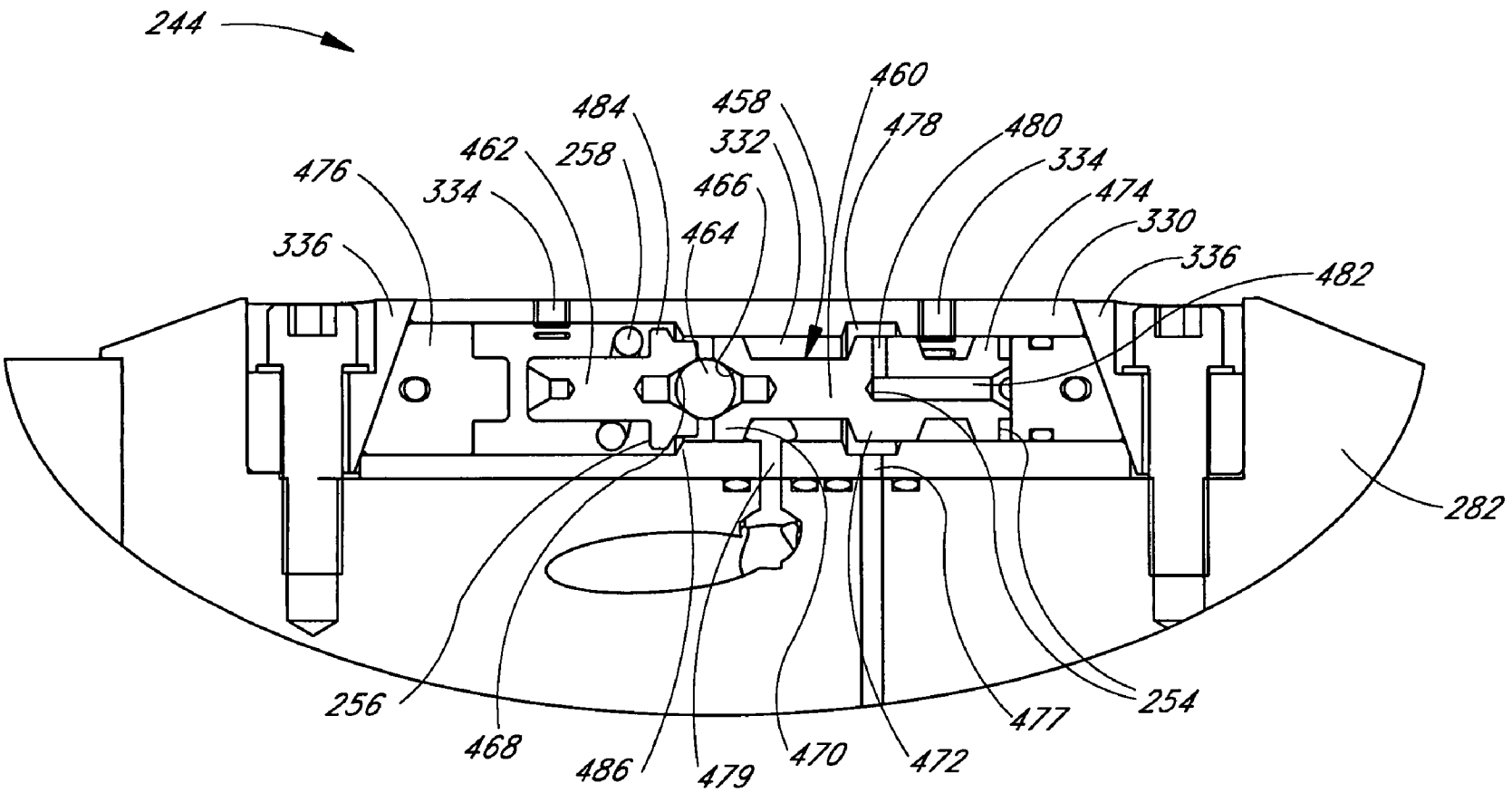
FIG. 13 is a longitudinal sectional view of the aft pressure reduction valve of the control assembly shown in FIG. 4.

FIG. 13 shows a longitudinal sectional view of the aft pressure reduction valve 244, according to a preferred embodiment, with the aft end shown on the right and the forward end shown on the left. The valve 244 includes a valve housing 330 configured generally similarly to those of the valves described above. The housing 330 has an inner cylindrical spool passage 332 with an annular recess 478. The housing 330 also includes two vents 334, as well as fluid ports 477 and 479 that fluidly communicate with the chambers 248 and 204, respectively. Each of the ports 477 and 479 is aligned with a fluid passage opening 344 in the aft transition housing 282 (FIG. 4). The port 477 is open to the annular recess 478 of the valve 244. The valve housing 330 is secured via clamp elements 336 and bolts to the aft transition housing 282.

The valve 244 includes a spool 458 comprising a first spool portion 460 and a second spool portion 462. The second spool portion 462 is preferably a spring guide. The spool portion 460 includes landings 470, 472, and 474 as shown. In some embodiments, one or more of the landings include centering grooves as described above. The spool portion 460 also includes a center-drilled passage 482 and a side passage 480. The passage 482 extends from the aft end of the spool portion 460 to the longitudinal position (in this context, the term "longitudinal" refers to the axis of the spool passage) of the side passage 480. The spool portion 460 is configured so that in normal operation the side passage 480 is positioned within the annular recess 478 of the spool passage 332. The side passage 480 is fluidly open to the center-drilled passage 482 so that fluid within the chamber 248 can flow into the passage 482. The fluid within the center-drilled passage 482 imparts a pressure force against the surface 254, which tends to push the spool 458 to the left in FIG. 13. As referred to herein, the surface 254 can include the aft end surface of the spool portion 460, outside of the passage 482.

The spool portion 462 has a flange 484 that defines an annular surface 256. A spring 258 is positioned between the surface 256 and an end plug 476. The spring 258 biases the spool portion 462 to the right in FIG. 13. In the illustrated embodiment, the spring 258 comprises a coil spring (only one coil is shown in FIG. 13) coiled around an elongated portion of the spool portion 462. In the preferred embodiment, there is always a clearance between a flange 484 of the spool portion 462 and an annular step 486 formed within the spool passage 332.

The spool portions 460 and 462 have opposing end surfaces with partially tapered and preferably partially conical ball-receiving recesses 466 and 468, respectively. A ball 464 is interposed between the spool portions 460 and 462, partially within the ball-receiving recesses 466 and 468. Preferably, the recesses 466 and 468 are configured to only partially receive the ball 464, so that the ball makes contact with both spool portions. The presence of the ball 464 and the ball-receiving recesses 466 and 468 results in improved alignment of the spool 458 within the spool passage 332, which in turn results in reduced leakage and more efficient operation.

As explained above, the spool 458 of the valve 244 has first, second, and third positions. The spool 458 is shown in its first position in FIG. 13. In this position, fluid within the chamber 204 flows through the port 479 across the forward end of the landing 472, and through the spool passage 332, the port 477, and into the chamber 248. When the fluid pressure force on the surface 254 exceeds an actuation threshold, the spool 458 moves to its second position (shifted partially to the left in FIG. 13). In this position, the landing 472 blocks fluid flow between the ports 477 and 479, which stops the flow into the aft gripper assembly 104 (FIG. 3). This spool will normally be in the second position when the gripper assembly is actuated. If the pressure in the chamber 248 is further increased, such as by an external friction force on the gripper assembly, the spool shifts further left to its third position. In the third position, excess pressure in the chamber 248 bleeds past the aft end of the landing 472 through the aft vent 334 into the annulus 40. The forward vent 334 accommodates volume changes on the left side of the landing 470 as the spool moves to the left.

As mentioned above, the forward pressure reduction valve 246 is preferably configured substantially identically to the aft pressure reduction valve 244. One difference is that, in the valve 246, the fluid ports analogous to the fluid ports 477 and 479 of the valve 244 are in fluid communication with the chambers 260 and 206, respectively.

Shaft Configuration and Manufacturing Process

With reference to FIG. 2, a process for manufacturing the shafts 118 and 124 of the tractor 100 is herein described.

As explained above in the Background section, prior art shafts designed for downhole tools used in drilling and intervention applications have been formed from more flexible materials, such as copper beryllium (CuBe), in order to facilitate turning at sharper angles in the bore of a well. Due to the various constraints of CuBe and other materials, prior art individually gun-drilled shaft portions have been attached to one another by electron beam welding, a very expensive process. The geometry of prior art shafts (e.g., larger internal passages necessitated by drilling mud) and the constraints of softer materials like CuBe have limited the possible length of gun-drilled passages and required a relatively large number of gun-drilled shaft portions.

In one aspect, the present invention provides a shaft design and manufacturing method for a tractor to be used primarily for intervention. In contrast to drilling, intervention applications are typically undertaken in cased boreholes and do not require the ability to negotiate sharp turns. In contrast to drilling tools, which typically use drilling mud having larger solid particles, an intervention tractor can use an operating fluid such as clean brine, and thus does not require as large an internal flow passage for fluid to the downhole equipment and valve system. Accordingly, a preferred embodiment of a tractor of the present invention includes a shaft with a relatively smaller internal flow passage for fluid to the downhole equipment and valve system. Also, the shaft is preferably formed from a stronger, more rigid material. The combination of a smaller diameter flow passage, which leaves more space for gun-drilled passages, and a stronger material of the shaft makes it possible to gun-drill longer passages. This in turn allows for fewer shaft portions. In a preferred embodiment of the invention, each shaft 118 and 124 (FIG. 2) includes only two shaft portions and an end flange.

Figure 14:
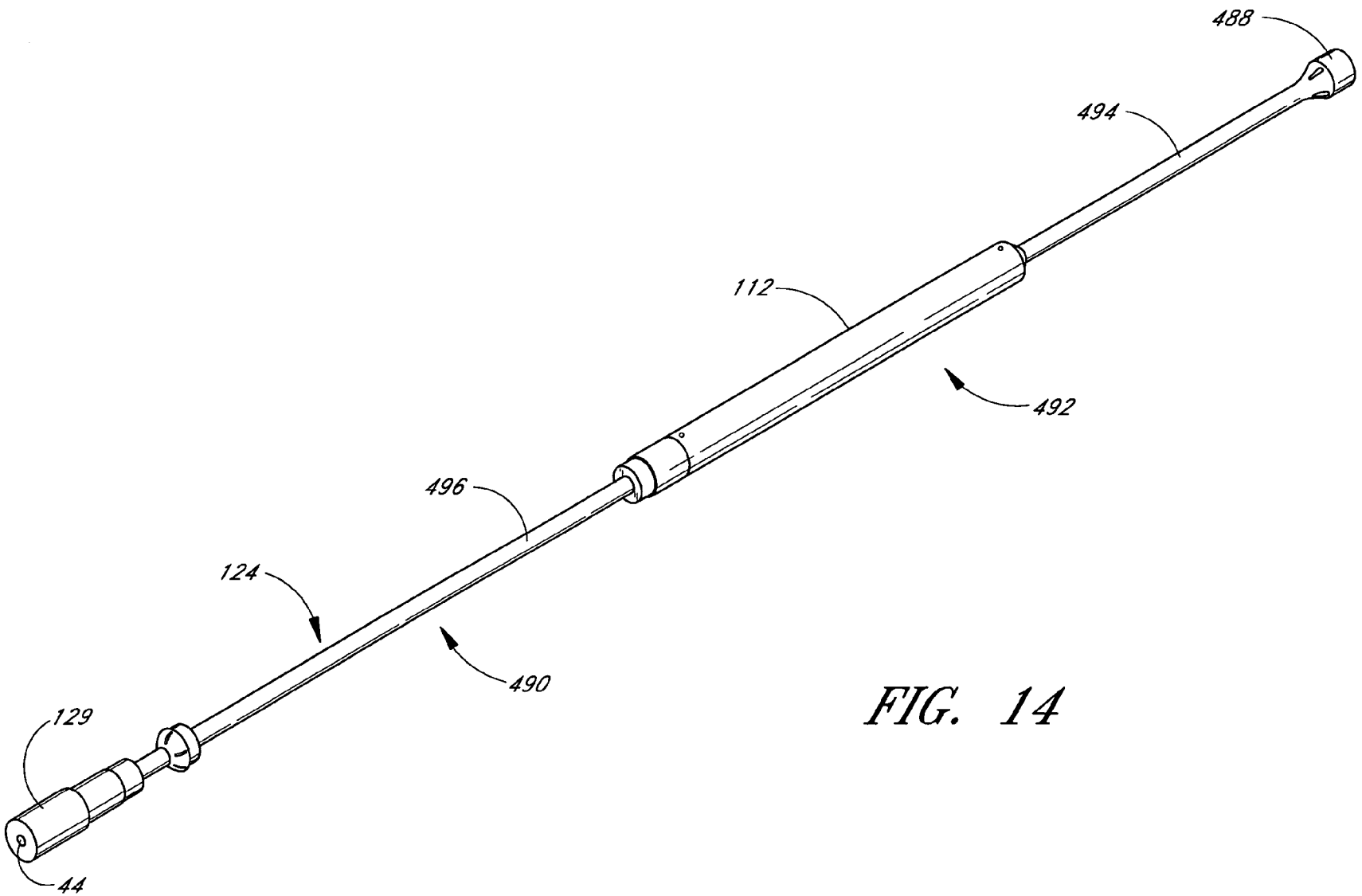
FIG. 14 is a perspective view of a forward shaft assembly a tractor according to one embodiment of the invention, with the gripper assembly not shown for clarity.

FIG. 14 shows a preferred embodiment of the forward shaft 124 of the tractor of the invention. In this embodiment, the tractor includes only a single forward propulsion cylinder 112 enclosing a single piston. The forward gripper assembly is not shown for clarity, but would typically be located generally at position 490. Attached to the forward end of the shaft 124 is a tool joint assembly 129 for attachment to downhole equipment. The assembly 129 includes an internal bore for the passage 44 for operating fluid to the downhole equipment. The aft end of the shaft 124 is welded to a flange 488 for connection to the forward end of the control assembly 102 (FIG. 2). The shaft 124 preferably includes a first shaft portion 494 and a second shaft portion 496. The shaft portions are preferably brazed together, as described below. The braze joint is located, for example, at about the position 492. The braze joint is enclosed by the cylinder 112.

Figure 15:
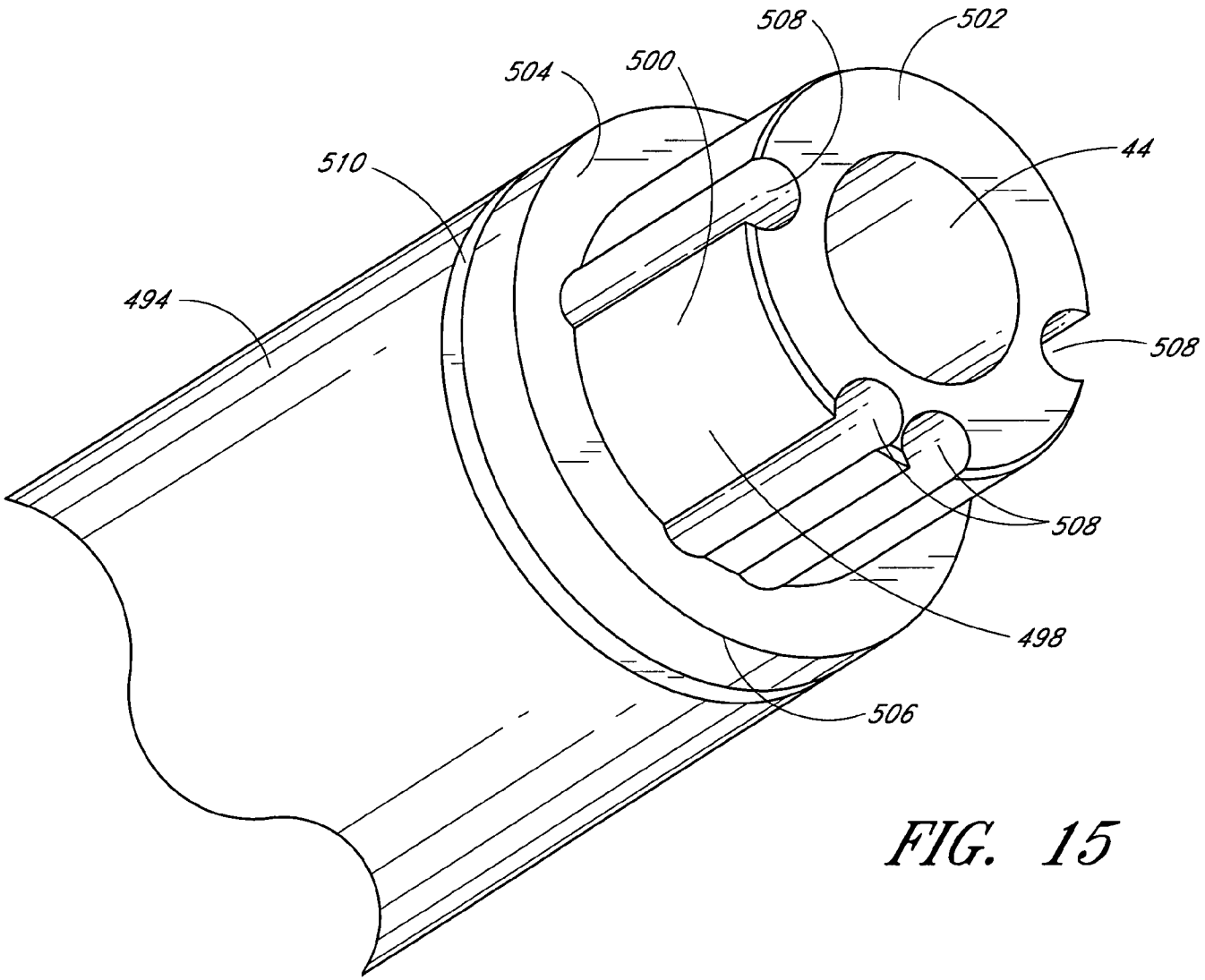
FIG. 15 is a perspective view of a male braze joint of a shaft portion of the shaft of FIG. 14.

FIG. 15 shows the forward end of a preferred embodiment of the first shaft portion 494 of FIG. 14. Preferably, the end surfaces of the first shaft portion 494 and the second shaft portion 496 are configured to mate with each other. The illustrated forward end of the first shaft portion 494 comprises a male connection, while a conforming aft end of the second shaft portion 496 is female. The shaft portion 494 includes an elongated end portion 498 having a reduced width (which may include non-circular configurations) or diameter (for circular configurations). The portion 498 has a peripheral surface 500 and an end surface 502, and is preferably about one inch long. A connecting annular surface 504 is formed between the end portion 498 and the remainder of the shaft portion 494. In the illustrated embodiment, the end surface 502 and the connecting surface 504 are generally flat and perpendicular to the longitudinal axis of the first shaft portion 494. However, other configurations are possible, such as tapered surfaces.

A "mating surface" of the first shaft portion 494 comprises the surfaces 502, 500, and 504. The second shaft portion 494 preferably has a "mating surface" that mates with that of the first shaft portion 494. Other mating surface configurations are possible, giving due consideration to the goal of forming a strong joint that is capable of withstanding combined tensile, shear, and bending loads experienced downhole. At the outside diameter of the shaft portion 494, an edge 506 is formed between the connecting surface 504 and the remainder of the shaft portion 494. The illustrated edge 506 is circular and forms an outer interface between the first and second shaft portions when they are attached together. Bores 508 form fluid passages within the shaft portion 494 (for the flow to the gripper assemblies and propulsion chambers), while a larger center bore forms the main passage 44 (FIG. 3). In the illustrated embodiment, the outside diameter of the end portion 498 interrupts the passages.

Preferably, a stress-relief groove 510 is formed proximate the mating surface of the first shaft portion 494. The groove 510 provides a stress concentration point to reduce the stresses felt at the outside diameter of the joint between the first and second shaft portions. Thus, the groove 510 further reduces the risk of failure at the joint by taking the stress away from the outside diameter of the shaft, where stresses are typically at a maximum. Preferably, the groove 510 extends along the entire or substantially the entire circumference of the outer diameter of the shaft portion 494. The groove 510 is preferably circular. The longitudinal position, as well as the width and depth, of the groove 510 can vary, keeping in mind the goal of pulling stress away from the outermost edge of the brazed connection. The groove 510 is desirably positioned within 0.060 inches of the edge 506. Preferably, the groove 510 has a width between 0.080 and 0.120 inches, and a depth between 0.050 and 0.060 inches.

In the preferred embodiment, the mating surfaces of the first and second shaft portions are silver brazed together. The silver braze connection is formed by placing a brazing shim on the end surface 502 and then mating together the mating surfaces of the first and second shaft portions. The connected shafts are then heated to melt the brazing shim. The brazing shim contains silver alloy which, when melted, flows along the mating surfaces of the shaft portions by capillary action. Advantageously, the silver generally does not flow into the bores 508 or the passage 44—it remains substantially along the mating surfaces. Since the heat will normally be applied from the exterior surfaces of the shaft portions, the surface 502 will be heated last. Thus, the surfaces 500 and 504 will be slightly hotter than the surface 502. This ensures that when the brazing shim melts at the surface 502 it will flow to the warmer surfaces 500 and 504 and remain in liquid form to effect a better connection. The emergence of excess silver at the external interface 506 signals that the silver has fused completely through the mating surfaces. Preferably, the shaft portions 494 and 496 are formed from stainless steel, such as 17-4PH steel, a high-strength corrosion-resistant steel that is readily brazed. Furthermore, in the H-1150 condition, the strength is sufficient and is not significantly affected by the silver braze process. In experimental testing, silver braze joints of the illustrated configuration have withstood multiply administered tension loads greater than 100,000 pounds.

Figure 16:
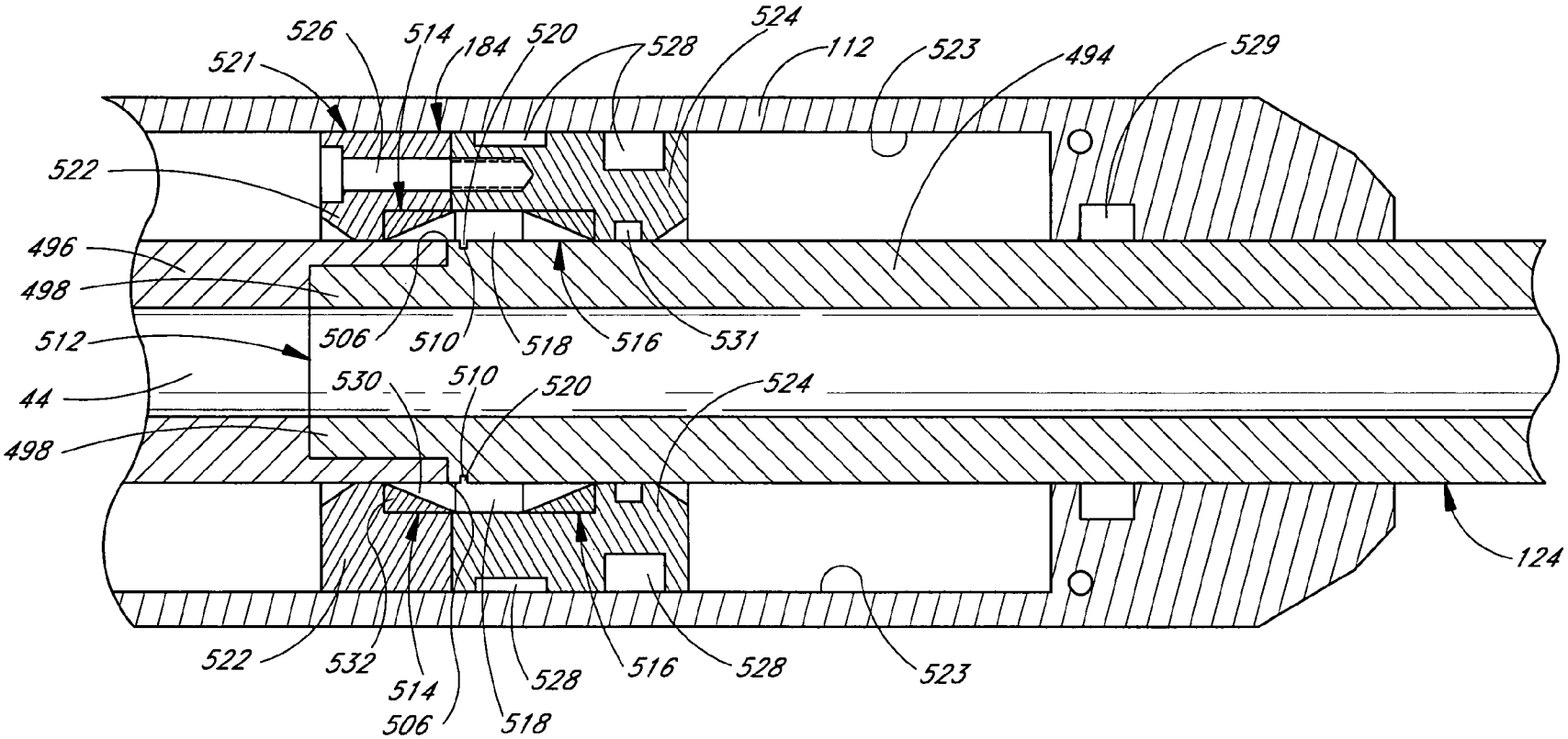
FIG. 16 is a longitudinal sectional view of a braze joint of the shaft of FIG. 14, as well as a connection of a preferred embodiment of a piston to the shaft.

FIG. 16 is a longitudinal sectional view of the braze joint of the shaft 124 of FIG. 14. Preferably, the piston 184 is fitted over the interface 506 between the first and second shaft portions 494 and 496. Advantageously, the piston 184 provides additional strength to the joint, reducing the risk of failure. FIG. 16 also illustrates a preferred embodiment of a piston 184, which comprises two ring-shaped compression clamps 514 and 516, a spacer ring 518, and a locking assembly 521. The compression clamps 514 and 516 each apply a radial inward compression force onto the shaft 124. The compression clamps rigidly lock onto the shaft and, along with the spacer ring 518 described below, provide the majority of the piston's resistance to moving with respect to the shaft 124. In the illustrated embodiment, each compression clamp comprises a pair of ring-shaped clamp members with tapered annular surfaces that interact with one another to produce the compression force. For example, the clamp 514 includes an inner clamp member 530 and an outer clamp member 532. The members 530 and 532 have inclined annular surfaces that mate with one another. As the members 530 and 532 are forced axially together with respect to the shaft axis, the axial force is converted into a radial inward compression force that locks the compression clamp 514 onto the shaft. The compression clamp 516 is preferably configured substantially similarly to the compression clamp 514. In a preferred embodiment, the clamps 514 and 516 comprise Ringfeder® clamps, available from Ringfeder Corporation of Westwood, N.J., U.S.A.

The spacer ring 518 is not a necessary element of the illustrated piston 184. However, the spacer ring advantageously provides additional resistance to axial movement or sliding of the compression clamps 514 and 516 with respect to the shaft 124. The spacer ring, preferably a two-piece part to facilitate installation, includes an annular lip 520 on its inner surface. The lip 520 is sized and adapted to fit within the stress-relief groove 510 of the first shaft portion 494 of the shaft. The reception of the lip 520 within the groove 510 resists axial sliding of the spacer ring 518, and thus of the entire piston 184, with respect to the shaft 124. Another advantage of the groove 510 and the spacer ring 518 is that the groove provides a convenient method for locating and properly positioning the piston 184 during assembly of the shaft 124.

The locking assembly 521 imparts an axial compression force onto each pair of clamp members of the compression clamps 514 and 516. The clamps 514 and 516 convert the axial compression force of the locking assembly 521 into the aforementioned radial inward compression force onto the shaft 124. In the illustrated embodiment, the locking assembly 521 comprises a pair of ring-shaped locking members 522 and 524, which are clamped axially together by one or more bolts 526 extending through holes in the member 522 and into threaded holes in the member 524. As the locking members 522 and 524 are clamped together, they increase the radial compression force of the compression clamps 514 and 516. The locking assembly 521 also comprises a majority of the volume of the piston 184. Preferably, the locking assembly 521 extends radially to the inner surface 523 of the propulsion cylinder 112. Seals 528 are provided within recesses in the peripheral surface of the locking member 524. The seals 528 effect a fluid seal between the piston 184 and the inner surface 523 of the cylinder 112. Also, at least one seal 531 is provided between the piston 184 and the shaft 124. The seals 528 and 531 may comprise O-ring type or lip type seals. It will be understood that seals can alternatively or additionally be positioned within recesses in the peripheral surface of the locking member 522. Seals 529 are also provided within recesses at the ends of the cylinder 112 adjacent the shaft 124 to prevent leakage of fluid from within the cylinder to the annulus 40. The aforementioned Ringfeder Corporation sells locking assemblies. However, in the preferred embodiment, the locking assembly 521 is custom sized and shaped.

It will be understood that each of the shafts 118 and 124 (FIG. 2) may comprise any number of shaft portions silver brazed together, preferably configured as shown in FIGS. 15 and 16. Also, some or all of the joints can be strengthened by positioning the pistons so as to enclose the interfaces of the joints, as shown in FIG. 16. Also, some or all of the pistons of the shafts can comprise compression clamps (preferably with spacer rings) and locking assemblies, as shown in FIG. 16.

Hydraulically Controlled Reverser Valve

Figure 17:
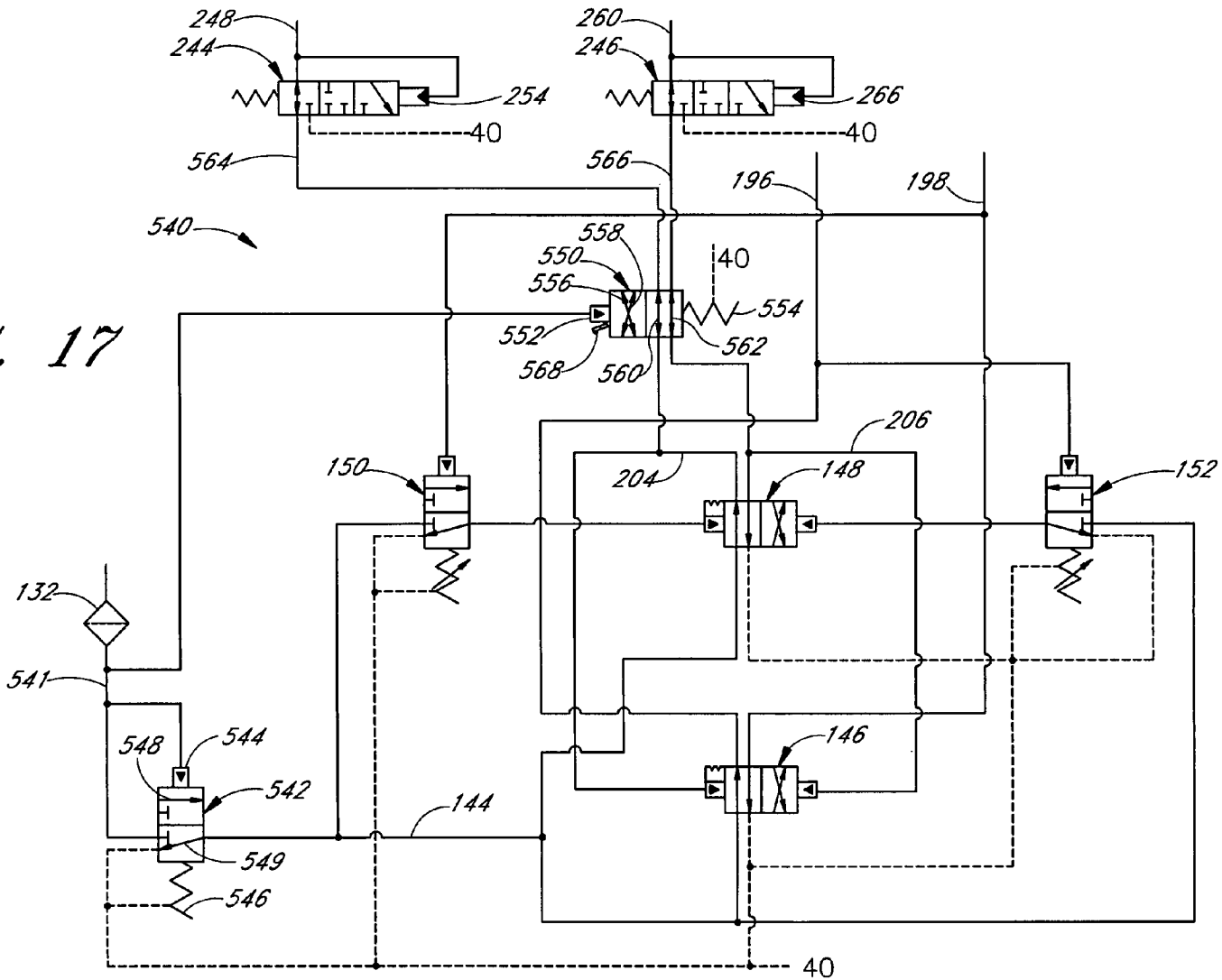
FIG. 17 is a schematic diagram illustrating a valve system according to an alternative embodiment of a tractor of the invention, which includes a hydraulically controlled reverser valve that toggles in response to a pressure spike to permit the tractor to power out of a borehole.

FIG. 17 illustrates a valve system 540 for a tractor according to an alternative embodiment of the invention. As explained below, the valve system 540 permits the direction of travel of the tractor to be controlled. With the exception of a number of modifications discussed below, the valve system 540 is configured substantially similarly to the valve system 133 shown in FIG. 3. Elements of the valve system 540 are labeled with the reference numbers of analogous elements of the valve system 133. The valve system 540 includes a propulsion control valve 146, gripper control valve 148, aft cycle valve 150, forward cycle valve 152, aft pressure reduction valve 244, and forward pressure reduction valve 246, all configured similarly to corresponding elements of the valve system 133. However, the inlet galley 541 and the inlet control valve 542 of the valve system 540 are configured differently than the inlet galley 134 and inlet control valve 136 of the valve system 133. The valve system 540 also includes a hydraulically controlled reverser valve 550, as well as fluid chambers 564 and 566, described below.

The inlet galley 541 of the valve system 540 extends to the inlet control valve 542 and the reverser valve 550. The inlet control valve 542 preferably comprises a spool valve. The valve spool has a first position (shown in FIG. 17) in which fluid is prevented from entering the remainder of the valve system 540, and a second position (shifted vertically downward in FIG. 17) in which fluid does enter the remainder of the valve system. In the first position of the spool, the valve 542 provides a flow path (represented by arrow 549) for fluid within the main galley 144 to flow into the annulus 40. In the first position of the spool, fluid within the inlet galley 541 is prevented from flowing through the valve 542 into the main galley 144. In the second position of the spool, the valve 542 provides a flow path (represented by arrow 548) for fluid within the inlet galley 541 to flow into the main galley 144. In the second position of the spool, fluid within the main galley 144 is prevented from flowing through the valve 542 into the annulus 40.

The inlet control valve 542 is piloted by the fluid pressure within the inlet galley 541. The spool has a surface 544 exposed to fluid within the inlet galley 541. At least one spring 546 biases the spool in a direction opposite to the fluid pressure force received by the surface 544. In this respect, the operation of the valve 542 is effectively similar to that of the cycle valves 150 and 152 and the pressure reduction valves 244 and 246. The valve spool of the valve 542 moves to its second position when the pressure in the inlet galley 541 exceeds a threshold determined by the characteristics of the at least one spring 546. Thus, the valve 542 effectively has an "off" position (as shown in FIG. 17) and an "on" position (shifted vertically downward in FIG. 17).

The reverser valve 550 controls the direction that the tractor travels within the passage or borehole. The valve 550 permits the sequence of operations for forward motion of the tractor (to the right in FIG. 13) to be modified so that the actuation and retraction of the gripper assemblies are reversed. During the operational cycle of the valves associated with forward motion of the tractor (described above), fluid is distributed to and from the gripper assemblies and to and from the chambers of the propulsion cylinders according to a specific sequence. At certain stages of the sequence, the aft gripper assembly is actuated and the forward gripper assembly is retracted. At other stages of the sequence, the aft gripper assembly is retracted and the forward gripper assembly is actuated. If this operational sequence is modified so that each gripper assembly is actuated during stages when it was previously retracted, and so that each gripper assembly is retracted during stages when it was previously actuated, the tractor will travel backward (to the left in FIG. 13). The reverser valve 550 accomplishes this task.

In the illustrated embodiment, the reverser valve 550 communicates with the chambers 204 and 206. Unlike in the valve system 133, the chambers 204 and 206 do not extend to the pressure reduction valves. The reverser valve 550 also communicates with the chambers 564 and 566. The chamber 564 extends from the valve 550 to the aft pressure reduction valve 244. The chamber 566 extends from the valve 550 to the forward pressure reduction valve 246. The valves 244 and 246 communicate with the chambers 564 and 566, respectively, in the same manner that the valves 244 and 246 communicate with the chambers 204 and 206 in the valve system 133 (FIG. 13).

In the preferred embodiment, the reverser valve 550 comprises a two-position spool valve. The valve spool has a first position (shown in FIG. 17) in which the tractor travels forward, and a second position (shifted to the right in FIG. 17) in which the tractor travels backward. In the first position of the spool, the valve 550 provides a flow path (represented by arrow 560) for fluid within the chamber 206 to flow into the chamber 564. In the first position of the spool, the valve 550 also provides a flow path (represented by arrow 562) for fluid within the chamber 566 to flow into the chamber 206. In the second position of the spool, the valve 550 provides a flow path (represented by arrow 558) for fluid within the chamber 204 to flow into the chamber 566. In the second position of the spool, the valve 550 also provides a flow path (represented by arrow 556) for fluid within the chamber 564 to flow into the chamber 206.

In the illustrated embodiment, the fluid pressure in the inlet galley 541 controls the position of the spool of the reverser valve 550. The spool has a surface 552 exposed to the fluid from the inlet galley 541. The surface 552 receives a pressure force that tends to move the spool to its second position. At least one spring 554 biases the spool toward its first position and opposes the pressure force on the surface 552. Thus, the spool shifts to its second position, to effect backward travel of the tractor, when the fluid within the inlet galley 541 exceeds a shifting threshold pressure determined by the characteristics of the at least one spring 554. Preferably, the shifting threshold pressure (e.g., 2000 psid) required to move the spool of the reverser valve 550 to its second position is greater than the threshold pressure (e.g., 800 psid) required to move the spool of the inlet control valve 542 to its second position. The skilled artisan will understand that the greater the variance between these threshold pressures, the easier it will be to open the inlet control valve 542 (i.e., to move the spool to its second position) without inadvertently reversing the direction of tractor motion.

In the preferred embodiment, the reverser valve 550 includes a locking feature, schematically represented by a latch 568, which locks the spool in its second (or first) position. Preferably, the locking feature comprises a cam such as the deactivation cam 368 (FIGS. 5–8) described above. In this embodiment, in order to shift and lock the spool within its second (or first) position, it is necessary to increase the pressure in the inlet galley 541 above the upper cam-activation threshold of the cam (e.g., 2000 psid). In order to unlock the spool, it is necessary to (1) reduce the pressure below the lower cam-activation threshold of the cam (e.g., 1000 psid), (2) increase the pressure back above the upper cam-activation threshold, and (3) reduce the pressure below the shifting threshold of the valve 550. Refer to the discussion of the deactivation cam 368 above.

Thus, the illustrated reverser valve 550 provides a convenient means for reversing the direction of the tractor, while preserving an all-hydraulic design for the valve system of the tractor.

An alternative embodiment of a tractor of the invention includes a hydraulically controlled reverser valve configured to be actuated only once. When the reverser valve is actuated, the tractor will walk backward out of the passage or borehole. A preferred configuration of the valve system of this embodiment is herein described with reference to FIG. 17. The valve system is substantially identical to that shown in FIG. 17, with the following exceptions. First, the reverser valve 550 is modified so that the toggle feature 568 and the spring 554 are removed. Second, a burst disc or rupture disc device is provided in the pilot line that extends from the inlet galley 541 to the end surface 552 of the spool of the reverser valve 550. The burst disc is configured to burst or open when the pressure in the inlet galley 541 reaches a burst pressure of the disc.

It will be understood that this configuration is useful if the tractor gets stuck in the borehole or if any downhole equipment of the BHA needs assistance in being removed, the reverser valve can be actuated. In this configuration, the tractor will normally be inserted into a borehole with the reverser valve 550 in its first position (the position shown in FIG. 17). The burst disc prevents fluid within the inlet galley 541 from exerting a pressure force on the spool of the valve 550. When it is desirable to reverse the direction of tractor motion, the pressure in the inlet galley 541 can be increased to the burst pressure of the burst disc. The burst disc will then burst or open to allow the fluid pressure within the inlet galley to move the spool of the valve 550 to its second position (shifted to the right in FIG. 17). Since the spring 554 is removed from this design, the valve 550 will not change its position. Optionally, stops or detents can be provided to prevent inadvertent shifting of the spool, such as the stops 434, 436 illustrated in FIG. 10. The burst pressure of the burst disc is preferably between 2500 and 7000 psid, and more preferably about 3200 psid. Preferably, the burst pressure of the disc is greater than the shifting threshold of the inlet control valve 542.

Electrically Controlled Reverser Valve

Figure 18:
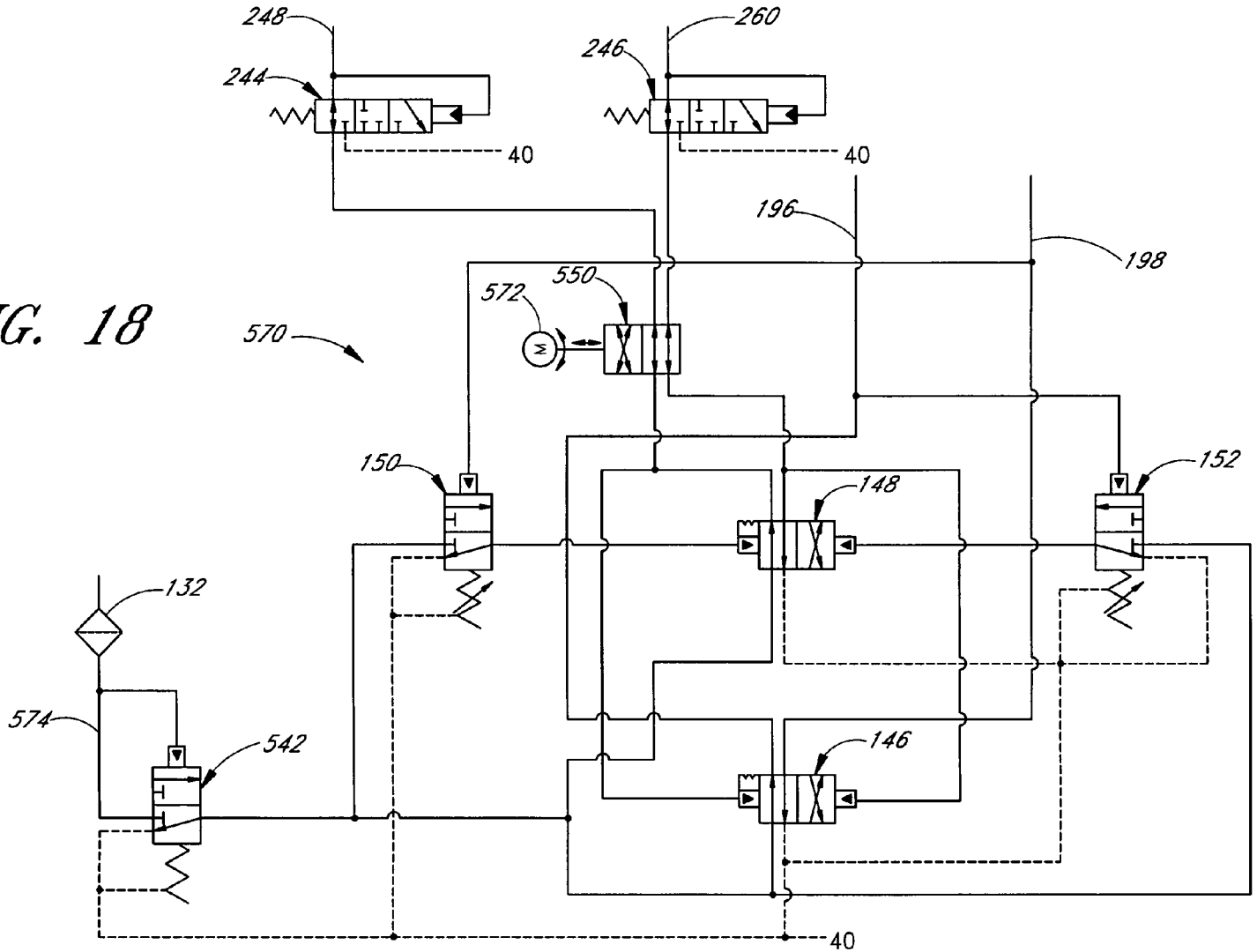
FIG. 18 is a schematic diagram illustrating a valve system according to another alternative embodiment of a tractor of the invention, which includes an electrically controlled reverser valve.

FIG. 18 illustrates a valve system 570 for a tractor according to another alternative embodiment of the invention. Like the valve system 540 of FIG. 17, the valve system 570 permits the direction of travel of the tractor to be controlled. With the exception of a number of modifications discussed below, the valve system 570 is configured substantially similarly to the valve system 540. Elements of the valve system 570 are labeled with the reference numbers of analogous elements of the valve system 540. However, the inlet galley 574 of the valve system 570 is different than the inlet galley 541 of the valve system 540. Also, the reverser valve 550 is controlled differently.

The inlet galley 574 of the valve system 570 does not extend to the reverser valve, as in the valve system 540. This is because the reverser valve 550 of the system 570 is not piloted by fluid pressure. Instead, a motor 572 controls the position of the spool of the reverser valve. In a preferred configuration, the output shaft of the motor 572 is coupled to a leadscrew, and a traversing nut is threadingly engaged with the leadscrew. The nut is coupled to the spool of the reverser valve 550, preferably via a flexible stem. As the leadscrew rotates with the motor output, the nut traverses the leadscrew and thereby moves the spool. The position of the spool can be controlled by controlling the amount of rotation of the motor output shaft. An assembly for controlling the position of a valve spool with a motor, within a tractor, is illustrated and described in U.S. Pat. No. 6,347,674.

Preferably, the motor 572 is controlled by electronic signals sent from a remote location (such as from ground surface equipment) or even from a programmable logic controller on the tractor itself.

It will be understood that the position of the spool of the reverser valve 550 can alternatively be controlled via solenoids or other electronic means.

Electrical Control of Fluid Entry

Figure 19:
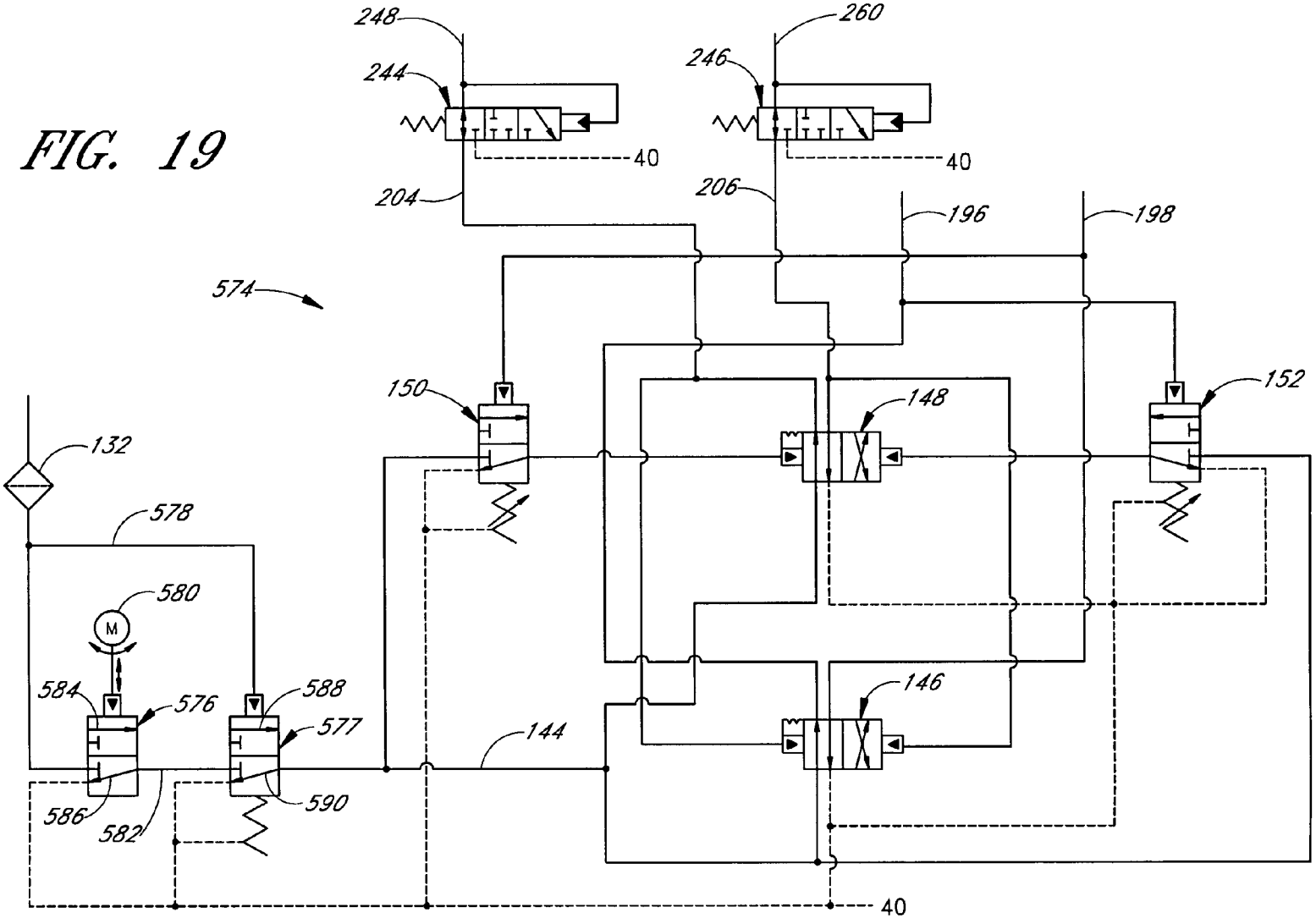
FIG. 19 is a schematic diagram illustrating a valve system according to yet another alternative embodiment of a tractor of the invention, which includes a pair of inlet control valves, one hydraulically controlled and the other electrically controlled to provide electric starting or stopping of the tractor.

FIG. 19 illustrates a valve system 574 for a tractor according to yet another alternative embodiment of the invention. As explained below, the valve system 574 provides electronic control of whether the tractor is "on" or "off." With the exception of a number of modifications discussed below, the valve system 574 is configured substantially similarly to the valve system 133 shown in FIG. 3. Elements of the valve system 574 are labeled with the reference numbers of analogous elements of the valve system 133.

The valve system 574 includes an inlet galley 578, a pair of inlet control valves 576 and 577, and a fluid chamber 582. The inlet galley 578 extends to both of the valves 576 and 577. The chamber 582 extends between the valves 576 and 577. Preferably, the valve 576 comprises a spool valve. The valve 576 is controlled by a motor 580, and can be configured similarly to the reverser valve 550 of the valve system 570 (FIG. 18). It will be understood that the position of the spool can alternatively be controlled via solenoids or other electronic means. The spool of the valve 576 has a first "closed" position (shown in FIG. 19) in which the valve 576 provides a flow path (represented by arrow 586) for fluid within the chamber 582 to flow into the annulus 40, and in which fluid within the inlet galley 578 is prevented from flowing through the valve 576 into the chamber 582. The spool of the valve 576 also has a second "open" position (shifted vertically downward in FIG. 19) in which the valve 576 provides a flow path (represented by arrow 584) for fluid within the inlet galley 578 to flow into the chamber 582, and in which fluid within the chamber 582 is prevented from flowing through the valve 576 into the annulus 40.

The valve 577 preferably comprises a spool valve and is preferably configured substantially similarly to the valves 542 of FIGS. 17 and 18. The spool of the valve 577 has a first "closed" position (shown in FIG. 19) in which the valve 577 provides a flow path (represented by arrow 590) for fluid within the main galley 144 to flow into the annulus 40, and in which fluid within the chamber 582 is prevented from flowing into the main galley 144. The spool of the valve 577 also has a second "open" position (shifted vertically downward in FIG. 19) in which the valve 577 provides a flow path (represented by arrow 588) for fluid within the chamber 582 to flow into the main galley 144, and in which fluid within the main galley 144 is prevented from flowing through the valve 577 into the annulus 40.

The pair of inlet control valves 576 and 577 operate to control the flow of fluid into the remainder of the valve system 574. The hydraulically controlled valve 577 shifts to its "open" position only when the fluid in the inlet galley 578 exceeds the threshold pressure associated with the valve 577. Regardless of the position of the valve 576, when the valve 577 is closed the fluid within the main galley 144 flows through the valve 577 into the annulus 40. Thus, when the pressure in the inlet galley 578 is below the threshold associated with the valve 577, the tractor is "off." In other words, the valve 577 is a failsafe valve to deactivate the tractor in case of control system failure. The electrically controlled valve 576 provides additional control. When the valve 576 is closed, the tractor is "off," regardless of the position of the valve 577. Even if the valve 577 is open when the valve 576 is closed, fluid within the main galley 144 flows through the valve 577, the chamber 582, the valve 576, and into the annulus 40. The tractor is "on" only when both the valves 576 and 577 are open. In such a condition, fluid within the inlet galley 578 flows through the valve 576, the chamber 58, the valve 577, and into the main galley 144. Thus, fluid flows into the remainder of the valve system 574 only when (1) the pressure in the inlet galley 578 exceeds the threshold associated with the valve 577 and (2) the valve 576 is shuttled to its "open" position.

Electrical Control of Fluid Entry and Reverse Motion

Figure 20:
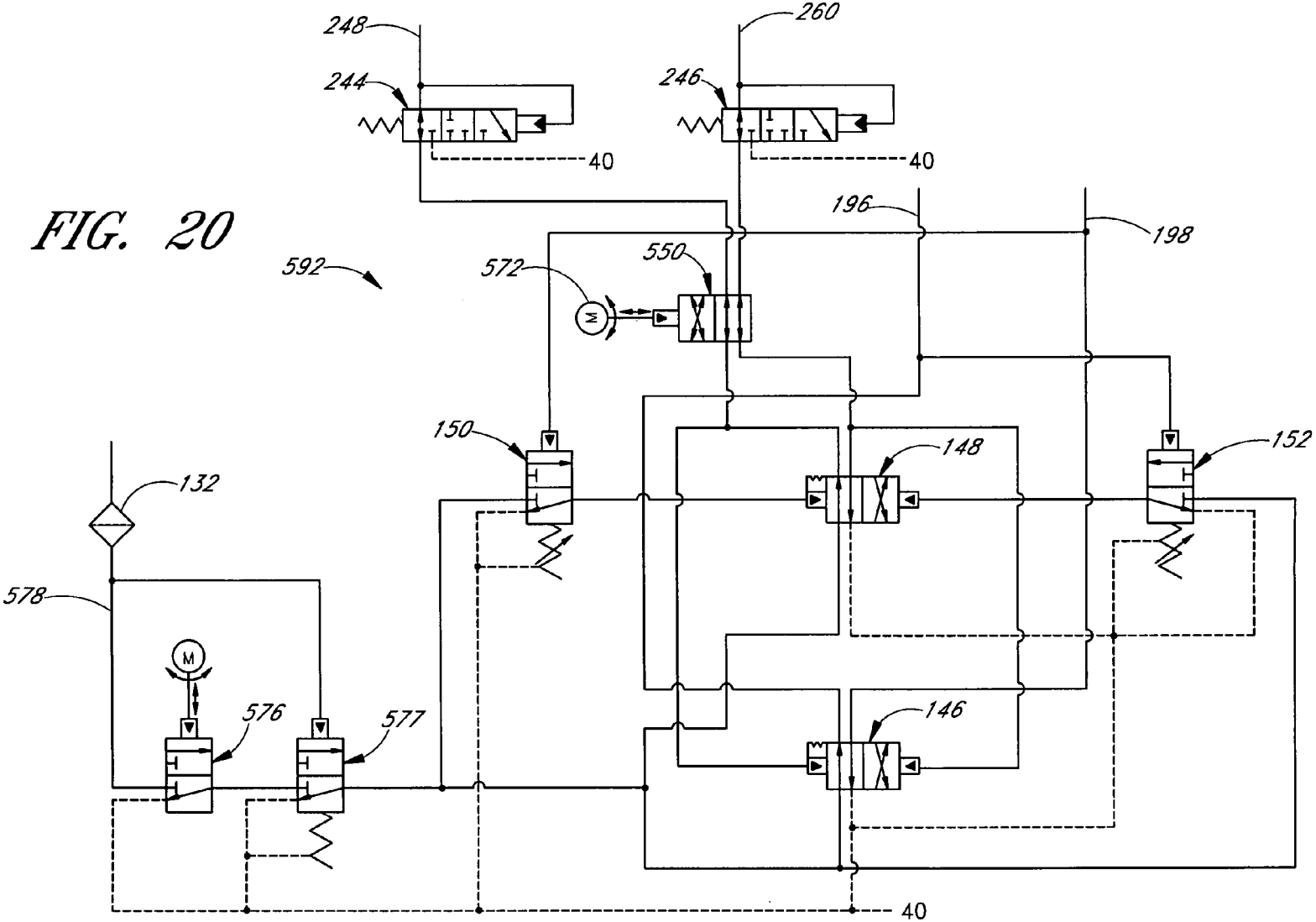
FIG. 20 is a schematic diagram illustrating a valve system according to yet another alternative embodiment of a tractor of the invention, which includes both the pair of inlet control valves of the valve system of FIG. 19 and the electrically controlled reverser valve of the valve system of FIG. 18.

FIG. 20 illustrates a valve system 592 for a tractor according to yet another alternative embodiment of the invention. The valve system 592 comprises a combination of the valve systems 570 (FIG. 18) and 574 (FIG. 19). The valve system 592 includes a pair of inlet control valves 576 and 577, configured similarly to analogous valves of the valve system 570. In particular, the valve 576 is electrically controlled and the valve 577 is hydraulically controlled. The valve system 592 also includes an electrically controlled reverser valve 550, configured similarly to the analogous valve of the valve system 574. Thus, the valve system 592 permits electrical control of (1) the on/off state of the tractor and (2) the direction of tractor motion.

Gripper Assemblies

As mentioned above, the gripper assemblies 104 and 106 are preferably configured in accordance with a design illustrated and described in a U.S. patent application Ser. No. 10/004,963, entitled "GRIPPER ASSEMBLY FOR DOWNHOLE TRACTORS," filed on Dec. 3, 2001. FIGS. 21–34 illustrate a preferred configuration of such a gripper assembly. Below is a brief description of the configuration and operation of the illustrated gripper assembly. For a more detailed description, please refer to the above-referenced application.

Figure 21:
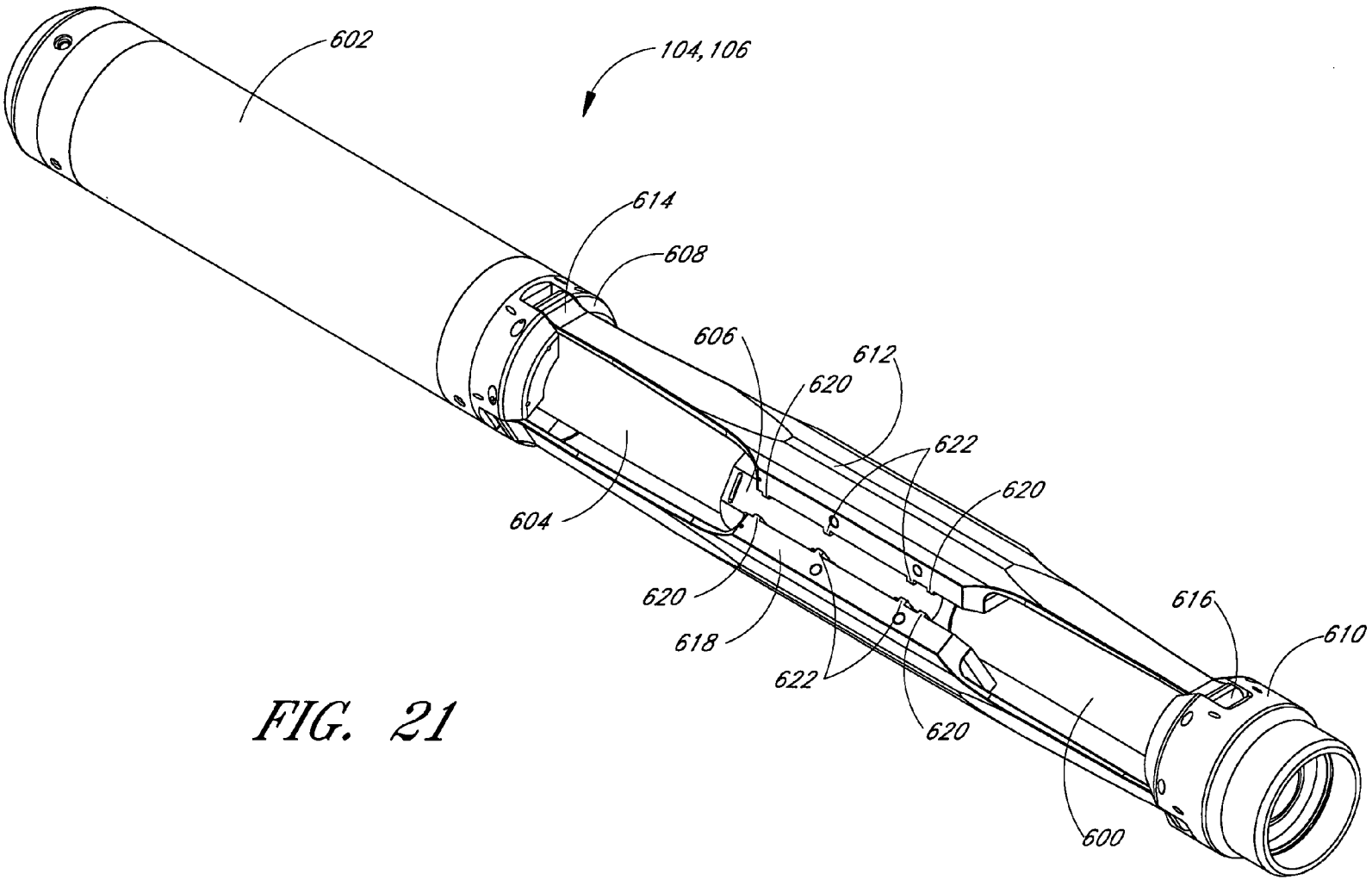
FIG. 21 is a perspective view of a preferred embodiment of a gripper assembly having flexible toes with rollers.
Figure 25:
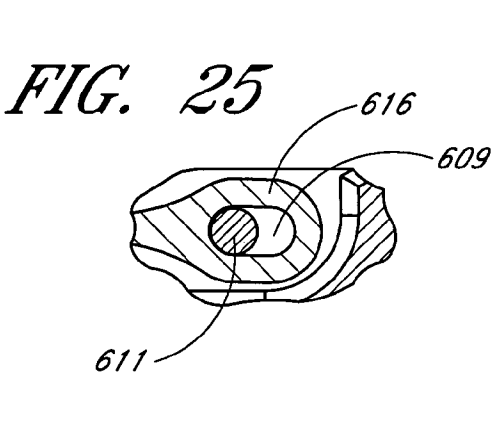
FIG. 25 is an exploded view of the forward end of the toe shown in FIG. 22.

In a preferred embodiment, the gripper assemblies 104 and 106 are substantially identical. Thus, the gripper assembly configuration shown in FIGS. 21–34 describes both assemblies 104 and 106. In FIG. 21, the gripper assembly is shown with its aft end on the left and its forward end on the right. The gripper assembly includes an elongated mandrel 600, a cylinder 602 engaged on the mandrel, toe supports 608 and 610, a tubular piston rod 604, a slider element 606, and three flexible toes or beams 612. The mandrel 600 surrounds and is free to slide longitudinally with respect to the shafts 118 and 124 (FIG. 2) of the tractor. When used for non-drilling applications, the mandrel 600 is preferably also free to rotate with respect to the shafts (i.e., there are no splines that prevent rotation). This is because it is generally not necessary to transmit torque to the borehole wall for non-drilling applications. The ends 614 and 616 of the toes 612 are pivotally secured to the toe supports 608 and 610, respectively. The cylinder 602 and the toe support 608 are fixed with respect to the mandrel 600, while the toe support 610 is free to slide longitudinally along the mandrel. The piston rod 604 and the slider element 606 are fixed with respect to each other and are together slidably engaged on the mandrel 600. The cylinder 602 encloses an annular piston (not shown) that is fixed with respect to the piston rod 604 and slider element 606 and also slidably engaged on the mandrel 600. The piston is biased in the aft direction by a return spring (not shown) that is also enclosed within the cylinder 602.

With reference to FIGS. 21–25, the central region of each toe 612 has a recess 624 (FIG. 24) formed in the inner radial surface of the toe. The recess 624 is formed between two axial sidewalls 618 of the toe 612. The recess 624 includes two rollers 626 on axles 628 secured within the sidewalls 618. The slider element 606 includes three pairs of ramps 630, each pair aligned with one of the toes 612. The ramps 630 are radially interior of the toes 612. As the slider element 606 slides forward, each roller 626 rolls up one of the ramps 630, causing the central regions of the toes 612 to bend radially outward to grip onto a borehole surface. As the slider element 606 slides aftward, the rollers 626 roll down the ramps 630, causing the toes 612 to relax back to the position shown in FIGS. 21 and 22.

The gripper assembly is actuated by pressurized operating fluid supplied to the cylinder 602, on the aft side of the enclosed piston. The pressurized fluid causes the piston, piston rod 604, and the slider element 606 to slide forward against the force of the return spring. As explained above, this causes the rollers 626 to roll up the ramps 630 and deflect the toes 612 radially outward. The toe support 610 freely slides aftward to accommodate the deflection of the toes 612. The gripper assembly is retracted by reducing the pressure aft of the piston, which causes the return spring to push the piston, piston rod 604, and slider element 606 aftward. The rollers 626 roll down the ramps 630, allowing the toes 612 to relax.

Figure 24:
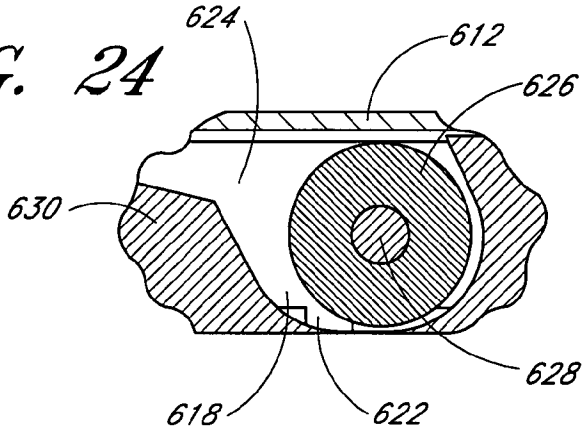
FIG. 24 is an exploded view of one of the rollers of the toe shown in FIG. 22.
Figure 23:
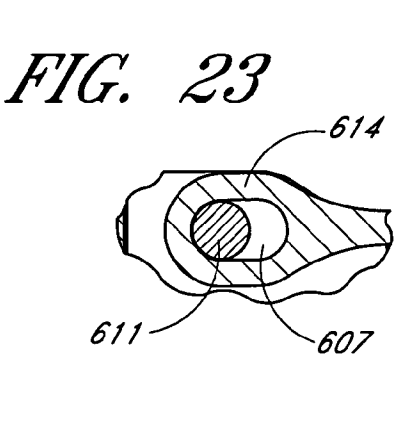
FIG. 23 is an exploded view of the aft end of the toe shown in FIG. 22.
Figure 22:
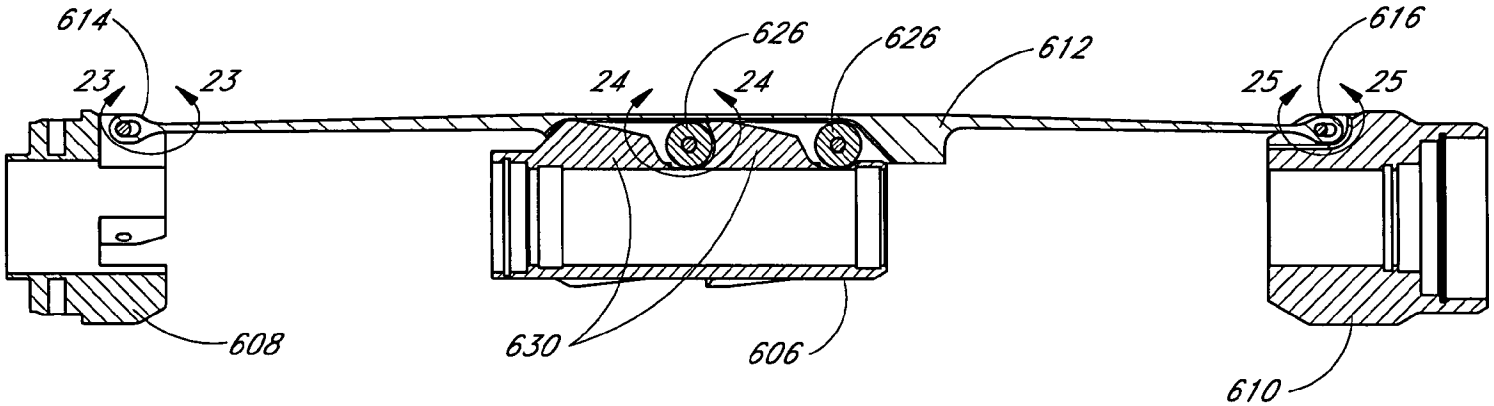
FIG. 22 is a longitudinal sectional view of the toe supports, slider element, and a single toe of the gripper assembly of FIG. 21, shown at a moment when there is substantially no external load applied to the toe.
Figure 29:
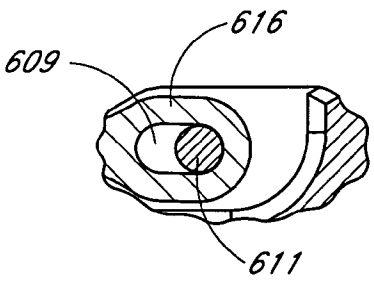
FIG. 29 is an exploded view of the forward end of the toe shown in FIG. 26.
Figure 28:
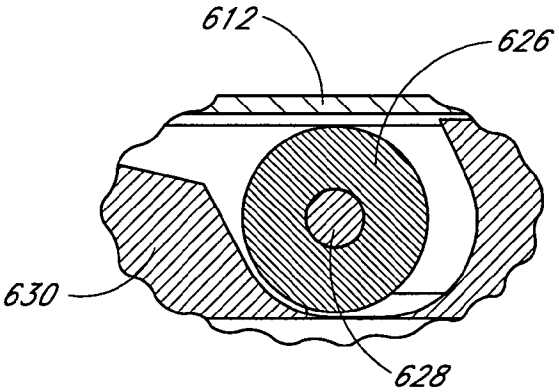
FIG. 28 is an exploded view of one of the rollers of the toe shown in FIG. 26.
Figure 27:
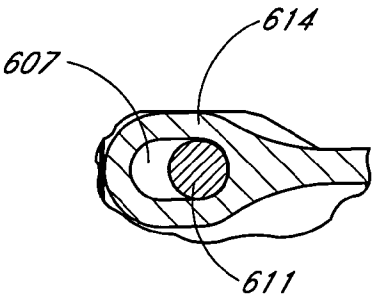
FIG. 27 is an exploded view of the aft end of the toe shown in FIG. 26.
Figure 26:
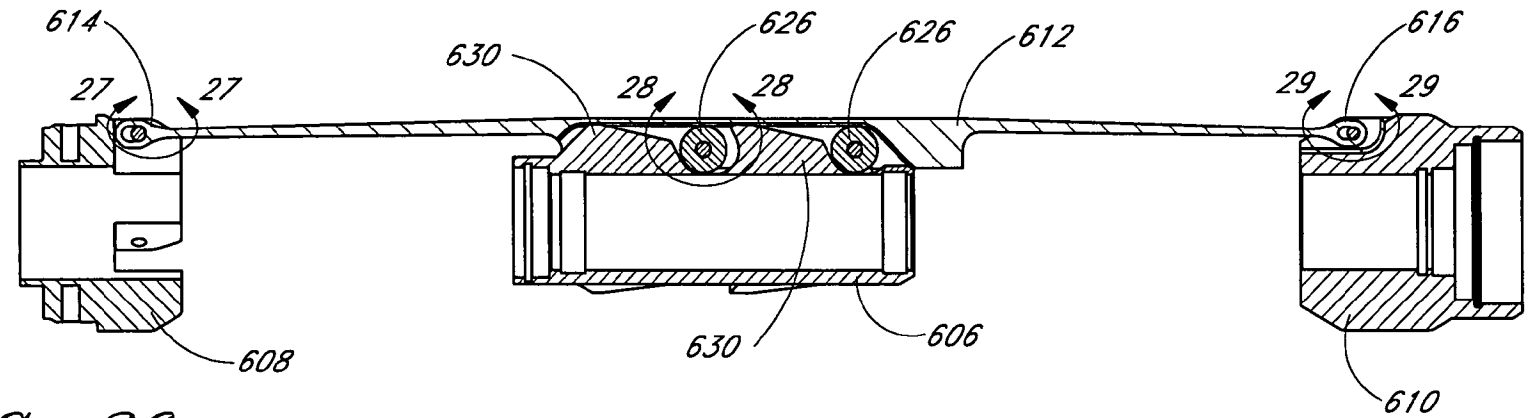
FIG. 26 is a longitudinal sectional view of the toe supports, slider element, and a single toe of the gripper assembly of FIG. 21, shown at a moment when an external load is applied to the toe.

FIGS. 22–29 illustrate the design of the toes 612, toe supports 608 and 610, and the slider element 606. The ends 614 and 616 of the toes 612 include elongated slots 607 and 609, respectively. The slots receive axles 611 secured to the toe supports 608 and 610. The slots 607 and 609 reduce potentially dangerous compression loads in the toes 612 when the toes experience external forces (e.g., sliding friction against the borehole surface). FIGS. 22–25 show a toe 612 in a normal position with respect to the (retracted) slider element 606 and toe supports 114 and 116, as the toe will shift forward due to gravity. FIGS. 26–29 show the toe 612 in a shifted position, which occurs when the toe experiences an aftwardly directed external force. As shown in FIGS. 24 and 28, as the toes 612 shift axially between these positions, the aft rollers 626 remain between the ramps 630 without rolling up the aft ramps. In other words, external forces applied to the toes do not cause the gripper assembly to self-energize.

Figure 32:
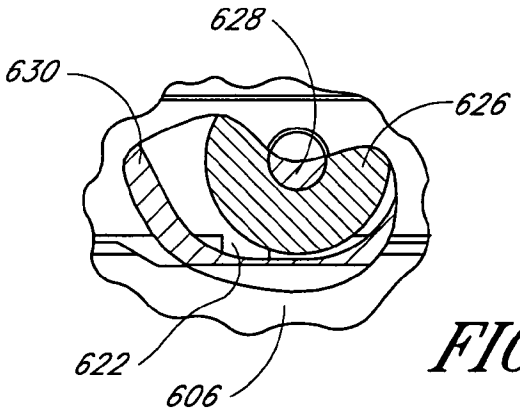
FIG. 32 is an exploded view of one of the rollers of the toe shown in FIG. 30.
Figure 31:
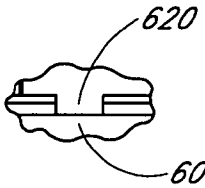
FIG. 31 is an exploded view of one of the spacer tabs of the toe shown in FIG. 30.
Figure 30:
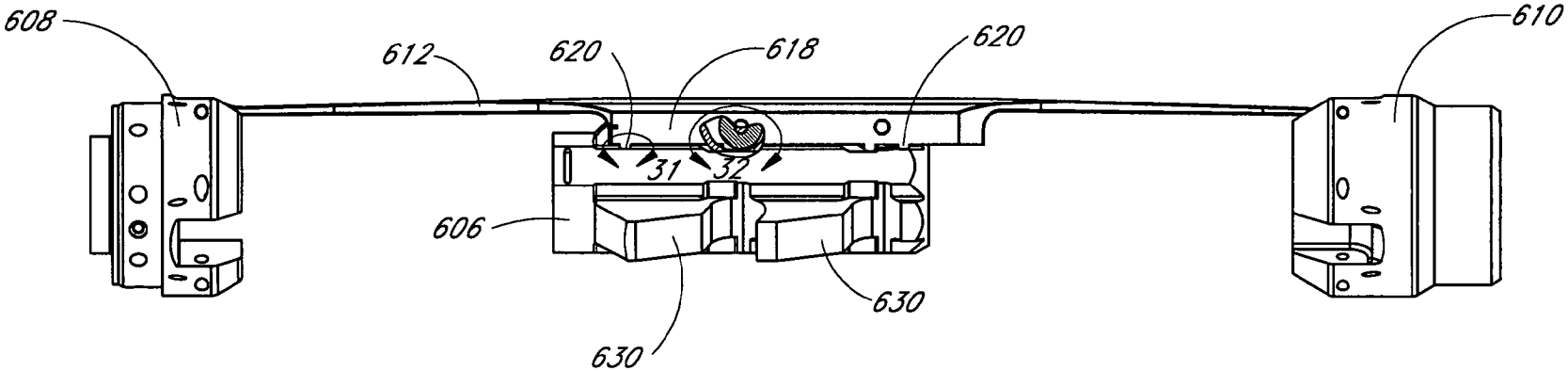
FIG. 30 is a partial cut-away side view of the toe supports, slider element, and a single toe of the gripper assembly of FIG. 21 shown at a moment when the toe is relaxed.

As shown in FIGS. 30 and 31, each toe 612 includes four spacer tabs 620 that extend radially inward from the toe's sidewalls 618. Two spacer tabs 620 are positioned on each sidewall 618, one tab near each end of the sidewall. The spacer tabs 620 are configured to bear against the slider element 606 when the toes 612 are relaxed. Also, as shown in FIG. 32, when the toes 612 are relaxed the rollers 626 do not contact the slider element 606. Thus, when the toes 612 are relaxed, the spacer tabs 620 absorb radial loads between the toes and the slider element 606 and also prevent undesired loading of the rollers 626 and roller axles 628.

Figure 34:
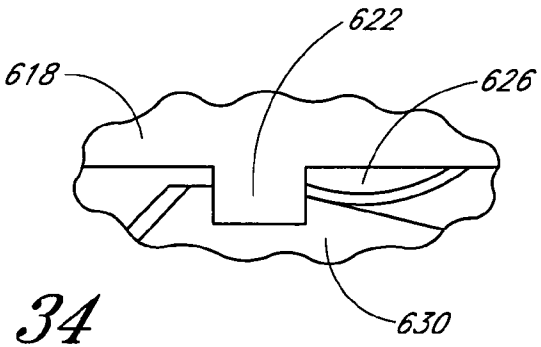
FIG. 34 is an exploded view of one of the alignment tabs of the toe shown in FIG. 33.
Figure 33:
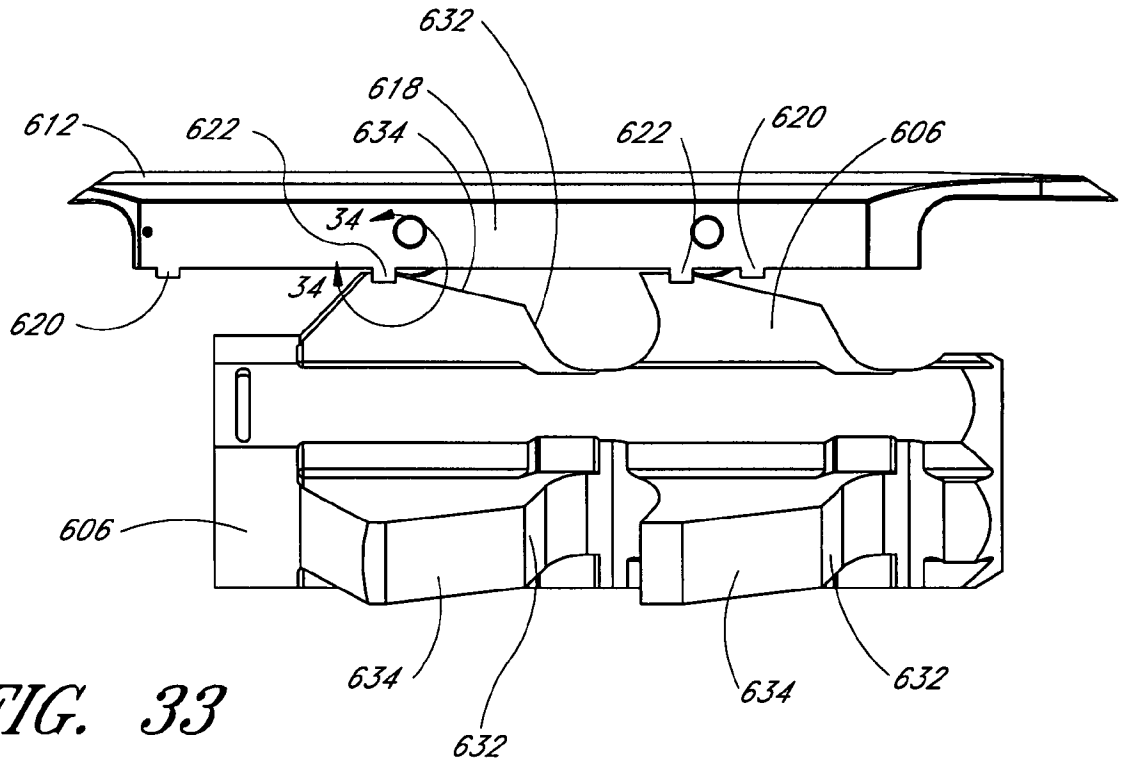
FIG. 33 is a side view of the slider element and a portion of one of the toes of the gripper assembly of FIG. 21, shown at a moment when the toe is radially deflected or energized.

As shown in FIGS. 33 and 34, each toe 612 includes four alignment tabs 622 that, like the spacer tabs 620, extend radially inward from the toe's sidewalls 618. A pair of alignment tabs 622 is provided for each of the ramp/roller combinations, one tab on each sidewall 618. Each pair of alignment tabs 622 straddles one of the ramps 630 and thus maintains the alignment between the roller 626 and the ramp. The alignment tabs 622 prevent the rollers 626 from sliding off of the sides of the ramps 630, particularly when the rollers are near the radial outward ends or tips of the ramps.

With reference to FIG. 33, each ramp 630 of the slider element 606 is configured to have a relatively steeper initial inclined surface 632 followed by a relatively shallower inclined surface 634. This causes the toes 612 to deflect radially outward at an initially high rate, followed by a low rate of deflection. Advantageously, during actuation of the gripper assembly, the toes 612 quickly approach the borehole surface. Before the toes 612 contact the borehole, the rate of expansion is slowed as the rollers roll along the shallower surfaces 634, to permit a degree of fine tuning of the radial expansion.

The gripper assemblies 104 and 106 are preferably formed of CuBe, but other materials can be employed. For example, the flexible toes can be formed of Titanium, and the mandrel can be formed of steel.

It will be understood that the tractor 100 can be utilized with any of a variety of different types of gripper assemblies. For example, U.S. Pat. No. 6,464,003 discloses a compatible gripper assembly in which toggles are utilized to radially expand flexible toes that grip a passage surface. Many compatible gripper designs comprise packerfeet. For example, U.S. Pat. No. 6,003,606 to Moore et al. discloses packerfeet that include borehole engagement bladders. Another reference, U.S. Pat. No. 6,347,674, discloses one packerfoot design having bladders strengthened by attached flexible toes and another packerfoot design in which the bladders and toes are not attached. Yet another reference, U.S. Pat. No. 6,431,291, discloses an improved packerfoot design.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. Further, the various features of this invention can be used alone, or in combination with other features of this invention other than as expressly described above. Thus, it is intended that the scope of the present invention herein disclosed should not be limited by the particular disclosed embodiments described above, but should be determined only by a fair reading of the claims that follow.

What is claimed is:

1. A tractor assembly for moving within a borehole, comprising:

an elongate body;

a first gripper assembly slidably coupled to said body for selectively gripping an inner surface of the borehole;

a second gripper assembly slidably coupled to said body for selectively gripping an inner surface of the borehole;

a first propulsion assembly for propelling said body through the borehole when said first gripper assembly is gripping the inner surface of the borehole;

a second propulsion assembly for propelling said body through the borehole when said second gripper assembly is gripping the inner surface of the borehole; and a valve system comprising:

a gripper control valve having a first position for directing pressurized fluid to said first gripper assembly, said gripper control valve having a second position for directing pressurized fluid to said second gripper assembly; and a propulsion control valve having a first position for directing pressurized fluid to said first propulsion assembly, said propulsion control valve having a second position for directing pressurized fluid to said second propulsion assembly;

said propulsion control valve being piloted by fluid pressures in said first and second gripper assemblies, said propulsion control valve moves from said first position to said second position only after said gripper control valve moves from said first position to said second position.

2. The tractor assembly of claim 1, wherein said valve system receives pressurized fluid from a supply source at a surface location for providing hydraulic power to said tractor assembly.

3. The tractor assembly of claim 1, wherein the speed of said tractor assembly through the borehole is at least partially controlled by the pressure and flow rate of the pressurized fluid into said valve system.

4. The tractor assembly of claim 1, wherein the position of said gripper control valve is controlled by fluid pressures in said first and second propulsion assemblies.

5. The tractor assembly of claim 4, wherein the fluid pressures in said first and second propulsion assemblies effect movement of said gripper control valve following propulsion of said body through the borehole relative to said first or second gripper assembly.

6. The tractor assembly of claim 1, wherein the position of said propulsion control valve is controlled by fluid pressures in a first flow path between the gripper control valve and the first gripper assembly and second flow path between the gripper control valve and the second gripper assembly.

7. The tractor assembly of claim 6, wherein the fluid pressures in said first and second flow paths effect movement of said propulsion control valve following expansion of said first or second gripper assembly.

8. The tractor assembly of claim 7, wherein said propulsion control valve comprises a spool with first and second ends, said first fluid path being in communication with said first end and said second fluid path being in communication with said second end.

9. The tractor assembly of claim 7, wherein expansion of said first or second gripper assembly produces fluid pressure changes in said first and second flow paths and wherein said propulsion control valve changes positions after a difference in the fluid pressures exceeds a predetermined threshold.

10. The tractor assembly of claim 9, wherein the difference in the fluid pressures exceeds the predetermined threshold only after said first or second gripper assembly has fully expanded to grip the inner surface of the borehole.

11. The tractor assembly of claim 1, further comprising at least one pressure control valve configured for limiting the fluid pressure in said first and second gripper assemblies.

12. The tractor assembly of claim 1, further comprising at least one inlet control valve for preventing pressurized fluid from entering said valve system from a pressurized source when the fluid at the pressurized source is outside a desired pressure range.

13. The tractor assembly of claim 1, wherein said elongate body further comprises first and second pistons longitudinally fixed with respect to said body, wherein said first propulsion assembly comprises a first propulsion cylinder formed with a first internal propulsion chamber for slidably receiving said first piston, and wherein said second propulsion assembly comprises a second propulsion cylinder formed with a second internal propulsion chamber for slidably receiving said second piston.

14. The tractor assembly of claim 1, further comprising a first cycle valve having an outlet flow for piloting said gripper control valve, said first cycle valve being configured to change positions after said body has been propelled through the borehole relative to said first gripper assembly.

15. The tractor assembly of claim 14, further comprising a second cycle valve having an outlet flow for piloting said gripper control valve, said second cycle valve being configured to change positions after said body has been propelled through the borehole relative to said second gripper assembly.

16. The tractor assembly of claim 1, wherein said first and second gripper assemblies expand radially to grip the inner surface of the borehole.

17. The tractor assembly of claim 1, wherein said elongate body is formed with an internal passage extending longitudinally therethrough, said internal passage being adapted for receiving pressurized fluid from a supply source.

18. The tractor assembly of claim 17, wherein said valve system is housed within said elongate body and said valve system receives a portion of the pressurized fluid from said internal passage.

19. The tractor assembly of claim 18, wherein a rate of advancement of said tractor assembly through the borehole is at least partially controlled by the pressure and flow rate of the pressurized fluid.

20. The tractor assembly of claim 1, wherein said tractor assembly is connected to a drill string and the speed of movement of said tractor assembly is at least partially controlled by the tension exerted on the tractor assembly by the drill string.

21. The tractor assembly of claim 1, wherein said elongate body is connectable to a component.

22. The tractor assembly of claim 21, wherein the component comprises a perforation gun assembly.

23. The tractor assembly of claim 21, wherein the component comprises an acidizing assembly.

24. The tractor assembly of claim 21, wherein the component comprises a sandwashing assembly.

25. The tractor assembly of claim 21, wherein the component comprises a bore plug setting assembly.

26. The tractor assembly of claim 21, wherein the component comprises a logging assembly.

27. The tractor assembly of claim 21, wherein the component comprises a bore casing locator.

28. The tractor assembly of claim 21, wherein the component comprises a measurement while drilling assembly.

29. The tractor assembly of claim 21, wherein the component comprises a fishing tool.

30. The tractor assembly of claim 21, further comprising an E-line.

31. The tractor assembly of claim 1, wherein said tractor assembly can pull at least 500 pounds but can exert no more than 100 psi on a surface surrounding said tractor assembly.

32. The tractor assembly of claim 1, wherein said tractor assembly can pull at least 3000 pounds but can exert no more than 3000 psi on a surface surrounding said tractor assembly.

33. The tractor assembly of claim 1, wherein a direction of travel of said tractor assembly through the borehole is hydraulically controlled.

34. A hydraulically controlled tractor assembly for moving within a borehole, comprising:

an elongate body;

first and second gripper assemblies slidably coupled to said body for selectively gripping an inner surface of the borehole;

first and second propulsion assemblies for propelling said body through the borehole while said first or second gripper assembly is gripping the inner surface of the borehole; and a valve system comprising:

a gripper control valve for directing pressurized fluid to said first and second gripper assemblies; and a propulsion control valve for directing pressurized fluid to said first and second propulsion assemblies;

movement of said tractor assembly through the borehole being entirely hydraulically controlled.

* * * * *